US007760161B2

(12) United States Patent
Sasaki et al.

(10) Patent No.: US 7,760,161 B2
(45) Date of Patent: Jul. 20, 2010

(54) CURRENT GENERATION SUPPLY CIRCUIT AND DISPLAY DEVICE

(75) Inventors: Kazuhiro Sasaki, Sagamihara (JP); Katsuhiko Morosawa, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 1046 days.

(21) Appl. No.: 10/891,904

(22) Filed: Jul. 14, 2004

(65) Prior Publication Data

US 2005/0017765 A1 Jan. 27, 2005

(30) Foreign Application Priority Data

Jul. 16, 2003 (JP) ..... 2003-275077

(51) Int. Cl.
*G09G 3/30* (2006.01)

(52) U.S. Cl. ..... 345/76; 345/77; 345/80; 345/204

(58) Field of Classification Search ..... 345/76–77, 345/80, 204
See application file for complete search history.

(56) References Cited

U.S. PATENT DOCUMENTS 6,266,000 B1 7/2001 Jusuf et al.
6,323,631 B1 11/2001 Juang
6,528,951 B2 3/2003 Yamazaki et al.
6,556,176 B1 * 4/2003 Okuyama et al. ..... 345/76
6,583,775 B1 * 6/2003 Sekiya et al.
6,765,560 B1 7/2004 Ozawa
6,777,885 B2 * 8/2004 Koyama
6,882,186 B2 4/2005 Nishitoba
7,012,597 B2 * 3/2006 Kasai ..... 345/204

(Continued)

FOREIGN PATENT DOCUMENTS

CN 1402208 A 3/2003

(Continued)

OTHER PUBLICATIONS

Related U.S. Appl. No. 10/880,298, filed Jun. 28, 2004; Applicants: Tsuyoshi Toyoshima et al; Title: Current Generation Supply Circuit and Display Device.

(Continued)

*Primary Examiner*—Richard Hjerpe
*Assistant Examiner*—Leonid Shapiro
(74) *Attorney, Agent, or Firm*—Frishauf, Holtz, Goodman & Chick, P.C.

(57) ABSTRACT

A current generation supply circuit which supplies drive currents corresponding to digital signals for a plurality of loads comprising a signal holding circuit which takes in and holds the digital signals, a current generation circuit which generates the drive currents having a ratio of current values corresponding to the values of the digital signals held in the signal holding circuit relative to the reference current supplied from a constant current source and supplied to the loads, and an operational state setting circuit which overlaps in terms of time and sets the operating state in the signal holding circuit and the current generation circuit in order to execute at least a take-in and hold operation of the digital signals in the signal holding circuit and a generation supply operation of the drive currents in the current generation circuit; as well as raises the operating speed of the current generation supply circuit.

60 Claims, 27 Drawing Sheets

U.S. PATENT DOCUMENTS

| | | | | |
|---|---|---|---|---|
| 7,091,937 | B2 | 8/2006 | Nakamura | |
| 7,256,756 | B2 | 8/2007 | Abe | |
| 2002/0021293 | A1 | 2/2002 | Tam | |
| 2002/0041276 | A1 | 4/2002 | Kimura | |
| 2002/0084812 | A1 | 7/2002 | Nishitoba | |
| 2002/0135314 | A1 | 9/2002 | Kitahara et al. | |
| 2003/0040149 | A1 | 2/2003 | Kasai | |
| 2003/0048669 | A1* | 3/2003 | Abe | |
| 2003/0058199 | A1 | 3/2003 | Kasai | |
| 2003/0648669 | | 3/2003 | Abe | |
| 2003/0128200 | A1 | 7/2003 | Yumoto | |
| 2003/0151616 | A1 | 8/2003 | Morita | |
| 2004/0075621 | A1* | 4/2004 | Shiuan et al. | 345/1.1 |
| 2004/0108998 | A1 | 6/2004 | Imamura | |
| 2004/0239668 | A1 | 12/2004 | Morosawa et al. | |
| 2004/0263437 | A1 | 12/2004 | Hattori | |
| 2005/0017931 | A1 | 1/2005 | Toyoshima et al. | |
| 2005/0057580 | A1 | 3/2005 | Yamano et al. | |
| 2005/0157580 | A1* | 7/2005 | Ferrant et al. | |
| 2005/0157581 | A1 | 7/2005 | Shiurasaki et al. | |
| 2007/0217275 | A1 | 9/2007 | Abe | |

FOREIGN PATENT DOCUMENTS

| | | | |
|---|---|---|---|
| DE | 10028598 | A1 | 3/2001 |
| EP | 0365445 | A2 | 4/1990 |
| EP | 1039440 | A1 | 9/2000 |
| EP | 1182636 | A2 | 2/2002 |
| EP | 1 282 103 | A2 | 2/2003 |
| EP | 1 288 901 | A2 | 3/2003 |
| EP | 1333422 | A1 | 8/2003 |
| JP | 04-042619 | A | 2/1992 |
| JP | 7-202599 | A | 8/1995 |
| JP | 08-129359 | A | 5/1996 |
| JP | 10-093436 | A | 4/1998 |
| JP | 2000-105574 | A | 4/2000 |
| JP | 2000-122608 | A | 4/2000 |
| JP | 2000-340842 | A | 12/2000 |
| JP | 2002-140041 | A | 5/2002 |
| JP | 2002-202823 | A | 7/2002 |
| JP | 2003-122303 | A | 4/2003 |
| JP | 2003-150082 | A | 5/2003 |
| JP | 2003-150112 | A | 5/2003 |
| JP | 2003-150115 | A | 5/2003 |
| JP | 2003-195812 | A | 7/2003 |
| JP | 2003-195815 | A | 7/2003 |
| JP | 2003-308043 | A | 10/2003 |
| JP | 2004-037656 | A | 2/2004 |
| JP | 2004-054234 | A | 2/2004 |
| KR | 1988-0014748 | A | 12/1988 |
| KR | 2000-0073726 | A | 12/2000 |
| KR | 2001-0007609 | A | 1/2001 |
| WO | WO 01/006484 | A1 | 1/2001 |
| WO | WO 02/017289 | A1 | 2/2002 |
| WO | WO 02/039420 | A1 | 5/2002 |
| WO | WO 03/023752 | A1 | 3/2003 |
| WO | WO 03/027998 | A1 | 4/2003 |

OTHER PUBLICATIONS

Chinese Office Action dated Jun. 22, 2007 (and English translation thereof) which issued in a Chinese application corresponding to related U.S. Appl. No. 10/880,298. 19 pages.

Goh, Joon-Chul, et al, "A New Pixel Circuit for Active Matrix Organic Light Emitting Diodes", IEEE Electron Device Letters, vol. 23, No. 9, Sep. 2002, pp. 544-546.

Tan, S.C. et al, "Designing of Circuit Building Blocks for OLED-on-Silicon Microdisplays", SID, 2002 Digest, pp. 980-983, School of Electrical & Electronic Engineering, pp. 980-983.

Related U.S. Appl. No. 10/855,584; filed May 26, 2004; Inventors: Katsuhiko Morisawa et al; Title: Display Device and Method for Driving Display Device.

Related U.S. Appl. No. 10/880,298; filed Jun. 28, 2004; Inventors: Tsuyoshi Toyoshima et al; Title: Current Generation Supply Circuit and Display Device.

Related U.S. Appl. No. 10/532,889; filed Apr. 27, 2005; Inventors: Katsuhiko Morosawa et al; Title: Display Device and Method for Driving Display Device.

International Search Report and Written Opinion (in English) dated Jul. 29, 2004 that issued in International Application No. PCT/JP03/13819, which is a counterpart of related U.S. Appl. No. 10/532/889.*

* cited by examiner

CURRENT GENERATION SUPPLY CIRCUIT AND DISPLAY DEVICE

CROSS-REFERENCE TO RELATED APPLICATION

This application is based upon and claims the benefit of priority from the prior Japanese Patent Application No. 2003-275077, filed Jul. 16, 2003, the entire contents of which is incorporated herein by reference.

BACKGROUND OF THE INVENTION

1. Field of the Invention

The present invention relates to a current generation supply circuit, a display device comprising the current generation supply circuit, and a drive control method of the display device; and more particularly related to a display panel comprising with display pixels comprising current control type light emitting devices for executing a light generation operation at predetermined luminosity gradations based on gradation currents corresponding to the display signals. Furthermore, the present invention is related to a current generation supply circuit which advances miniaturization of the display panel while acquiring superb image quality.

2. Description of the Related Art

In recent years, as the next generation display device (display) following liquid crystal displays (LCD's) which at present are abundantly used as monitors and displays for personal computers and video equipment, Research and Development (R&D) toward full utilization of self-luminescence type display devices (display devices) comprising a display panel arranged in a matrix form consisting of self-luminescent type optical devices such as organic electroluminescent devices (hereinafter, referred to as "organic EL devices"), in organic electro luminescent devices or Light Emitting Diodes (LEDs), etc. is actively being developed.

In such a self-luminescent type display, and particularly a self-luminescent type display which applies an active-matrix drive method and as compared with an LCD provides a more rapid display response speed as well as there is no viewing angle dependency. As backlight is not needed like an LCD, this very predominant feature enhances the clarity of displayed images and makes even higher contrast and higher luminosity more practicable in the years ahead. Thus, the likelihood is inevitable of further miniaturized, low-powered and thin-shaped displays in the future.

This self-luminescence type display according to such an active-matrix drive method, in summary, comprises a display panel with display pixels containing light emitting devices arranged near each of the intersecting points of the scanning lines positioned in rows and the data lines positioned in columns; a data driver which generates gradation signals corresponding to the image display signals (display data) for supplying each of the display pixels via the data lines; and a scanning driver which sequentially applies scanning signals at predetermined timing to sets specified lines of the display pixels as the selection state. By supplying gradation signals from the data driver to each of the display pixels set as the selection state by the scanning driver, each of the display pixels (light emitting devices) execute the light generation operation at predetermined luminosity gradations corresponding to the display data and is configured so that the desired image information is displayed on the display panel.

As the drive methods in such a display, the voltage specification type drive method and the current specification type drive method are primarily known. Notably, the voltage specification type drive method controls the current values of the light generation drive currents flowed to each of the light emitting devices for executing the light generation operation by predetermined luminosity through adjusting the current values (gradation signal voltages) of the gradation signals corresponding to the display data applied by the data driver relative to the display pixels (light emitting devices) of specified lines selected by the scanning driver. Further, the current specification type drive method controls the current values of the light generation drive currents flowed to each of the light emitting devices by means of adjusting the current values (gradation currents) of the gradation signals supplied by the data driver.

The active devices (Thin-Film Transistors, etc.) which constitute these pixel driver circuits are susceptible to characteristic changes influenced by the external environment and deterioration with age. Accordingly, variations in the current values of the light generation drive currents become noticeably greater over a period of time, thereby resulting in the troublesome problem of acquiring the desired luminescent characteristic in a stable state.

Conversely, the current application type drive method has the predominance that the device characteristics can be controlled and suppressed. Configurations of the data driver applicable to the display employing such a current application type method, for example, generate gradation currents corresponding to display data based on reference current supplied via a current supply source line from a current source and are configured so that each of the display pixels can be supplied via each of the data lines. In this instance, as the gradation currents supplied to each of the data lines change corresponding to the display data, the reference current supplied to the current supply source line will also change corresponding to the display data. However, because the capacity component (parasitic capacitance), such as the wiring capacity, etc., exists in the signal wiring for supplying the reference current via the current supply source line is equivalent to charging or discharging at predetermined potential the capacity component which exists in the concerned current supply source line. Therefore, when the reference current supplied particularly via the current supply source line is exceptionally low, the charge and discharge operation takes time and until the potential of the current supply source line is stabilized, a relatively lengthy period is required Here, in order for the charge and discharge operation to the current supply source line to take a certain amount of time as mentioned above and although the time period allocated for generating the drive currents for every data line in the data driver decreases as the number of display pixels increases with miniaturization of the display panel, as the number of data lines and scanning lines increase and the drive time for every scanning line decreases a faster higher speed operation is required. Accordingly, rate control of the operating speed in the data driver originating in the amount of time the charge and discharge operation takes to be completed is highly difficult to contend with in greater miniaturization of the display panel has the disadvantage of causing deterioration of the display quality.

SUMMARY OF THE INVENTION

The present invention comprises a current generation supply circuit which supplies drive currents corresponding to digital signals to a plurality of loads and this current generation supply circuit comprises a driver circuit in a display device which displays image information on a display panel having current control type light emitting devices. The present invention produces various effects such as significantly increasing the operating speed of the data driver, elevating the display response speed and reducing the circuit scale for greater miniaturization of the display panel with the main purpose of noticeably improving the display image quality.

The present invention of the current generation supply circuit for acquiring the above-mentioned effects comprises the current generation supply circuit comprising a signal holding circuit which takes-in and holds the digital signals, a current generation circuit which generates and supplies to the plurality of loads the drive currents having a ratio of current values corresponding to the digital signal values held in the signal holding circuit relative to reference current supplied from a constant current source, and an operational state setting circuit which sets the operating state in the signal holding circuit and the current generation circuit to execute with overlapped timing at least a take-in and hold operation of the digital signals in the signal holding circuit and a generation supply operation of the drive currents in the current generation circuit, which sets the polarity of the drive currents in order to flow the drive currents in the direction flowed from the loads side and sets the polarity of the drive currents in order to flow the drive currents in the direction flowed to the loads side.

The above-mentioned current generation supply circuit comprises two sets of the signal holding circuit which constitute initial stage and latter stage signal holding circuits connected in series with each other, and the operational state setting circuit which sets the operating state to execute with overlapped timing an operation which take-in and hold the digital signals in the initial stage signal holding circuit and an operation which outputs the outputted signals to the current generation circuit based on each bit value of the digital signals held in the latter stage signal holding circuit; or comprises two sets of the current generation circuit connected in parallel with each other and the operational state setting circuit which selectively sets the operating state in the two sets of current generation circuits for supplying the outputted signals to the two sets of current generation circuits based on each bit value of the digital signals held in the signal holding circuits and which executes an operation for generating the drive currents in either of the two sets of current generation circuits corresponding to each bit value of the digital signals.

The current generation supply circuit comprises a charge storage circuit which stores electrical charges corresponding to the current component of the reference current; the above-mentioned current generation supply circuit comprises a refresh circuit which refreshes the charge amount stored in the charge storage circuit provided in the current generation circuit to the charge amount corresponding to the reference current, and the operational state setting circuit comprises a means which sets the operating state in the refresh circuit; the operational state setting circuit which sets the operating state to execute with overlapped timing a take-in and hold operation of the plurality of digital signal bits in the signal holding circuit and a refresh operation of the charge storage circuit in the refresh circuit or the operational state setting circuit which sets the operating state to execute without overlapped timing a take-in and hold operation of the digital signals in the signal holding circuit, a generation supply operation of the drive currents in the current generation circuit and a refresh operation of the charge storage circuit in the refresh circuit.

The current generation supply circuit comprises a module current generation circuit which generates a plurality of module currents having a ratio of current values different from each other relative to the reference current corresponding to each bit value of the digital signals; each current value of the plurality of module currents has a different ratio from each other defined by $2^n$ (n=0, 1, 2 and 3, . . . ); the module current generation circuit comprises a reference current transistor in which the reference current flows and a plurality of module current transistors in which each of the module currents flow; each control terminal of the reference current transistor and the plurality of module current transistors are connected in common and constitute a current mirror circuit; the plurality of module current transistors are designed so that the transistor sizes differ from each other; and the plurality of module current transistors each channel width is set at a different ratio from each other defined by $2^n$ (n=0, 1, 2 and 3, . . . ).

Additionally, the current generation circuit further comprises a current selection circuit which selectively integrates the plurality of module currents and generates the drive currents corresponding to each bit value of the digital signals held in the signal holding circuit; the current selection circuit comprises a selection switch which selects the plurality of module currents corresponding to each bit value of the digital signals.

The display device for acquiring the above-mentioned effects comprises a display panel comprising a plurality of scanning lines and a plurality of signal lines positioned to intersect perpendicularly with each other and a plurality of display pixels arranged in matrix form near the intersecting points of the scanning lines and the signal lines, a scanning driver circuit which applies sequentially applies scanning signals to the plurality of scanning lines for setting a selection state in each of the display pixels a-line-at-a-time, a signal driver circuit comprising at least one set of a plurality of gradation current generation supply circuits comprising a signal holding circuit which takes in and holds the digital signals of the display signals corresponding to the plurality of signal lines, a gradation current generation circuit which generates gradation currents having a ratio of current values and supplies the plurality of signal lines corresponding to the values of the digital signals held in the signal holding circuit relative to the reference current supplied from a constant current source; and an operational state setting circuit which sets the operating state in the signal holding circuit and the gradation current generation circuit to execute with overlapped timing at least a take-in and hold operation of the digital signals in the signal holding circuit and a generation supply operation of the gradation currents in the gradation current generation circuit, which sets the polarity of the gradation currents in order to flow in the direction the gradation currents flow via the signal lines from the display pixel side or sets the polarity of the gradation currents in order to flow in the direction which flows the gradation currents toward the display pixel side via the signal lines.

The gradation current generation supply circuit comprises two sets of the signal holding circuits which constitute an initial stage and a latter stage signal holding circuit connected in series with each other, and the operational state setting circuit which sets the operating state to execute with overlapped timing at least an operation which takes in and holds the display signals to the initial stage signal holding circuit and an operation which outputs the outputted signals to the current generation circuit based on each bit value of the digital signals held in the latter stage signal holding circuit; or the gradation current generation supply circuit comprises two sets of the gradation current generation circuit connected in parallel with each other, and the operational state setting circuit which sets selectively the operating state of two sets of the gradation current generation circuits at least executes an operation which generates the gradation currents corresponding to each bit value of the display signals in either of the two sets of gradation current generation circuits and which supplies the outputted signals based on each bit value of the display signals held in the signal holding circuit supplied to the two sets of gradation current generation circuits; or the signal driver circuit comprises two sets of the gradation current generation supply circuit group at least for each of the plurality of signal lines, each of the gradation current generation supply circuit groups are arranged in position at opposite ends of the display panel, and the operational state setting circuit which sets the operating state to execute with overlapped timing at least a take-in and hold operation of the plurality of digital signal bits in each of the signal holding circuits of one group of the gradation current generation supply circuit group and a generation supply operation of the gradation currents in each of the gradation current generation circuits of the opposite group of the gradation current generation supply circuit group; or the signal driver circuit comprises two sets of the gradation current generation supply circuit group at least corresponding to each of the signal lines of these groups and the plurality of signal lines are grouped into two sets, each gradation current generation supply circuit group, for example, are arranged in position at opposite ends from each other and the operational state setting circuit which sets the operating state to execute with overlapped timing at least a take-in and hold operation of the digital signals in each of the signal holding circuits of one group of the gradation current generation supply circuit group and a generation supply operation of the gradation currents in each of the gradation current generation circuits of the opposite group of the gradation current generation supply circuit group, each group is grouped to the same number of each one of the signal lines among the plurality of signal lines allocated to the display panel, or each group is grouped to the same number of each one of the signal lines of each predetermined number among the plurality of signal lines allocated to the display panel and grouped.

The gradation current generation circuit comprises a charge storage circuit which stores electrical charges corresponding to the current component of the reference current; the gradation current generation supply circuit comprises a refresh circuit which refreshes the charge amount stored in the charge storage circuit provided in the current generation circuit to the charge amount corresponding to the reference current and the operational state setting circuit comprises a means which sets the operating state in the refresh circuit which sets the operating state to execute with overlapped timing a take-in and hold operation of the display signals in the signal holding circuit, and a refresh operation of the charge storage circuit in the refresh circuit or sets the operating state to execute without overlapped timing a take-in and hold operation of the display signals in the signal holding circuit and a generation supply operation of the drive currents in the gradation current generation circuit and a refresh operation of the charge storage circuit in the refresh circuit.

The gradation current generation circuit comprises a module current generation circuit which generates the plurality of module currents having a ratio of current values different from each other relative to the reference current, wherein each current value of the plurality of module currents has a different ratio from each other defined by 2n (n=0, 1, 2 and 3, . . . ); the module current generation circuit comprises a reference current transistor in which the reference current flows and a plurality of module current transistor in which each of the module currents flow, wherein the reference current transistor and the plurality of module current transistors are connected in common and each control terminal constitutes a current mirror circuit, wherein the plurality of module current transistors are designed so that the transistor sizes differ from each other, wherein the plurality of module current transistors each channel width is set at a different ratio from each other defined by 2n (n=0, 1, 2 and 3, . . . ).

In addition, the gradation current generation circuit further comprises a current selection circuit which integrates selectively the plurality of module currents corresponding to each bit value of the digital signals held in the signal holding circuit and generates the gradation currents; wherein the current selection circuit comprises a selection switch which selects the plurality of module currents corresponding to each bit value in the digital signals of the display signals.

Also, the gradation current generation supply circuit comprises a specified state setting circuit which applies specified voltage to the scanning lines for making the optical elements drive at a specified operating state, wherein the above specified values of the display signals are the values in which each of the module currents are entirely non-selected by each bit in the digital signals of these display signals, and the specified voltage is the voltage for making the optical elements drive in the state of the lowermost gradation.

Moreover, the display pixels in the display panel comprise current control type light emitting devices which perform a light generation operation by predetermined luminosity gradations corresponding to the current values of the gradation currents, and the display pixels comprise pixel driver circuits which hold the gradation currents, generate the light generation currents based on the held gradation currents and is supplied to the light emitting devices, the light emitting devices, for example, are organic electroluminescent devices.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BEST MODE FOR CARRYING OUT THE INVENTION

Figure 1:
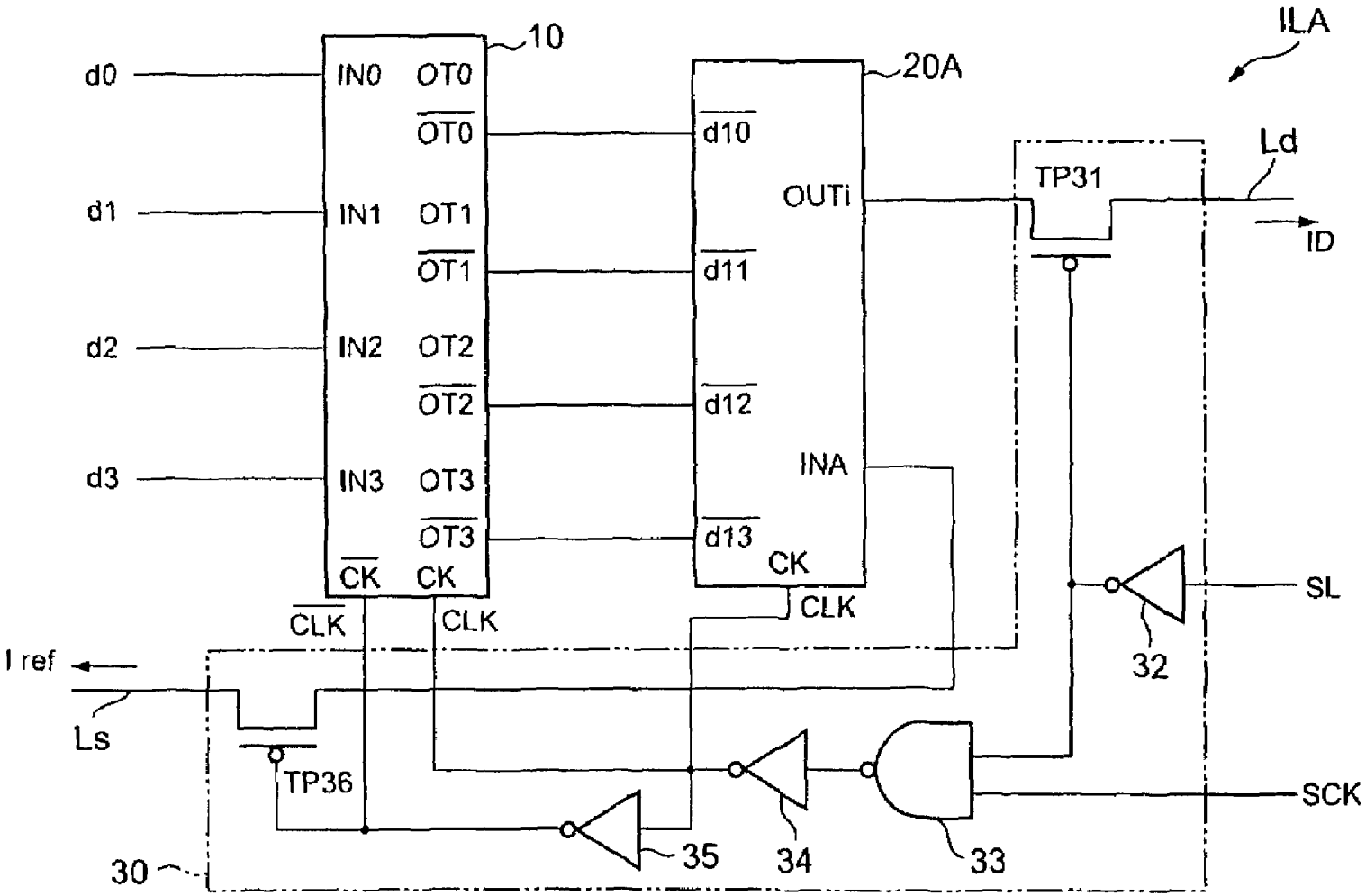
FIG. 1 is an outline configuration diagram showing the first embodiment of the current generation supply circuit related to the present invention.

Hereinafter, the embodiments shown in the drawings of the display device provided with the current generation supply circuit related to the present invention and associated current generation supply circuits will be explained in detail.

Initially, the current generation supply circuit related to the present invention and associated control method will be explained with reference to the drawings.

FIRST EMBODIMENT OF THE CURRENT GENERATION SUPPLY CIRCUIT

The first embodiment of the current generation supply circuit will be explained.

FIG. 1 is an outline configuration diagram showing the first embodiment of the current generation supply circuit related to the present invention.

Figure 2A:
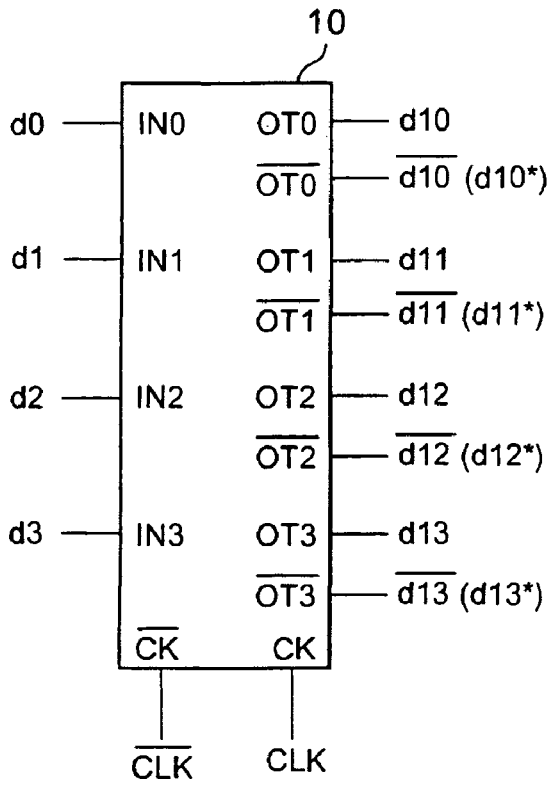
FIGS. 2A and 2B are outline configuration diagrams showing the signal holding circuit applied to the current generation supply circuit related to the embodiments.
Figure 2B:
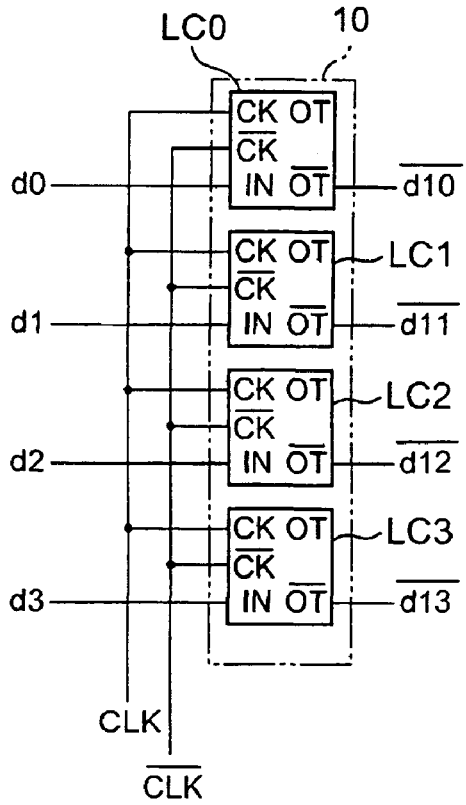

FIGS. 2A and 2B are outline configuration diagrams showing the signal holding circuit applied to the current generation supply circuit related to the embodiments.

Figure 3:
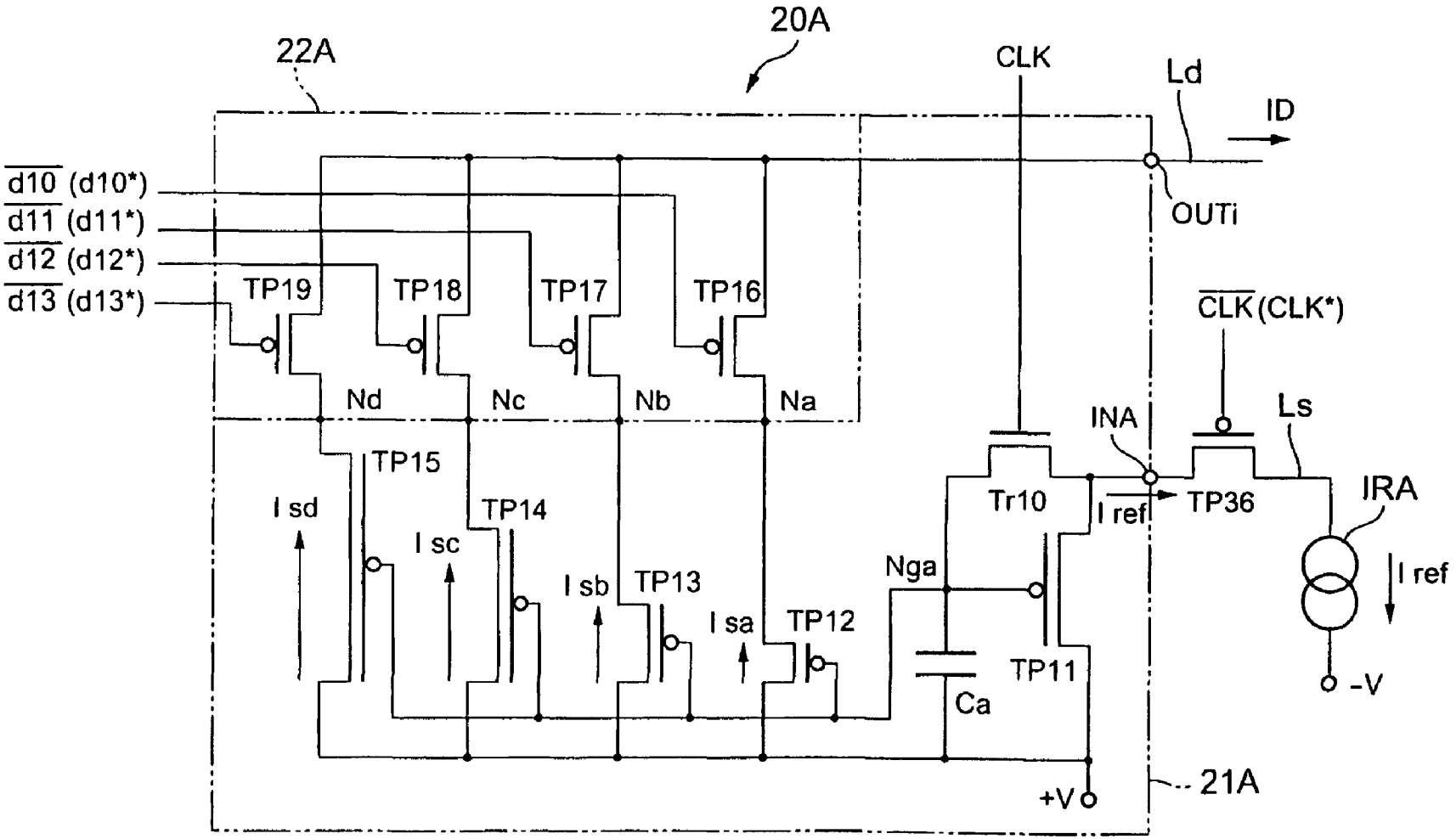
FIG. 3 is a circuit configuration drawing showing an illustrative example of the current generation circuit applied to the current generation supply circuit related to the embodiments.

FIG. 3 is a circuit configuration drawing showing an illustrative example of the current generation circuit applied to the current generation supply circuit related to the embodiments.

As shown in FIG. 1, the current generation supply circuit ILA has a configuration comprising at least a data latch section 10 (signal holding circuit), a current generation section 20A (current generation circuit) and an operation setting section 30 (operational state setting circuit). The data latch section 10 takes in and holds (latches) a plurality of digital signal bits (In the embodiments, a case of 4-bits is illustrated for convenience) d0, d1, d1 and d3 (d0~d3) for specifying current values. The current generation section 20A takes in the reference current Iref which has a constant current value supplied from an external constant current generation source (constant current source) via the reference current supply line Ls, generates the load drive currents ID (drive currents) having a predetermined ratio of current values relative to the above-mentioned reference current and supplies the loads (For example, the display pixels in the display device described later.) via the drive currents supply line Ld based on the output signals (inverted output signals) d10*, d11*, d12* and d13* (d10*~d13*; hereinafter in the specification, the appended asterisk (*) denotes reverse polarity for convenience.) outputted from the above-mentioned data latch section 10. The operation setting section 30 sets the operating state (data sampling operation, data output operation, refresh operation) of the current generation supply circuit ILA based on the timing control signal SCK and the selection setting signal SL outputted from an external control circuit comprising a timing generator, a shift register, etc.

Hereinafter, each of the above-mentioned components will be explained in detail.

Specifically, the data latch section 10 (signal holding circuit), shown in FIGS. 2A and 2B has a configuration in which a number of latch circuits LC0, LC1, LC2 and LC3 (LC0~LC3) are provided in parallel corresponding to the bit number (4-bits) of the digital signals d0~d3. Based on the above-mentioned timing control signal SCK, the non-inverted clock signal CLK and the inverted clock signal CLK* are generated in the operation setting section 30 described later. By means of timing when the non-inverted clock signal CLK generates high-level (inverted clock signal CLK* is in low-level), the above-mentioned digital signals d0~d3 supplied individually and respectively are taken in simultaneously; and by means of timing when the non-inverted clock signal CLK generates low-level (inverted clock signal CLK* is in high level), an operation (signal hold operation) is executed which outputs and holds this signal level based on the taken in digital signals d0~d3. Additionally, in the data latch section 10 shown in FIG. 1 or FIG. 2A, IN0~IN3 respectively show the input contact points IN of each of the latch circuits LC0~LC3 illustrated in FIG. 2B; OT0~OT3 respectively show the non-inverted output contact points OT of each of the latch circuits LC0~LC3; and OT0*~OT3* respectively show the inverted output contact points OT* of each of the latch circuits LC0~LC3.

The current generation section 20A (current generation circuit), as shown in FIG. 3, comprises a current mirror circuit section 21A (module current generation circuit) and a switching circuit section 22A (current selection circuit). The current mirror circuit section generates a plurality of the module currents Isa, Isb, Isc and Isd (Isa~Isd) having a ratio of current values different from each other relative to the reference current Iref supplied from a constant current generation source IRA. The switching circuit section 22A selects and integrates random module currents from among a plurality of the module currents Isa~Isd based on the output signals (inverted output signals) d10*~d13* (The signal levels of the inverted output contact points OT0*~OT3* shown in FIG. 1 and FIG. 2) outputted individually from each of the latch circuits LC0~LC3 of the data latch section 10 described above.

The current mirror section 21A (module current generation circuit), specifically as shown in FIG. 3, has a configuration comprising a reference current transistor TP11, the module current transistors TP12, TP13, TP14, TP15 (TP12~TP15), are fresh control transistor Tr10 (refresh circuit) and a capacitor Ca (charge storage circuit). The reference current transistor TP11 consists of a p-channel Field-Effect Transistor (FET) (hereinafter denoted as "Pch FET") by which the control terminal (gate terminal) is connected to the contact Nga while the current path (source-drain) is connected between the high electric potential +V and the current input contact INA to which the reference current Iref is supplied (drawn out) via the reference current supply line Ls (and a current supply source control transistor TP36) from the external constant current generation source IRA. The module current transistors TP12~TP15 consist of a plurality of Pch FETs (four corresponding to the latch circuits LC0~LC3) by which the control terminals are connected in common to the contact Nga while each current path is connected between the high electric potential +V and each of the contacts Na, Nb, Nc and Nd (Na~Nd). The refresh control transistor Tr10 consists of an n-channel Field-Effect Transistor (FET) (hereinafter denoted as "Nch FET") by which the continuity condition (switch "ON/OFF" operation) is controlled and the non-inverted clock signal CLK outputted from the operation setting section 30 is applied to the control terminal while the current path is connected between the contact Nga and the current input contact INA. The capacitor Ca is connected between the high electric potential +V and the contact Nga (gate terminal of the reference current transistor TP11).

Furthermore, the current input contact INA provided in the operation setting section 30 described later is connected to a current supply source control transistor TP36 which consists of a Pch FET and the constant current generation source IRA via the reference current supply line Ls. This configuration is set so that the reference current Iref having a constant current value can be drawn out corresponding to the continuity condition of the current supply source control transistor TP36. Here, the constant current generation source IRA as mentioned above, the other end side is connected to the low electric potential −V (For example, the ground potential Vgnd.) so as to flow the reference current Iref in the direction drawn from the current generation supply circuit ILA. Also, in FIG. 3, the scale correlation in the transistor sizes of the reference current transistor TP11 which constitutes the current mirror circuit 21A and each of the module current transistors TP12~TP15 is shown conceptually and for convenience by changing the widths of the transistor circuit symbols.

The switching circuit section 22A (current selection circuit), which is provided in the operation setting section 30 described later, has a configuration comprising the switching transistors TP16, TP17, TP18 and TP19 (TP16~TP19). The switching transistors TP16~TP19 consist of a plurality of Pch FETs (four) by which the output signals d10*~d13* outputted individually from each of the latch circuits LC0~LC3 of the above-mentioned data latch section 10 are applied in parallel to the control terminals. The current path is connected between each of the contacts Na~Nd and the current output contact OUTi establishing a direct connection to the loads (Refer to FIG. 1) via an output control transistor TP31 consisting of a Pch FET and the drive current supply line Ld.

Here, particularly in the current generation section 20A related to the embodiments, the module currents Isa~Isd which flow to each of the module current transistors TP12~TP15 are set to have a ratio of current values different from each other relative to the constant reference current Iref which flows to the reference current transistor TP11 established in the current mirror circuit section 21A stated above.

Specifically, the transistor size of each of the module current transistors TP12~TP15 is set at a different ratio from each other. For example, while assuming fixed channel length in the FETs which constitute each of the module current transistors TP12~TP15, each channel width ratio is designed to be W12:W13:W14:W15=1:2:4:8. W12 indicates the channel width of the module current transistor TP12, W13 indicates the channel width of the module current transistor TP13, W14 indicates the channel width of the module current transistor TP14 and W15 indicates the channel width of the module current transistor TP15.

Accordingly, in the state where both the refresh control transistor Tr10 and the current supply source control transistor TP36 described later perform an "ON" operation, with the channel width of the reference current transistor TP11 set to W11, the current values of the module currents Isa~Isd which flow to each of the module current transistors TP12~TP15 are each other set as Isa=(W12/W11)×Iref, Isb=(W13/W11)×Iref, Isc=(W14/W11)×Iref and Isd=(W15/W11)×Iref. Therefore, the current values of each of the module currents Isa~Isd can be set to a ratio defined by $2^n$ as a result of setting each channel width of the module current transistors TP12~TP15 so that each other converts to a relation of $2^n$ (n=0, 1, 2, 3, . . . ; $2^n$=1, 2, 4, 8, . . . ).

In the current generation section 20A which has such a configuration, in response to the signal levels of the output signals d10*~d13* from the above-mentioned latch circuits LC0~LC3, the particular switching transistors of the switching circuit section 22A perform an "ON" operation (Instances when any one or more of the switching transistors TP16~TP19 perform an "ON" operation, besides occurrences when any of the switching transistors TP16~TP19 perform an "OFF" operation is included.). The module currents Isa~Isd having a predetermined ratio of current values ($a\times2^n$) gradations; a is the constant defined by the channel width W11 of the reference current transistor TP11) relative to the reference current Iref which flows to the reference current transistor TP11 flow to the module current transistors (any one or more combination of TP12~TP15) of the current mirror circuit section 21A connected to the switching transistors that perform an "ON" operation toward the current output contact OUTi mentioned above. The load drive currents ID which have current values using the composite value of these module currents flow in the direction of the loads from the high electric potential +V to the module current transistors (any of TP12~TP15) connected to the switching transistors (any of TP16~TP19) in an "ON" state toward the current output contact OUTi via the drive current supply line Ld.

Therefore, the load drive currents ID having current values of 2″ step are generated corresponding to the bit number "n" of the digital signals. Accordingly, when the 4-bit digital signals d0~d3 are applied such as in this embodiment which correspond to the "ON" state of the switching transistors TP16~TP19 connected to each of the module current transistors TP12~TP15, the load drive currents ID having $2^4$=16 steps (gradations) of different current values are generated.

In addition, when the non-inverted clock signal CLK of the timing control signal SCK outputted from the operation setting section 30 described later sets the timing to generate the high-level, the refresh control transistor Tr10 provided between the contact Nga (control terminal of the reference current transistor TP11) and the current input contact INA performs an "ON" operation. As a result based on the reference current Iref, the electrical charge supplied to the contact Nga is stored in the capacitor Ca and recharging (refreshing) of this potential (Namely, the voltage applied to the gate terminals of each of the module current transistors TP16~TP19.) at the contact Nga is accomplished by means of constant voltage. Consequently, by repeatedly executing at predetermined cycles a refresh operation for recharging the potential of the contact Nga in the current generation section 20A, any decline in the potential of the contact Nga resulting from current leakage and the like in the module current transistors TP16~TP19 is controlled. Also, the refresh operation for holding the potential of the contact Nga will be described later.

The operation setting section 30A, as shown in FIG. 1 for example, has a configuration comprising an inverter 32, an output control transistor TP31, a NAND circuit 33 (commonly defined as a Not-AND logic gate for producing inverse output of an AND gate), an inverter 34, an inverter 35 and a current supply source control transistor TP36. The inverter 32 performs reversal processing of the selection setting signal SL outputted from an external control circuit. The output control transistor TP31 consists of a Pch FET by which the inverted signal (the output signal of the inverter 32) of the above-mentioned selection setting signal SL are applied to the control terminal while the current path is provided in the drive current supply line Ld. The NAND circuit 33 receives as inputs the inverted signal of the selection setting signal SL and the timing control signal SCK. The inverter 34 performs reversal processing of the logic output of the NAND circuit 33. The inverter 35 performs further reversal processing of the inverted outputs of the inverter 34. The current supply source control transistor TP36 consists of a Pch FET by which the output signals of the above-mentioned inverter 35 are applied to the control terminal while the current path is provided in the feed route of the reference current Iref to the current generation section 20A.

Additionally, the operation setting section applicable to the current generation supply circuit related to the present invention is not restricted to the configuration shown in this embodiment. If the design has the equivalent features illustrated in the display device described later, the operation setting section can have other configurations. Therefore, in this embodiment only a fundamental example of one arrangement of the operation setting section applicable to the current generation supply circuit related to the present invention is shown.

In the operation setting section 30 which has such a configuration, when the high-level selection setting signal SL is inputted and in conjunction with reversal processing of the signal polarity by the inverter 32, the output control transistor TP31 performs an "ON" operation and the current output terminal OUTi (current output contact OUTi) of the current generation section 20A connects to the drive current supply line Ld via this output control transistor TP31. During this period, while not involved with the output timing of the timing control signal SCK but having the low-level non-inverted clock signal CLK by the NAND circuit 33 and the inverters 34, 35 is inputted to the non-inverted input contact CK of the data latch section 10. Besides, while the high-level inverted clock signal CLK* is being inputted regularly to the inverted input contact CK* and the control terminal of the current supply source control transistor TP36, the inverted output signals d10*~d13* based on the value of each of the digital signal bits d0~d3 held in the data latch section 10 are outputted to the current generation section 20A and the provision of the reference current Iref to the current generation circuit 20A is blocked out (shut down).

Conversely, when the low-level selection setting signal SL is inputted to the operation setting section 30 and in conjunction with reversal processing of the signal polarity by the inverter 32, the output control transistor TP31 performs an "OFF" operation and the current output terminal OUTi of the current generation section 20A disconnects from the drive current supply line Ld. During this period, corresponding to the input timing of the timing control signal SCK through the NAND circuit 33 and the inverters 34, 35, the high-level control signal is inputted to the non-inverted input contact CK of the data latch section 10. Besides, while the low-level control signal is inputted to the inverted input contact CK* and the control terminal of the current supply source control transistor TP36, each of the digital signal bits d0~d3 are taken in and held in the data latch section 10 as well as the reference current Iref is supplied to the current generation section 20A.

Therefore, in the current generation supply circuit ILA related to this embodiment, when the high-level selection setting signal SL is inputted and based on the inverted output signals d10*~d13* of each of the digital signal bits d0~d3 held in the data latch section 10, the load drive currents ID consisting of analog currents having a predetermined ratio of current values relative to the reference current Iref are generated corresponding to value of each of the digital signal bits d0~d3 in the current generation section 20A and supplied to the loads via the drive current supply line Ld (In this embodiment, as mentioned above, the load drive currents are flowed in the direction of the loads from the current generation supply circuit side). Accordingly, the current generation supply circuit ILA is set to the selection state.

Conversely, although each of the digital signal bits d0~d3 are taken in and held in the data latch section 10, when the low-level selection setting signal SL of the non-selection level is inputted the load drive currents ID will not be generated but the drive current supply line Ld will be supplied and the current generation supply circuit ILA set to the non-selection state. Furthermore, in this non-selection state, when both the current supply source control transistor TP36 and the refresh control transistor Tr10 perform an "ON" operation, the reference current Iref flows in the current path of the reference current transistor TP11 and the electrical charge of the reference current Iref is supplied to the gate terminal (contact Nga) based on the channel width of the reference current transistor TP11. Thereby, the electrical charge is stored (charge) in the capacitor Ca and the refresh operation is executed by which the potential of the gate terminal (contact Nga) is recharged to specified voltage.

In addition, in this embodiment relative to the loads connected to the current generation supply circuit ILA, a configuration (hereinafter denoted as the "current application method") is described which sets the current polarity so that the load drive currents ID flow from the current generation supply circuit side. However, the present invention is not limited to this and can apply a configuration (hereinafter denoted as the "current sinking method") which sets the current polarity so that the load drive currents ID flow in the direction of the current generation supply circuit from the loads side. Hereinafter, the current generation supply circuit corresponding to the current sinking method will be described briefly later.

SECOND EMBODIMENT OF THE CURRENT GENERATION SUPPLY CIRCUIT

The second embodiment of the current generation supply circuit will be explained.

Figure 4:
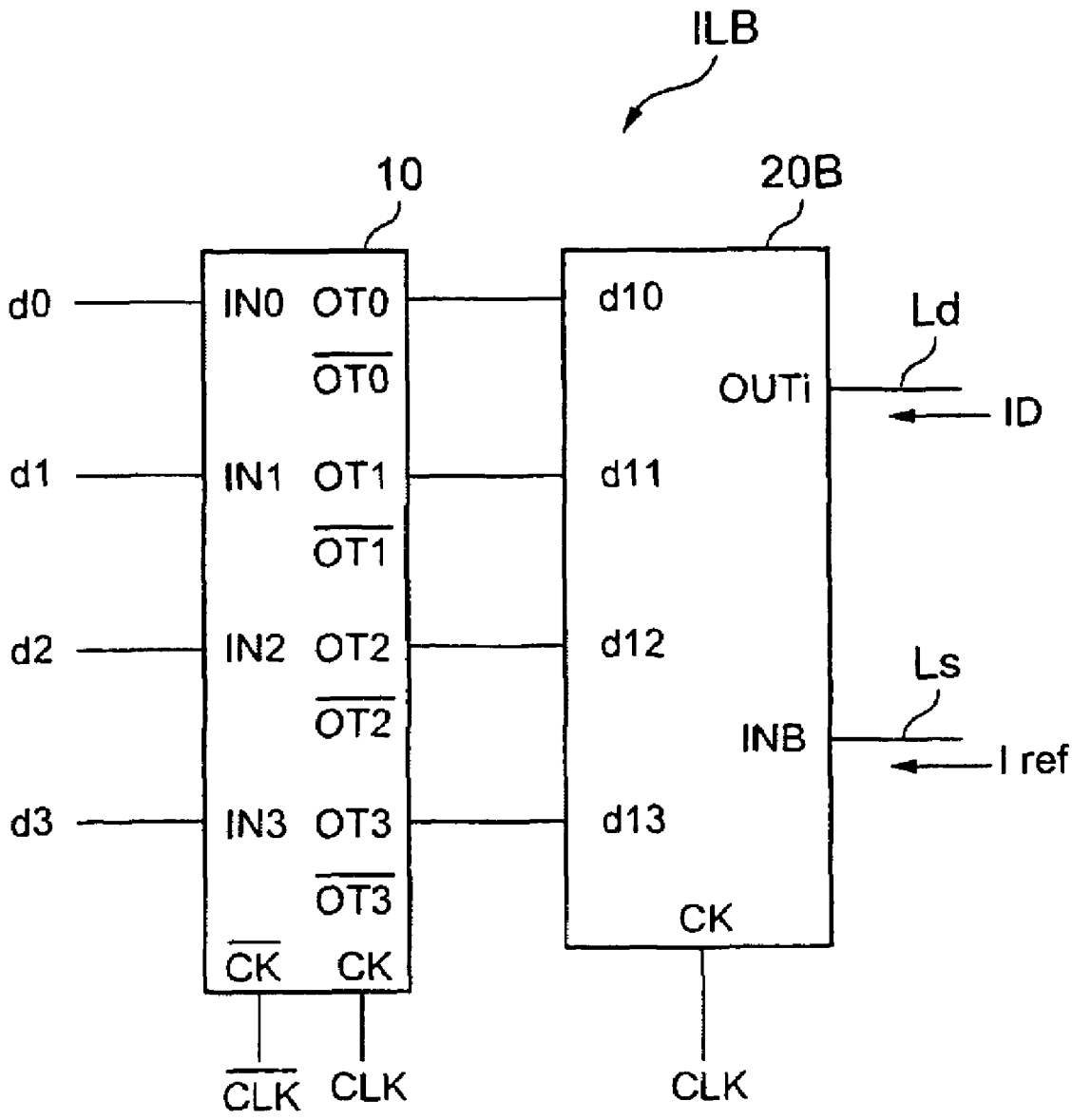
FIG. 4 is an essential parts configuration diagram showing the second embodiment of the current generation supply circuit related to the present invention.

FIG. 4 is an essential parts configuration diagram showing the second embodiment of the current generation supply circuit related to the present invention.

Figure 5:
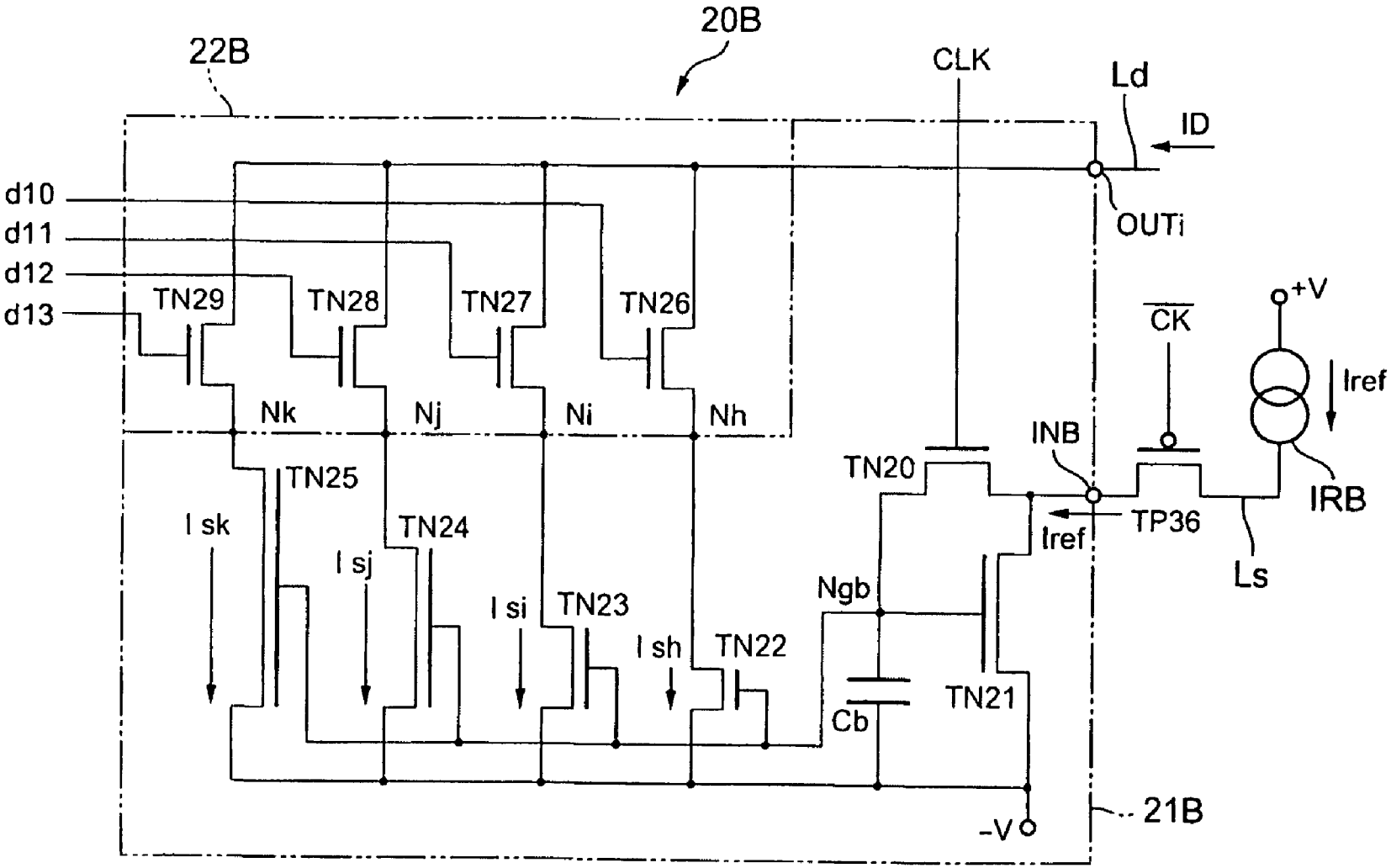
FIG. 5 is a circuit configuration drawing showing one illustrative example of the current generation circuit applied to the current generation supply circuit related to the embodiments.

FIG. 5 is a circuit configuration drawing showing one illustrative example of the current generation circuit applied to the current generation supply circuit related to the embodiments.

Here, concerning any configuration equivalent to the first embodiment mentioned above, the same or equivalent nomenclature is appended and the explanation is simplified or omitted from the description.

As shown in FIG. 4, the current generation supply circuit ILB has a configuration comprising a data latch section 10, a current generation section 20B (current generation circuit) and an operation setting section (omitted from FIG. 4). The data latch section 10 (latch circuits LC0~LC3) are equivalent to the first embodiment (Refer to FIG. 1) mentioned above. The current generation section 20B is connected to the non-inverted output contact points OT0~OT3 of the data latch section 10. The operation setting section sets the operating state of the current generation supply circuit ILB.

The current generation section 20B, as shown in FIG. 5, in summary comprises a current mirror circuit section 21B (module current generation circuit) and a switching circuit section 22B (current selection circuit) having the equivalent circuit configuration to the first embodiment (Refer to FIG. 3) mentioned above. Based on the output signals d10~d13 (non-inverted output signals) from the data latch section 10 (signal holding circuit) (each of the latch circuits LC0~LC3), the load drive currents ID are constituted by integrating selectively a plurality of the module currents Ish, Isi, Isj and Isk (Ish~Isk) having a predetermined ratio of current values relative to the reference current Iref which are generated for supplying the loads.

The current generation section 20B, specifically as shown in FIG. 5 which comprises the current mirror circuit section 21B and the switching circuit section 22B, the refresh control transistor TN20, the reference current transistor TN21, the module current transistors TN22~TN25 and the switching transistors TN26~TN29 entirely consist of Nch FETs. The reference current transistor TN21 control terminal is connected to the contact Ngb and the capacitor Cb is connected between the contact Ngb and the low electric potential −V while the current path is connected between the current input contact INB and the low electric potential −V to which the reference current Iref is supplied from the constant current generation source IRB (flowed in). The refresh control transistor TN20 is constituted so that the non-inverted clock signal CLK is applied to the control terminal while the current path is connected between the current input contact INB and the contact Ngb.

Additionally, the control terminals of the module current transistors TN22~TN25 are connected in common to the contact Ngb while the current path is connected between each of the contacts Nh, Ni, Nj and Nk and the low potential −V. Moreover, the switching transistors TN26~TN29 are configured so that the output signals d10~d13 (non-inverted output signals) outputted from the data latch section 10 (latch sections LC0~LC3) are applied individually to the control terminals while the current path is connected between each of the above-mentioned contacts Nh, Ni, Nj and Nk and the current output contact OUTi.

Here, also in this embodiment, the transistor sizes (Namely, the channel width based on the assumption of fixed channel length.) of each of the module current transistors TN22~TN25 which constitute the current mirror circuit section 21B are designed to become a predetermined ratio on the basis of the reference current transistor TN21. Furthermore, the module currents Ish~Isk which flow to each current path are set to have a predetermined ratio of current values different from each other relative to the reference current Iref.

Accordingly, also in the current generation supply circuit ILB of this embodiment, while each of the digital signal bits d0~d3 are taken in and held in the data latch section 10 in the non-selection state set by the signal level of the selection setting signal SL, the potential of the gate terminal (contact Ngb) of the reference current transistor TN21 is refreshed to specified voltage. Meanwhile, in the selection state, the particular switching transistors TN26~TN29 of the switching circuit section 22B perform an "ON" operation based on the non-inverted output signals d10~d13 of each of the digital signal bits d0~d3 held in the data latch section 10. The module currents Ish~Isk which flow via the module current transistors TN22~TN25 connected to the switching transistors that perform an "ON" operation are integrated selectively and supplied to the loads as the load drive currents ID via the current output contact OUTi and the drive current supply line Ld (In this embodiment, the load drive currents flow in the direction of the current generation supply circuit from the loads side).

Therefore, in the current generation supply circuit ILA and ILB described in the first and second embodiments mentioned above, the constant reference current Iref in which the signal level does not change is supplied via the reference current supply line Ls from the constant current generation source IRA and IRB to the current generation section 20A and 20B connected to the loads via the drive current supply line Ld. By having a configuration which generates the load drive currents ID having current values that can operate the loads in the desired drive state based on each of the digital signal bits d0~d3 (The output signals d10~d13, d10*~d13* of the data latch section 10), even in instances where the current values of the load drive currents ID are exceptionally low or in instances where the supply time (or the driving time for the loads) of the load drive currents ID to the loads is set briefly, the influence of signal delays resulting from the charge and discharge operation of the parasitic capacitance, such as the wiring capacity, etc. to reference current supply line Ls can be eliminated. Also, any deterioration of the operating speed of the current generation supply circuit can be controlled, as well as the loads can be operated faster and in a precise drive state.

Additionally, in order to set the current values of the load drive currents ID, the reference current Iref consisting of a constant current value is supplied as the current fed to the current generation supply circuit ILA and ILB and the signal level of each of the digital signals is applied directly. Since the plurality of module currents have a predefined ratio corresponding to the reference current from the current mirror circuit which are integrated selectively and the load drive currents ID can be generated, when applied to the data driver of the display device mentioned later in a plurality of current generation supply circuits, the relation of the current values of the load drive currents relative to the gradations (designated gradations) assigned by the digital signals can be equalized and a plurality of loads can be operated in a uniform drive state appropriately by means of a relatively simple drive control method.

Besides, in the first or second embodiment mentioned above, as for the digital signals in these cases the load drive currents which apply the display data (display signals) for displaying the desired image information on the display device can be generated and outputted from the current generation supply circuit corresponding to the gradation currents supplied in order to perform the light generation operation of each of the display pixels which constitute the display panel at predetermined luminosity gradations described later.

FIRST EMBODIMENT OF THE DISPLAY DEVICE

Next, the display device applicable to the current generation supply circuit having the configurations and features which were described above will be explained.

Figure 6:
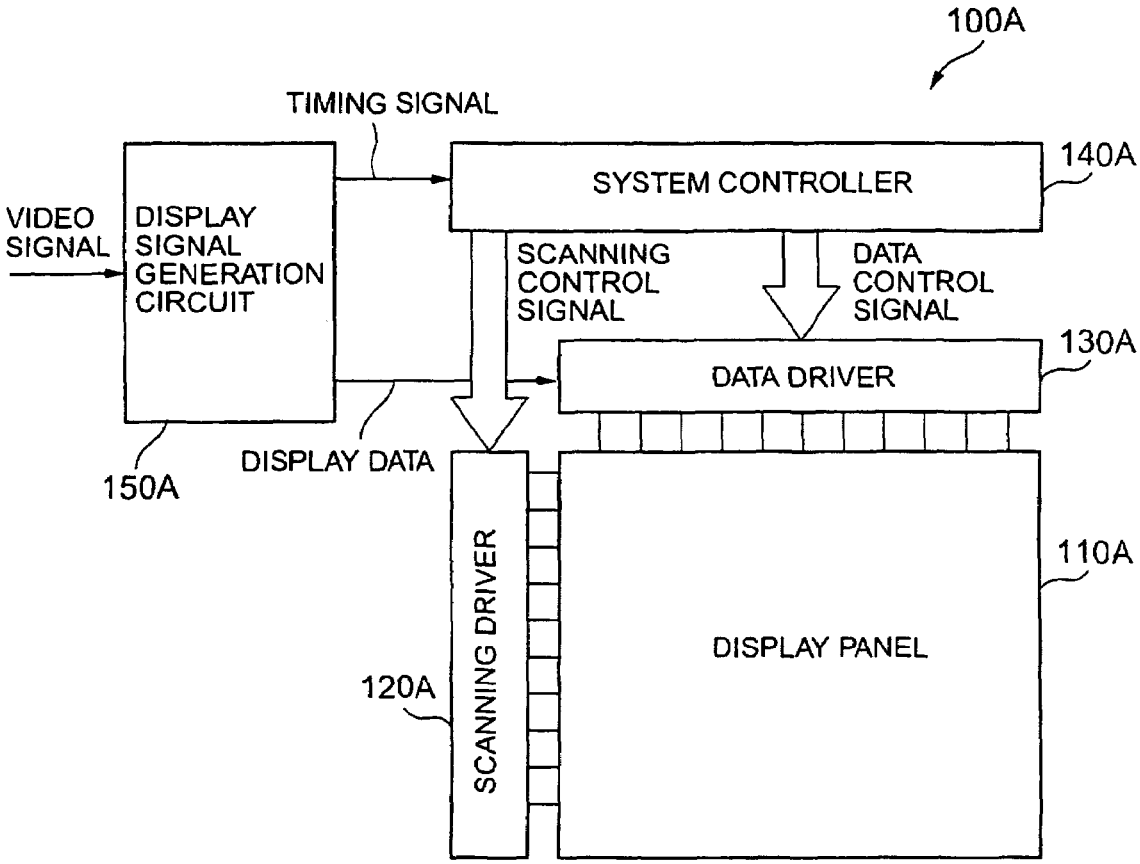
FIG. 6 is an outline block diagram showing one embodiment of the display device applicable to the current generation supply circuit related to the present invention.

FIG. 6 is an outline block diagram showing one embodiment of the display device applicable to the current generation supply circuit related to the present invention.

Figure 7:
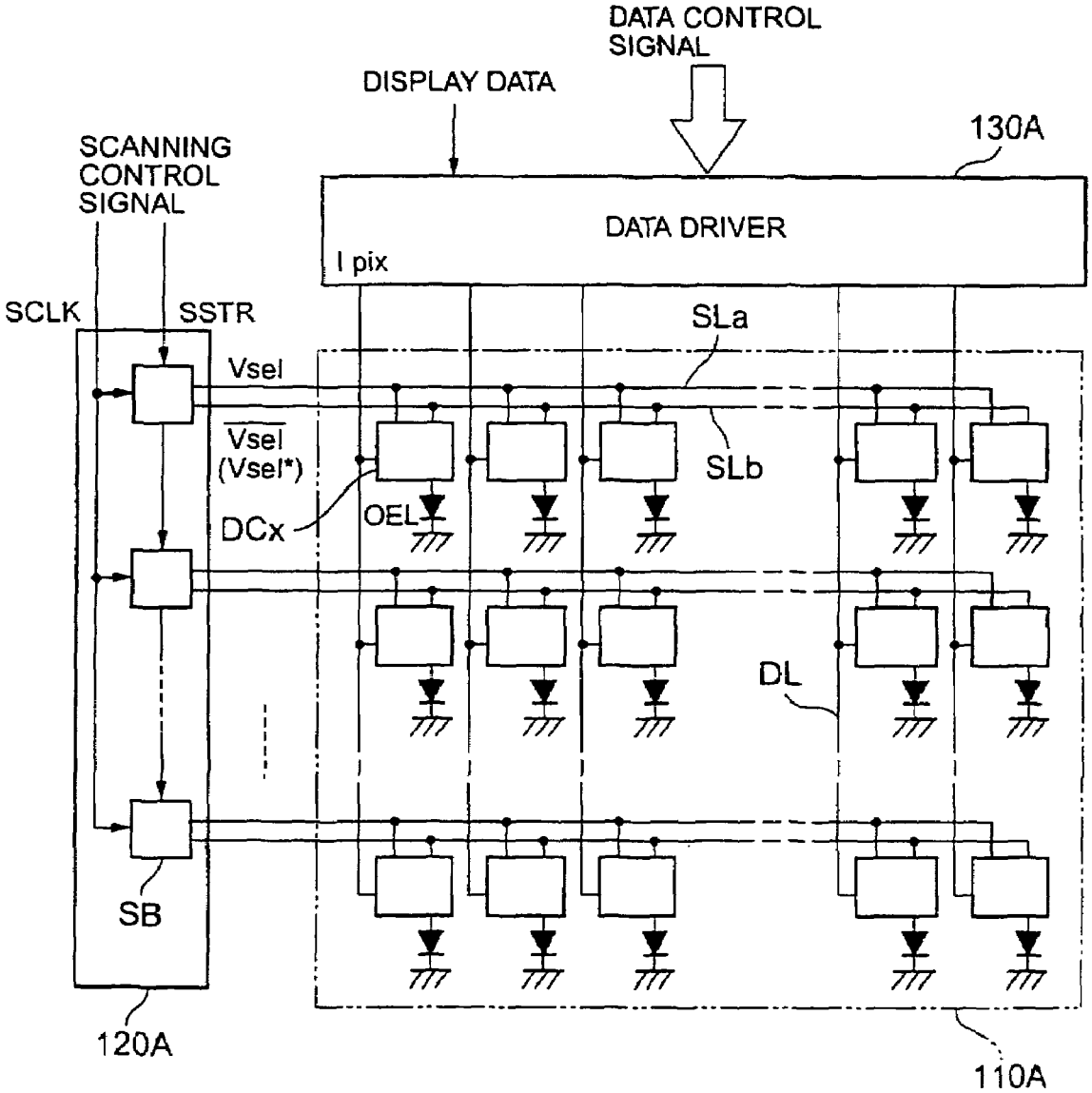
FIG. 7 is an outline configuration diagram showing the display panel applied to the display device related to the embodiments.

FIG. 7 is an outline configuration diagram showing the display panel applied to the display device related to the embodiments.

Here, the configuration comprising display pixels corresponding to an active-matrix method as the display panel will be explained.

Additionally, in this embodiment, the current generation supply circuit (FIG. 1 and FIG. 3) stated in the first embodiment mentioned above which explained the case where the current application method is employed to flow the gradation currents (drive currents) to the display pixels from the data driver side will be suitably referred to below.

Referring to FIG. 6 and FIG. 7, the display device 100A related to this embodiment has a configuration in summary comprising a display panel 110A, a scanning driver 120A (scanning driver circuit), a data driver 130A (signal driver circuit), a system controller 140A and a display signal generation circuit 150A. The display panel 110A comprises a plurality of display pixels (loads) arranged in matrix form. The scanning driver 120A is connected to the scanning lines SLa, SLb (scan lines) which are connected in common with every display pixel cluster positioned in the row direction of the display panel 110A. The data driver 130A is connected to the data lines DL1, DL2, DL3, . . . (DL) (signal lines) which are connected in common with every display pixel cluster positioned in the column direction of the display panel 110A. The system controller 140A generates and outputs various kinds of control signals for controlling the operating state of the scanning driver 120A and the data driver 130A. The display signal generation circuit 150A generates the display data, a timing signal, etc. based on the video signals supplied from the exterior of the display device 100A.

Hereinafter, each of the above mentioned components will be explained in detail.

As shown in FIG. 7, the display panel 110A has a configuration comprising the scanning lines SLa and SLb, the data lines DL and a plurality of display pixels. The two scanning lines SLa and SLb are arranged parallel from each other corresponding to the display pixel clusters for every row. The data lines are positioned to intersect perpendicularly with the scanning lines SLa and SLb corresponding to the display pixel clusters for every column. The plurality of display pixels are arranged near each of the intersection points of these intersecting lines (A configuration consisting of the pixel driver circuits DCx and the organic EL devices OEL in FIG. 7).

The display pixels, for example, have a configuration comprising the pixel driver circuits DCx and the light emitting devices OEL. The pixel driver circuits DCx control the write-in of the gradation currents Ipix in each of the display pixels as well as the light generation operation based on the scanning signals Vsel applied via the scanning lines SLa from the scanning driver 120A; the scanning signals Vsel* (Polarity reversal signals of the scanning signals Vsel applied to the scanning lines SLa) applied via the scanning lines SLb; and the gradation currents Ipix (drive currents) supplied via the data lines DL from the data driver 130A. The light emitting devices have a configuration comprising current control type light emitting devices (For example, organic EL devices OEL) by which the luminosity gradations are controlled corresponding to the current values of the luminosity drive currents supplied from the pixel driver circuits DCx.

Here, in this embodiment, although a configuration applying the organic EL devices OEL as the light emitting devices is described, the present invention is not limited to this. As long as the current control type light emitting devices execute the light generation operation by predetermined luminosity corresponding to the current values of the light generation drive currents supplied to the light emitting devices, other light emitting devices such as light emitting diodes, etc. can also be applied. In addition, an example circuit configuration applicable to the pixel driver circuits DCx will be described later.

The scanning driver 120A, as shown in FIG. 7, comprises a shift block SB consisting of a shift register and a buffer with a plurality of steps corresponding to each line of the scanning lines SLa, Slb based on scanning control signals (a scanning start signal SSTR, a scanning clock signal SCLK, etc.) supplied from the system controller 140A. While shift signals are outputted to execute sequential shifting from the upper part to the lower part of the display panel 110A from the shift register which are applied to each of the scanning lines SLa as the scanning signals Vsel having a specified voltage level (The selection level; for example, high-level) via the buffer, the voltage level of the scanning signals Vsel is inverted and applied to each of the scanning lines SLb as the scanning signals Vsel*. Thereby, the display pixel clusters for every line are set as the selection state and controls write-in of the gradation currents Ipix in each of the display pixels based on the display data supplied from the data driver 130A via each of the data lines DL.

As for the data driver 130A, even though the details of an illustrative circuit configuration or its drive control operation will be described later, in summary as shown in FIG. 7, the display data consisting of a plurality of digital signal bits supplied from the display signal generation circuit 150A are taken in and held based on data control signals (a shift start signal STR, a shift clock signal SFC, etc. which will be described later) supplied from the system controller 140A.

Also, the gradation currents Ipix having current values corresponding to the appropriate display data are generated based on predetermined reference current and controlled to supply in parallel each of the display pixels set as the selection state by the scanning driver 120A via each of the data lines DL.

The system controller 140A at least interacts with each of the scanning driver 120A and the data driver 130A based on the timing signals supplied from the display signal generation circuit 150A described later. By generating and outputting scanning control signals (the scanning start signal SSTR, the scanning clock signal SCLK, etc. mentioned above) and data control signals (the shift start signal STR, the shift clock signal SFC, etc. mentioned above), each driver operates at predetermined timing. Accordingly, the scanning signals Vsel, Vsel* and the gradation currents Ipix output to the display panel 110A; predetermined control operations (described later) are executed consecutively in the pixel driver circuits DCx; and control to display predetermined image information on the display panel 110A is executed based on the video signals.

The display signal generation circuit 150A, for, example, extracts the luminosity gradation signal component from the video signals supplied from the exterior of the display device 100A and supplies this luminosity gradation signal component for every one line period of the display panel 110A to the data driver 130A as the display data consisting of a plurality of digital signal bits. Here, when the above-mentioned video signals contain the timing signal component which specifies the display timing of the image information, such as a television broadcasting signal (composite video signal), the display signal generation circuit 150A may have a feature which extracts the timing signal component supplied to the system controller 140A and another feature which extracts the above-mentioned luminosity gradations signal component. In this case, the above-mentioned system controller 140A generates the above-mentioned scanning control signals and data control signals which are supplied to the scanning driver 120A or the data driver 130A based on the timing signals supplied from the display signal generation circuit 150A.

Furthermore, even though this embodiment has a mounted structure with peripheral circuitry, such as the driver, controller, etc., attached to the borders of the display panel 110A, the present invention is not limited to this. For example, at least the display panel 110A, the scanning driver 120A and the data driver 130A may be formed on the same substrate. The scanning driver 120A and the data driver 130A or only the data driver 130A as described later may be provided separately from the display panel 110A and connected electrically. Here, if in the case of forming the peripheral circuitry (driver, etc.) as one unit on the same substrate and the display panel consists of display pixels comprising organic EL devices, for example, each of the functional devices of the peripheral circuitry (transistors, etc.) can be formed with the application of polycrystalline silicon (polysilicon) as the structural material. At the same time, it is possible to produce a common architecture by incorporating the manufacturing process of the display pixels and the circuit scale can be substantially reduced.

(An Example Configuration of the Display Pixels)

Subsequently, an example of a pixel driver circuit applicable to each of the display pixels which constitute the display panel mentioned above will be explained.

Figure 8:
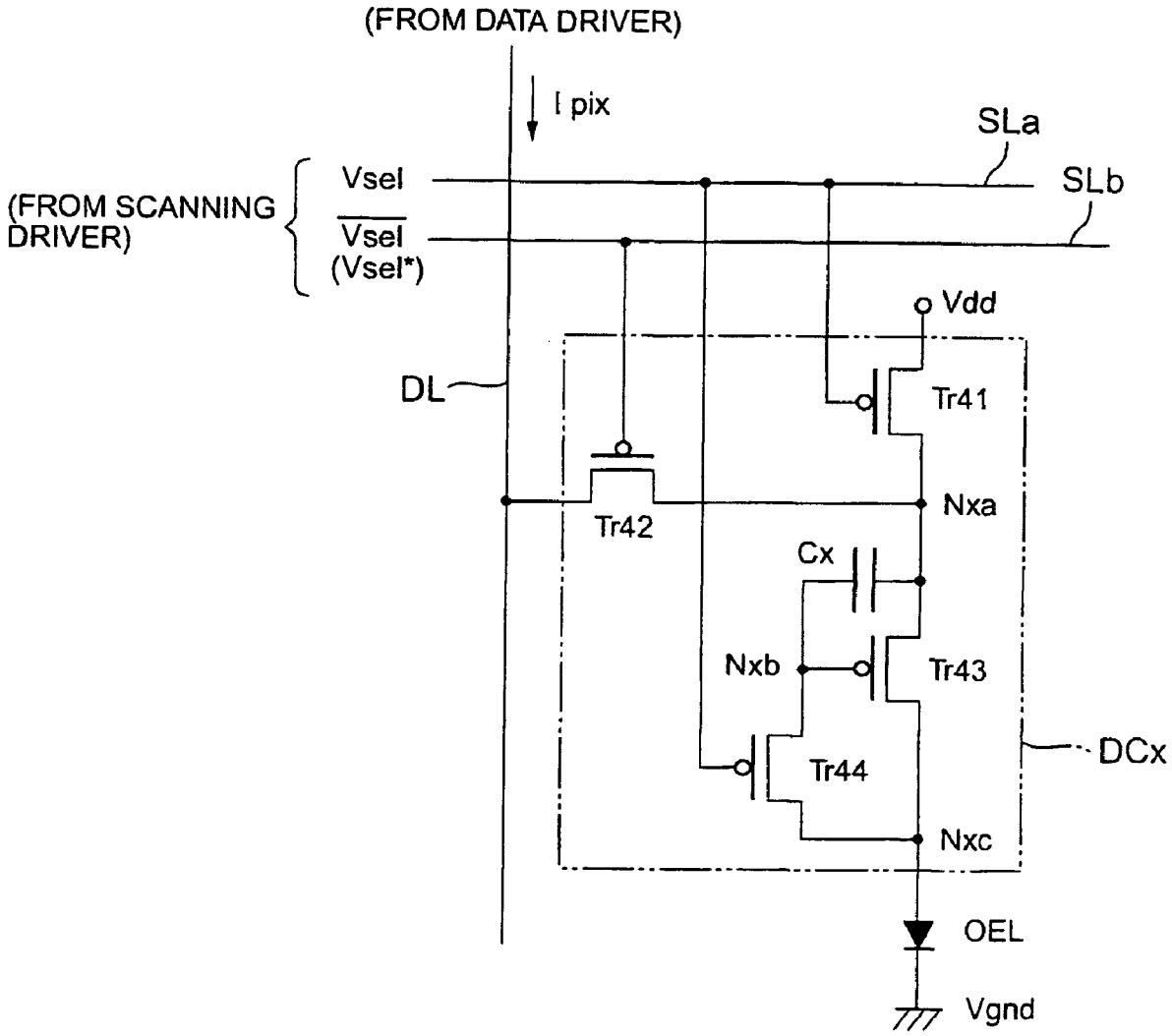
FIG. 8 is a circuit configuration drawing showing one embodiment of a pixel driver circuit applicable to the display pixels of the display panel related to the embodiments.

FIG. 8 is a circuit configuration drawing showing one embodiment of a pixel driver circuit applicable to the display pixels of the display panel related to the embodiments.

In addition, the pixel driver circuit shown here illustrates one example applicable of the display device which employs the current application method. It is emphasized that other circuit configurations having equivalent features may be applied.

Referring to FIG. 8, the pixel driver circuits DCx related to the embodiments have a configuration comprising a Pch FET Tr41, a Pch FET Tr42, a Pch FET Tr43, an Nch FET Tr44 and a capacitor Cx (storage capacitor). The Pch FET Tr41 source-drain terminals are connected each other to the contact Nxa and the power supply contact Vdd (high electric potential) along with the gate terminal connected to the scanning lines SLa near the intersection points of the scanning lines SLa, SLb and the data lines DL. The Pch FET Tr42 source-drain terminals are connected each other to the data lines DL and the contact Nxa along with the gate terminal connected to the scanning lines SLb. The Pch FET Tr43 source-drain terminals are connected each other to the contact Nxc and the contact Nxa along with the gate terminal connected to the contact Nxb. The Nch FET Tr44 source-drain terminals are connected each other to the contact Nxc and the contact Nxb along with the gate terminal connected to the scanning lines SLa. The capacitor Cx (storage capacitor) is connected between the contact Nxa and the contact Nxb. Here, the power supply contact Vdd, for example, is connected to the high electric potential via the power supply lines and constant high potential voltage is applied continually or at predetermined timing.

Furthermore, the light emitting devices OEL (organic EL devices), by which the light generation luminosity is controlled by the light generation drive currents supplied from the pixel driver circuits DCx, have a configuration in which respectively the anode terminal is connected to the contact Nxc of the above-mentioned pixel driver circuits DCx and the cathode terminal is connected to the low electric potential Vgnd (For example, ground potential). Here, the capacitor Cx may be a parasitic capacitor positioned between the gate-source of the transistor Tr43 and a second capacitative element can be added separately further between the gate-source in addition to the parasitic capacitor.

Now the drive control operations of the organic EL devices OEL in the pixel driver circuits DCx which have such a configuration will be explained. First, in a write-in operation period, for example, while applying the high-level (selection level) scanning signals Vsel to the scanning lines SLa, the low-level scanning signals Vsel* are applied to the scanning lines SLb and synchronizing with this timing the gradation currents Ipix are supplied to the data lines DL from the data driver 130A as described later. Here, as the gradation currents Ipix, positive polarity currents are supplied and set so that these currents flow (are applied) properly in direction of the display pixels (the pixel driver circuits DCx) via the data lines DL from the data driver 130A side.

Accordingly, as the Pch FET Tr42 and the Nch FET Tr44 which constitute the pixel driver circuits DCx perform an "ON" operation, the Pch FET Tr41 performs an "OFF" operation and the positive potential corresponding to the gradation currents Ipix supplied to the data lines DL is applied to the contact Nxa. Also, between the contact Nxb and the contact Nxc connect by Nch FET Tr44 and between the gate-drain of the Pch FET Tr43 is controlled by the electric potential. Thereby, the Pch FET Tr43 performs an "ON" operation in the saturation region which produces a potential difference corresponding to the gradation currents Ipix in both sides (between contact Nxa and contact Nxb) of the capacitor Cx. While the electrical charge corresponding to this potential difference is stored (charge) and held as the voltage component, the gradations currents Ipix flow to the light emitting devices OEL (organic EL devices) and the light generation operation of the organic EL devices OEL commences.

Subsequently, in the light generation operation period, while applying the low-level (non-selection level) scanning signals Vsel to the scanning lines SLa, the high-level scanning signals Vsel* are applied to the scanning lines SLb and synchronizing with this timing the gradation currents Ipix to the data lines are blocked out (shut down). Thereby, the Pch FET Tr42 and the Nch FET Tr44 perform an "OFF" operation and electrically block out between the data lines DL and the contact Nxa together with between the contact Nxb and the contact Nxc, as well as the capacitor Cx holds the electrical charge stored in the write-in operation period mentioned above. As a result, when the capacitor Cx holds the charge voltage at the time of the write-in operation, the potential difference between the contact Nxa and the contact Nxb (between the gate-source of the Pch FET Tr43) will be held and the Pch FET Tr43 maintains an "ON" operation. Moreover, because the Pch FET Tr41 performs an "ON" operation simultaneously while applying the above-mentioned scanning signals Vsel (low-level), light generation currents having current values equivalent to the gradation currents Ipix flow (Specifically, the voltage component based on the electrical charge stored in the capacitor Cx) corresponding to the gradation currents Ipix to the organic EL devices OEL via the Pch FET Tr41 and Pch FET 43 from the power supply contact (high electric potential Vdd) and the light generation operation at predetermined luminosity gradations of the organic EL devices OEL is maintained.

(An Example Configuration of the Data Driver)

Subsequently, the configuration of the data driver applicable to the display device concerning this embodiment will be explained.

Figure 9:
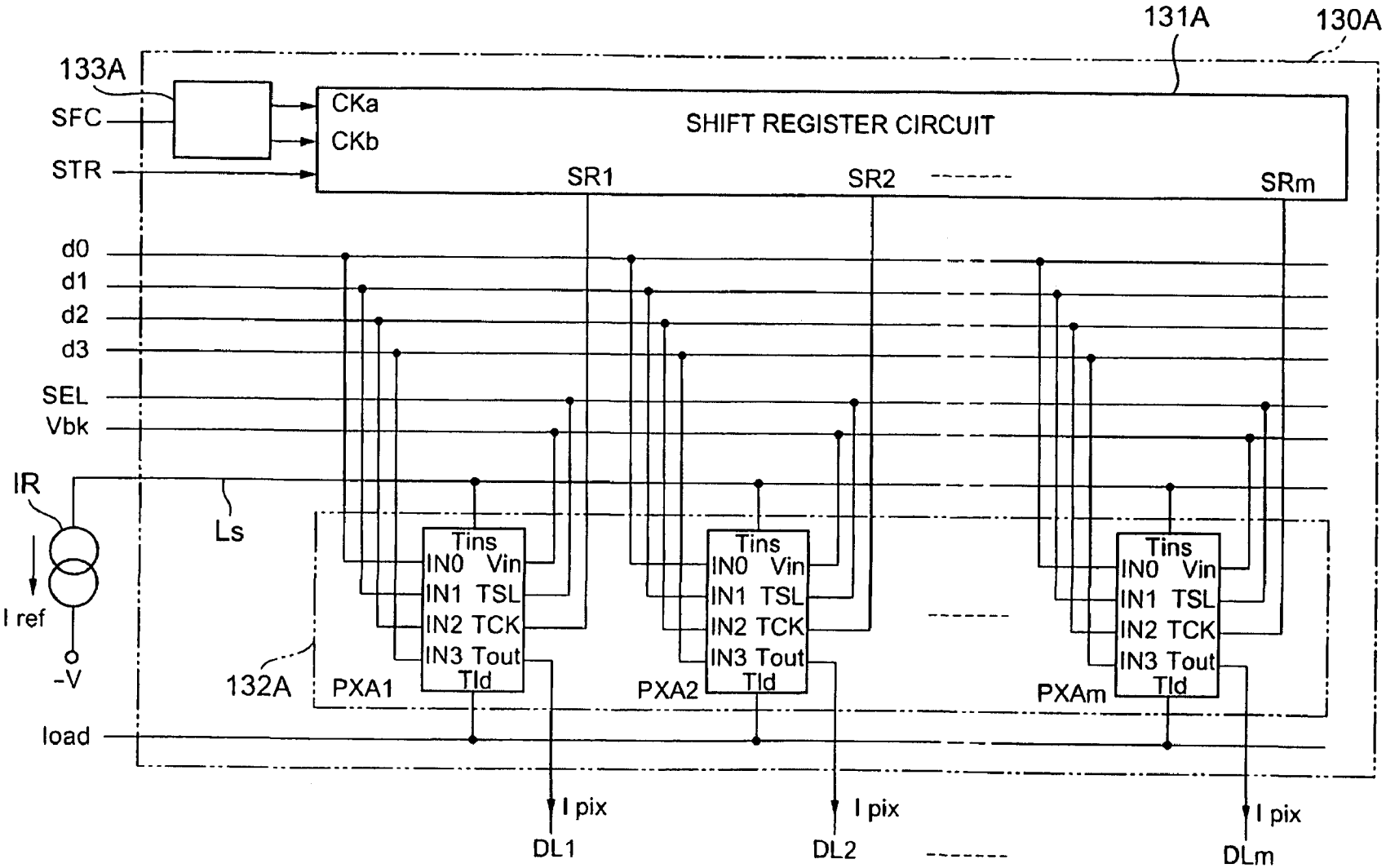
FIG. 9 is an outline configuration diagram showing an example of one arrangement of the data driver applicable to the first embodiment of the display device related to the embodiments.

FIG. 9 is an outline configuration diagram showing an example of one arrangement of the data driver applicable to the first embodiment of the display device related to the embodiments.

Figure 10:
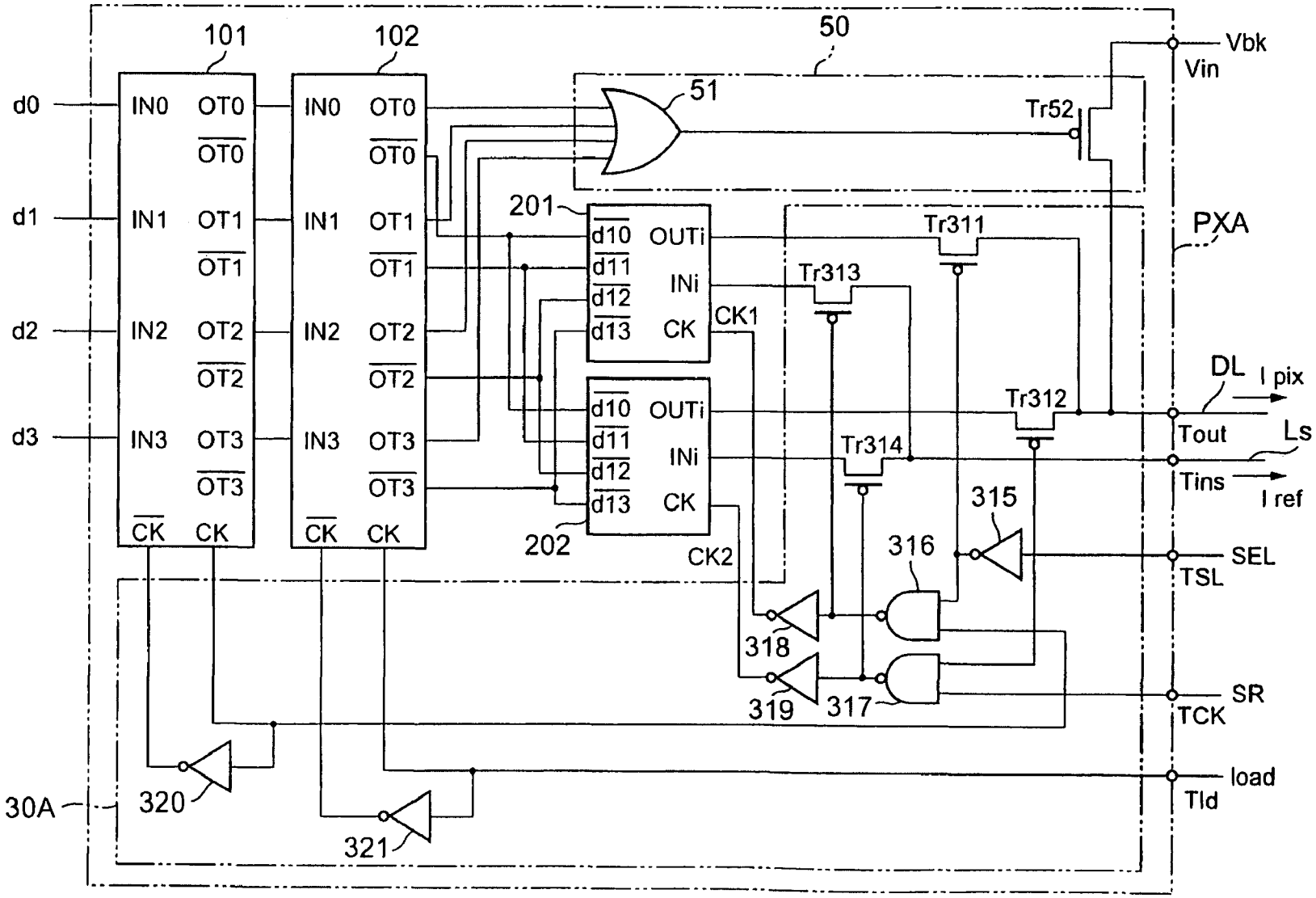
FIG. 10 is an outline configuration diagram showing one illustrative example of the gradation current generation supply circuit applicable to the data driver related to the embodiments.

FIG. 10 is an outline configuration diagram showing one illustrative example of the gradation current generation supply circuit applicable to the data driver related to the embodiments.

Here, the configuration equivalent to the current generation supply circuit (FIG. 1 and FIG. 3) described in the embodiment mentioned above will be explained. Also, to simplify the explanation, the same or equivalent nomenclature is appended matching the composition shown in FIG. 1 and FIG. 3.

The data driver 130A applicable to the display device 100A related to the embodiment, in summary is constituted with the identical configuration as the current generation supply circuit ILA illustrated in the first embodiment (FIG. 1 and FIG. 3) of the above-mentioned current generation supply circuit. The data driver 130A is provided individually as a gradation current generation circuit corresponding to each of the data lines DL for each gradation current generation supply circuit. As shown in the above-mentioned FIG. 3, the reference current Iref having a constant current value via the common reference current supply line Ls from a single constant current generation source IRA (constant current source) is supplied (In this example of the configuration, supply of the reference current Iref flows outwardly (drawn out)).

The data driver 130A in this example configuration, specifically as shown in FIG. 9, has a composition comprising a reversal latch circuit 133A, a shift register circuit 131A and a gradation current generation supply circuit group 132A. The reversal latch circuit 133A generates a non-inverted clock signal CKa and an inverted clock signal CKb based on a shift clock signal SFC supplied as a data control signal from the system controller 140A. The shift register circuit 131A sequentially outputs the shift signals SR1, SR2, SR3, . . . at predetermined timing while shifting the sampling start signal STR based on the non-inverted clock signal CKa and the inverted clock signal CKb. The gradation current generation supply circuit group 132A consist of a plurality of gradation current generation supply circuits PXA1, PXA2, . . . . Based on the output timing of the shift signals SR1, SR2, SR3, . . . (equivalent to the timing control signal SCK mentioned above; hereinafter denoted as the "shift signals SR" for convenience) from the shift register circuit 131A, the display data d0~dq (Here, the digital signals d0~d3 inputted to the current generation supply circuit ILA shown in FIG. 1 and FIG. 3 correspond and are referred to as q=3 for convenience) sequentially supplied from the display signal generation circuit 150A is sequentially taken in for one line periods and generates the gradation currents Ipix supplied (applied) to each of the data lines DL1, DL2, DL3, . . . (equivalent to the drive current supply line Ld mentioned above) corresponding to the light generation luminosity in each of the display pixels.

Here, the reversal latch circuit 133A applicable to the data driver 130A in this example configuration will explained. In summary, initially when the shift clock signal SFC is applied, the related signal level is held. At that moment a non-inverted signal and an inverted signal of that signal level is outputted from the non-inverted output terminal and the inverted output terminal respectively, which is supplied to the shift register circuit 131A as the non-inverted clock signal CKa and the inverted clock signal CKb.

The shift register circuit 131A, based on the non-inverted clock signal CKa and the inverted clock signal CKb which are outputted from the reversal latch circuit 133A mentioned above and while taking in the sampling start signal STR from the system controller 140A and executing sequential shifting at predetermined timing, outputs the shift signal SR1, SR2, SR3, . . . to each of the gradation current generation supply circuits PXA1, PXA2, . . . which constitute the gradation current generation supply circuit group 132A.

The gradation current generation supply circuit group 132A which constitutes each of the gradation current generation supply circuits PXA1, PXA2, . . . (hereinafter denoted as the "gradation current generation supply circuits PXA"), as shown in FIG. 10, has a configuration comprising the data latch section 101 and 102 (signal holding circuit), the gradation current generation section 201 and 202 (gradation current generation circuit), an operation setting section 30A (operational state setting circuit) and a specified state setting section 50 (specified state setting circuit). The two data latch section 101, 102 consist of an initial stage and latter stage having an equivalent configuration to the data latch section 10 of each configuration of the current generation supply circuit ILA shown in FIG. 1 as the base element. The two gradation current generation section 201 and 202 have an equivalent configuration to the current generation section 20A (current generation circuit) which are connected in parallel to the inverted output contact points OT0~OT3 of the above-mentioned data latch section 102. The operation setting section 30A sets the operating state and selection state of each of the gradation current generation supply circuits PXA1, PXA2, . . . based on the selection setting signal SEL outputted from the system controller 140A. The specified state setting section 50 applies the specified voltage Vbk to the data lines DL1, DL2, DL3, . . . only when operating the display pixels in the specified drive state, such as a black display operation based on the display data d0~d3 (The non-inverted output signals d10~d13 outputted from the non-inverted output contacts points OT0~OT3 of the data latch section 102) taken in and held in the data latch section 101 and 102.

The data latch section 101 and 102 comprise a plurality of latch circuits corresponding to the bit number of the display data d0~d3 respectively. The initial stage data latch section 101 executes an operation which takes in and holds the display data d0~d3 at timing based on the shift signals SR outputted from the shift register circuit 131A and an operation which outputs to the latter stage data latch section 102.

Additionally, the latter stage data latch section 102 executes an operation which takes in and holds the non-inverted output signals d0~d13 outputted from the non-inverted output contact points OT0~OT3 of the data latch section 101 at timing based on the load signals load supplied from the system controller 140A and an operation which outputs the inverted output signals d10*~d13* outputted from the inverted output contact points OT0~OT3 to the gradation current generation section 201 and 202. Furthermore, in this embodiment, even though the case where the above-mentioned operations in the data latch section 102 are controlled based on the load signals load is illustrated, this invention is not restricted to this and may be controlled based on the shift start signal STR inputted to the shift register circuit 131A from the system controller 140A.

The gradation current generation section 201 and 202 (gradation current generation circuits) comprise a current mirror circuit section and a switching circuit section equal to the current generation section 20A shown in FIG. 3 respectively. Based on the inverted output signals d10*~d13* outputted from the data latch section 102 mentioned above and the control signals CK1 and CK2 outputted from the operation setting section 30A described later, the gradation currents Ipix are generated having current values corresponding to the display data d0~d3 and integrated selectively as predetermined module currents and supplied to the data lines DL via each of the output control transistors Tr311 and Tr312 provided in the operation setting section 30A.

The operation setting section 30A (operational state setting circuit) as shown in FIG. 10 has a configuration comprising an inverter 315, an output control transistor Tr311, an output control transistor Tr312, a NAND circuit 316, a NAND circuit 317, an inverter 318, an inverter 319, a current supply source control transistor Tr313, a current supply source control transistor Tr314, an inverter 320 and an inverter 321. The inverter 315 performs reversal processing of the selection setting signal SEL outputted from the system controller 140A. The output control transistor Tr311 consists of a Pch FET by which the inverted signal (output signal of the inverter 315) of the above-mentioned selection setting signal SEL is applied to the control terminal while the current path is established between the current output contact OUTi of the gradation current generation section 201 and the output contact Tout to which the data lines DL are connected. The output control transistor Tr312 consists of Pch FET by which the above-mentioned selection setting signal SEL is applied to the control terminal while the current path is established between the current output contact OUTi of the gradation current generation section 202 and the above-mentioned output contact Tout. The NAND circuit 316 receives as inputs the inverted signal of the selection setting signal SEL and the shift signals SR from the shift register circuit 131A. The NAND circuit 317 receives as inputs the selection setting signal SEL and the shift register circuit 131A. The inverter 318 performs reversal processing of the logic output of the NAND circuit 316. The inverter 319 performs reversal processing of the logic output of the NAND circuit 317. The current supply source control transistor Tr313 consists of a Pch FET by which the output signal of the above-mentioned NAND circuit 316 is applied to the control terminal while the current path is established between the current input contact INi of the gradation current generation section 201 and the reference current contact Tins to which the reference current Iref is supplied (the reference current supply line Ls is connected). The current supply source control transistor Tr314 consists of a Pch FET by which the output signal of the above-mentioned NAND circuit 317 is applied to the control terminal while the current path is established between the current input contact INi of the gradation current generation section 202 and the reference current contact Tins. The inverter 320 performs reversal processing of the shift signals SR from the shift register circuit 131A. Lastly, the inverter 321 performs reversal processing of the load signals load from the system controller 140A.

Here, the output signal of the inverter 318 is applied to the refresh control transistor (equivalent to the refresh control transistor Tr10 in FIG. 3) provided in the gradation current generation section 201 as the control signal CK1. The output signal of the inverter 319 is applied to the refresh control transistor provided in the gradation current generation section 202 as the control signal CK2. Additionally, the shift signals SR from the shift register circuit 131A are inputted directly to the non-inverted input contact CK of the data latch section 101 as a non-inverted clock signal. The inverted signal (the inverter 320 output signal) of the shift signals SR is inputted as an inverted clock signal to the inverted input contact CK* of the data latch section 101. Moreover, the load signals load from the system controller 140A are inputted directly to the non-inverted input contact CK of the data latch section 102 as the non-inverted clock signal. The inverted signal (the inverter 321 output signal) of the load signals load is inputted as an inverted clock signal to the inverted input contact CK* of the data latch section 102.

Referring to FIG. 10, the specified state setting section 50 (specified state setting circuit) has a configuration comprising a logical operation circuit 51 and a specified voltage application transistor Tr52. The logical operation circuit 51 (hereinafter denoted as an "OR circuit") processes the input signals of the non-inverted output signals d10~d13 outputted from the data latch section 102. The specified voltage application transistor Tr52 consists of a Pch FET by which output end of the OR circuit 51 is connected to the control terminal (gate) while the current path is established between the output contact Tout and the voltage contact Vin which applies the specified voltage Vbk. The configuration such as this distinguishes whether or not the signal levels of the non-inverted output signals d10~d13 outputted from the above-mentioned latch section 102 by the OR circuit 51 are set in the specified state (equivalent to a black display state) defined as all "0's" (zeros). Only in this specified state, the specified voltage Vbk is applied to the data lines DL via the specified voltage application transistor Tr52.

In the gradation current generation supply circuits PXA which have such a configuration, each of the digital signal bits d0~d3 supplied as a plurality of digital signal bits is taken in simultaneously and held corresponding to the output timing (high-level output timing) of the shift signals SR from the shift register circuit 131A. Moreover, at timing (For example, during a retrace line period) set to the high-level load signals load and based on the display data d0~d3 held in the data latch section 101, the non-inverted output signals are transferred to the data latch section 102 which are taken in simultaneously and held. Also, at timing (For example, periods other than the retrace line period in a selection period) set to the succeeding low-level load signals load from the system controller 140A and based on the above-mentioned non-inverted output signals (Namely, the display data d0~d3) held in the data latch section 102, the inverted output signals d10*~d13* are outputted simultaneously to the gradation current generation section 201 or 202.

Here, when the selection setting signal SEL inputted to the operation setting section 30A from the system controller 140A is the high-level, as the output control transistor Tr311 performs an "ON" operation by the inverter 315, the output control transistor Tr312 performs an "OFF" operation. Thereby, the current output contact OUTi of the gradation current generation section 201 is connected to the data lines DL (output contact Tout) via the output control transistor Tr311, and the current output contact OUTi of the gradation current generation section 202 and the connection with the data lines DL are blocked out (shut down).

During this period, while not involved with the output timing of the shift signals SR but having the high-level control signal (output signal of the NAND circuit 316) to the control terminal of the current supply source control transistor Tr313 by NAND circuit 316 and the inverter 318, the control signal CK1 of the low-level is supplied to the gradation current generation section 201. Also, the current supply source control transistor Tr313 and the refresh control transistor (equivalent to Nch FET Tr10 shown in FIG. 3) of the gradation current generation section 201 performs an "OFF" operation.

Furthermore, while the control signal (output of the NAND circuit 317) of the low-level is applied to the control terminal of the current supply source control transistor Tr314 with the NAND circuit 317 and the inverter 319, by inputting the high-level selection setting signal SEL corresponding to the output timing (high-level output timing) of the shift signals SR, the high-level control signal CK2 is supplied to the gradation current generation section 202. Also, the current supply source control transistor Tr314 and the refresh control transistor of the gradation current generation section 202 perform an "ON" operation.

Therefore, when the high-level selection setting signal SEL is inputted to the gradation current generation supply circuits PXA, the gradation current generation section 201 is set as the data output state and supplies the gradation currents Ipix to the data lines DL which are generated based on the display data d0~d3 (inverted output signals d10*~d13*) taken in and held in the data latch section 101 and 102 at previous timing. Simultaneously, while supplying the reference current Iref (The gate terminal is supplied while flowing in the current path of the reference current transistor) to the gradation current generation section 202, there fresh operation executes recharging of the charge storage circuit (the capacitor Ca shown in FIG. 3) in the gradation current generation section 202 to specified voltage.

Meanwhile, in the gradation current generation supply circuits PXA, when the selection setting signal SEL inputted from the system controller 140A is the low-level, while the output control transistor Tr311 performs an "OFF" operation with the inverter 315, the output control transistor Tr312 performs an "ON" operation. Thereby, the current output contact OUTi of the gradation current generation section 201 and the connection with the data lines DL are blocked out (shut down), and the current output contact OUTi of the gradation current generation section 202 is connected to the data lines DL (output contact Tout) via the output control transistor Tr312.

Simultaneously during this period, while the low-level control signal is applied to the control terminal of the current supply source control transistor Tr313 with the NAND circuit 316 and the inverter 318 corresponding to the output timing (high-level out put timing) of the shift signals SR, the high-level control signal CK1 is supplied to the gradation current generation section 201. Also, the current supply source control transistor Tr313 and the refresh control transistor of the gradation current generation section 201 perform an "ON" operation.

Furthermore, while not involved with the output timing of the shift signals SR but having the high-level control signal to the control terminal of the current supply source control transistor Tr314 by the NAND circuit 317 and the inverter 319 and by inputting the low-level selection setting signal SEL, the control signal CK2 of the low-level is supplied to the gradation current generation section 202. Also, the current supply source control transistor Tr314 and the refresh control transistor of the gradation current generation section 202 perform an "OFF" operation.

Therefore, when the low-level selection setting signal SEL is inputted to the gradation current generation supply circuits PXA, the gradation current generation section 202 is set as the data output state and supplies the gradation currents Ipix to the data lines DL which are generated based on the display data d0~d3 (inverted output signals d10*~d13*) taken in and held in the data latch section 101 and 102. Simultaneously, while supplying the reference current Iref to the gradation current generation section 201, the refresh operation executes recharging of the charge storage circuit in the gradation current generation section 201 to specified voltage.

Thus, in the gradation current generation supply circuits PXA related to this embodiment, while shifting two sets of gradation current generation section 201 or 202 of either one as the data output state by suitably setting the signal level of the selection setting signal SEL supplied from the system controller 140A for every predetermined cycle (For example, the selection period), the refresh operation can be executed simultaneously to the gradation current generation section of the other side.

In addition, even though in this embodiment a configuration is described in which the reference current Iref is supplied in common via the common reference current supply line Ls from a single constant generation source IR relative to all of the gradation current generation supply circuits PXA1, PXA2, . . . provided in the data driver 130A, this invention is not restricted to this arrangement. For example, when a plurality of data drivers are provided in the display panel, the configuration may comprise individually a constant current generation source for each data driver, and also may comprise a plurality of constant current generation sources corresponding to each of a plurality of gradation current generation circuits provided in a single data driver.

(The Drive Control Method of the Display Device)

Next, the display device of this embodiment and the drive control method of the data driver will be explained with reference to the drawings.

Figure 11:
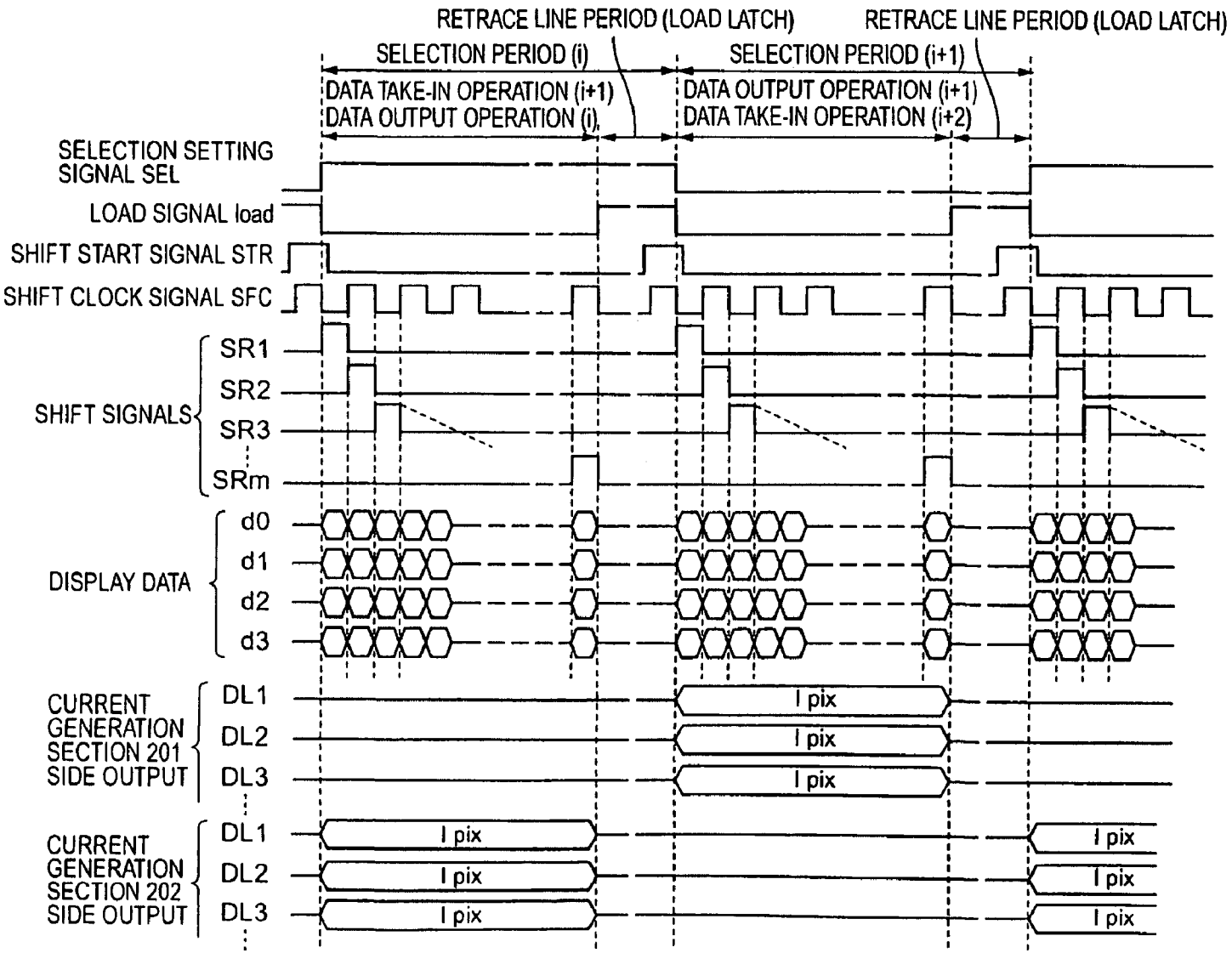
FIG. 11 is a timing chart showing an example of the control operations in the data driver related to the embodiments.

FIG. 11 is a timing chart showing an example of the control operations in the data driver related to the embodiments.

Figure 12:
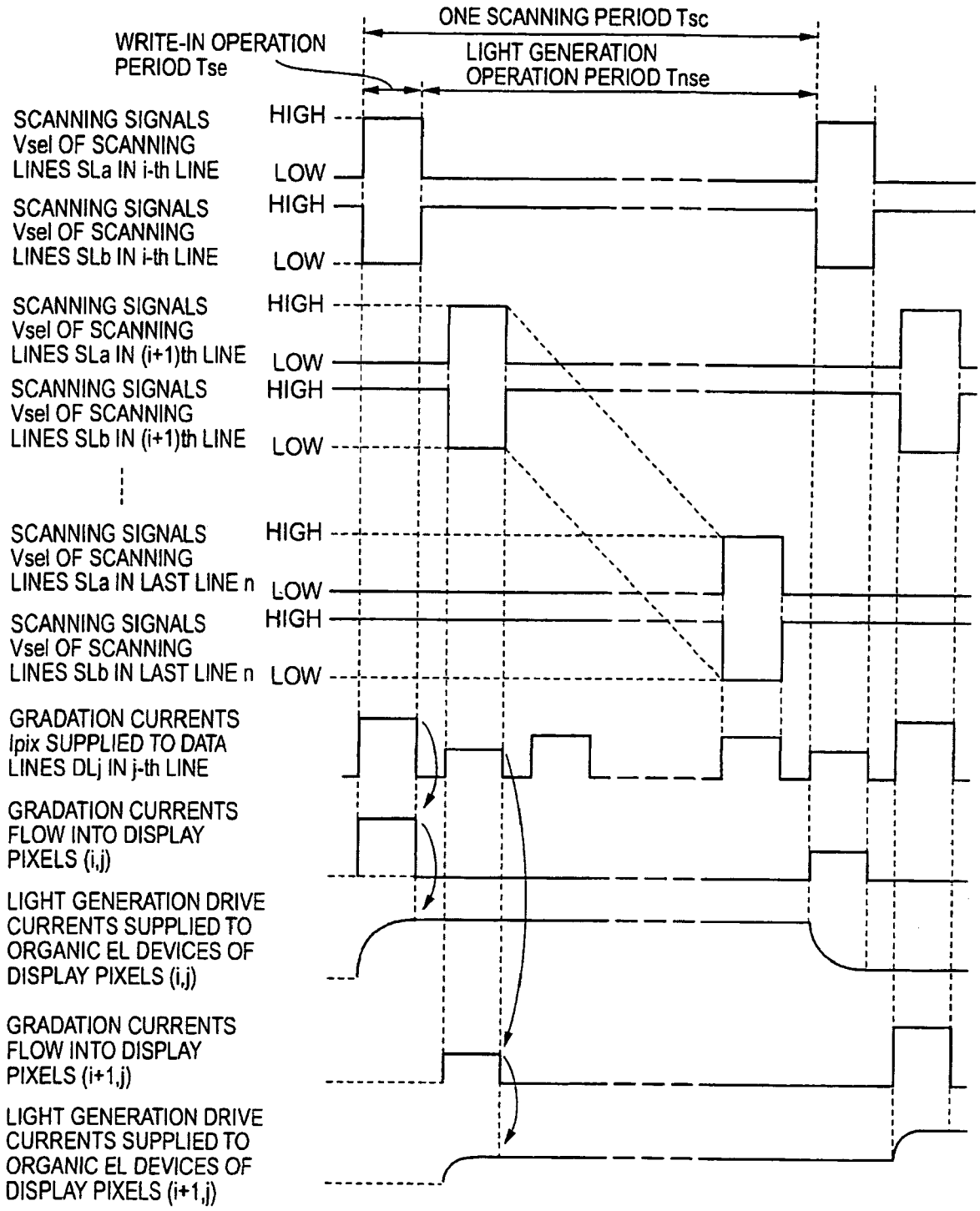
FIG. 12 is a timing chart showing an example of the control operations of the display pixels in the display panel related to the embodiments.

FIG. 12 is a timing chart showing an example of the control operations of the display pixels in the display panel related to the embodiments.

Here, explanation with suitably refer to the configuration of the current generation supply circuit shown in FIG. 3 in addition to the configuration of the first embodiment of the data driver described in FIG. 9 and FIG. 10.

The control operations in the data driver 130A, in summary, are set to a data take-in period (data take-in operation) in addition to a refresh period (refresh operation) for supplying and for refreshing the reference current Iref to either of the gradation current generation section 201 or 202 while taking in and holding the display data d0~d3 supplied from the display signal generation circuit 150A to the data latch section 101 provided in each of the gradation current generation supply circuits PXA1, PXA2, . . . as described above; and a data output period (data output operation) for generating the gradation currents Ipix corresponding to the display data d0~d3 taken in and held by the gradation current generation section 201 or 202 and for supplying each of the display pixels (pixel driver circuits DCx) via the data lines DL1, DL2, DL3, . . . . These operational periods are executed simultaneously in every selection period (one cycle) and the data output operation is repeatedly executed alternately by the two sets of gradation current generation section 201 and 202.

In the data take-in period which takes in and holds the display data d0~d3 to the data latch section 101 of each of the gradation current generation supply circuits PXA1, PXA2, . . . , as shown in FIG. 11, by inputting the low-level selection setting signal SEL in the selection period (i) in the i-th line and based on the shift signals SR1, SR2, SR3, . . . from the shift register circuit 131A except for periods of the retrace line period of the selection periods (i), the operation sequentially takes in and holds the display data d0~d3 which shifts corresponding to each column of the display pixels in the (i+1) line and is executed consecutively for one line periods to the data latch section 101 of each of the gradation current generation supply circuits PXA1, PXA2, . . . provided corresponding to each of the data line DL1, DL2, DL3, . . . .

Additionally, in this operational period when the output control transistor Tr312 performs an "ON" operation in the gradation current generation section 201, corresponding to the display data d0~d3 in the i-th line taken in and held by the data take-in operation at previous timing (selection period of the i-1 line) and based on the inverted output signals d10*~d13* outputted from the data latch section 102, the "ON/OFF" state of the plurality of switching transistors (equivalent to the switching transistors TP16~TP19 shown in FIG. 3) is controlled. Accordingly, the composite currents of the module currents flow to the module current transistors (equivalent to the module current transistors TP12~TP15 shown in FIG. 3) connected to the switching transistor(s) which perform an "ON" operation and are simultaneously (in parallel) supplied (data output period) to the data lines DL1, DL2, DL3, . . . as the gradation currents Ipix from each of the gradation current generation supply circuits PXA1, PXA2, . . . . Here, each of the module currents which flow to the module current transistors and equal to the current generation supply circuit (Refer to FIG. 3) mentioned above is set to a predetermined ratio of current values (For instance, the module currents have different current values from each other defined by $2^n$ relative to the predefined reference current Iref. The supply operation (data output operation) of the gradation currents Ipix is continued until directly before the retrace line period in the appropriate selection period (i).

Furthermore, in this operational period, as the current supply source control transistor Tr313 performs an "ON" operation, the refresh control transistor provided in the gradation current generation section 201 also performs an "ON" operation. Accordingly, the reference current Iref flows to the reference current transistor in the gradation current generation section 201 and the electrical charge based on the reference current is supplied to the gate terminal of this reference current transistor. Thereby, the electrical charge is stored in the capacitor (charge storage circuit) formed at the gate terminal of the reference current transistor and recharging (refresh operation) the potential of the gate terminal to predetermined constant voltage is performed.

Subsequently, during the operation (data take-in period) which takes in sequentially the display data d0~d3 for one line periods mentioned above after the retrace line period (hereinafter denoted as "load latch period") is completed, the non-inverted output signals based on the display data d0~d3 taken in and held in the data latch section 101 of each of the gradation current generation supply circuits PXA1, PXA2, . . . are transferred to the data latch section 102 based on the load signals load collectively outputted from the system controller 140A.

Afterwards, by inputting the high-level selection setting signal SEL of the selection period (i+1) in the (i+1) line except for periods of the retrace line period in the selection periods (i+1), a similar operation of the gradation current generation section 202 in the above-mentioned data output period is executed corresponding to the display data d0~d3 in the (i+1) line taken in and held in each of the gradation current generation supply circuits PXA1, PXA2, . . . based on the inverted output signals d10*~d13* outputted from the data latch section 102 to the gradation current generation section 201. Accordingly, the module currents are integrated selectively and simultaneously (in parallel) supplied to data lines DL1, DL2, DL3, . . . as the gradation currents Ipix from each of the gradation current generation supply circuits PXA1, PXA2, . . . .

Also, in this operational period and similar to the data take-in period mentioned above, the operation takes in and holds consecutively for one line periods the display data d0~d3 in the (i+2) line and is executed to the data latch section 101 of each of the gradation current generation supply circuits PXA1, PXA2, . . . based on the shift signals SR1, SR2, SR3 . . . outputted sequentially from the shift register circuit 131A.

Furthermore, in this operational period, as the current supply source control transistor Tr314 performs an "ON" operation, the refresh control transistor provided in the gradation current generation section 202 also performs an "ON" operation. Accordingly, recharging (refresh operation) of the potential of the gate terminal of the reference current transistor provided in the gradation current generation section 202 to predetermined constant voltage is performed.

Also, while taking in and holding the display data d0~d3 to the data latch section 101 of each of the gradation current generation supply circuits PXA1, PXA2, . . . as mentioned above, the data take-in operation and the refresh operation supplies and refreshes the reference current in the gradation current generation section of one or the other of 201 or 202; and the data output operation generates the gradation currents Ipix corresponding to the display data d0~d3 taken in as described above by the opposite side of the gradation current generation section 201 or 202 and supplies each of the data lines DL1, DL2, DL3, . . . . In this manner, these operations are set to be repeatedly executed alternately in synchronization with the gradation current generation section 201 and 202 for every 1 selection period.

Moreover, in the display device related to this embodiment, in the situation of driving the entire image display area of the display panel 110A in the specified state, such as a black state, etc., by inputting a plurality of digital signal bits in which the signal levels of the display data d0~d3 are set as all "0's" (zeros) except for periods of the retrace line period in the selection periods, the non-inverted output signals outputted to the gradation current generation section 201 and 202 from the data latch section 102 of each of the gradation current generation supply circuits PXA1, PXA2, . . . are set as all "0's" (zeros).

Accordingly, even though all the switching transistors which select and integrate the module currents as well as any of the gradation current generation section 201 and 202 perform an "OFF" operation and the gradation currents are not generated, the signal level of the data lines becomes an indefinite state via the specified voltage application transistor Tr52 provided in the specified state setting section 50. For example, by applying the predetermined black display voltage (specified voltage Vbk) corresponding to the light generation operation in the lowermost luminosity gradation of the display pixels to the data lines DL, the signal level of the data lines becomes stationary immediately and excellent black display operation is executed.

Also, for example, in the situation which has the pixel driver circuit of the above-mentioned display pixels shown in FIG. 8, the control operations in the display panel 110A (display pixels) is set as (Tsc=Tse+Tnse) and drive control is equivalent to the pixel driver circuits DCx mentioned above executed in each operational period. Specifically, as shown in FIG. 12, one scanning period Tsc which displays the desired image information for one screen of the display panel 110A represents one cycle. Within this one scanning period Tsc, as the display pixel clusters connected to the scanning lines of specified lines are selected by the scanning driver 120A, the gradation currents Ipix corresponding to the display data d0~d3 supplied from the data driver 130A are written in and held as the signal voltage. The write-in operation period Tse (selection period of the display pixels) supplies the gradation currents Ipix to the organic EL devices OEL and commences the light generation operation at predetermined luminosity gradations. The light generation operation period Tnse (non-selection period of the display pixels) continues the light generation operation at predetermined luminosity gradations by supplying and maintaining the light generation drive currents to the organic EL devices OEL corresponding to the gradation currents Ipix based on this held signal voltage. Here, the write-in operation period Tse established for every line is set so that a time overlap does not occur with one another.

Also, the write-in operation period Tse is a set length to at least include a constant period which supplies in parallel the gradation currents Ipix to each of the data lines DL in the data output operation in the above-mentioned data driver 130A.

Accordingly, in the write-in operation period as shown in FIG. 12, is initiated by execution of a selection scan applied at predetermined signal levels to the scanning lines SLa and SLb with the scanning driver 120A relative to the display pixels of specified lines (i-th lines). As the operation holds simultaneously the gradation currents Ipix as the voltage component to the storage capacitor (equivalent to the capacitor Cx provided in the pixel driver circuits DCx shown in FIG. 8) provided in each of the display pixels and supplies in parallel to each of the data lines DL by the data driver 130A is executed, these gradation currents Ipix are supplied to the organic EL devices OEL and the light generation operation commences. In the succeeding light generation operation periods Tnse, the operation for emitting light at luminosity gradations corresponding to the display data continues by supplying and maintaining the light generation drive currents to the organic EL devices OEL corresponding to the gradation currents Ipix based on the voltage component held during the above-mentioned write-in operation Tse.

By executing such a series of drive control operations, as shown in FIG. 12, repeated sequentially to the display pixel clusters of all lines (1~n lines) that constitute the display panel 110A, one screen of display data in the display panel 110A is written in. Thus, each of the display pixels emit light at predetermined luminosity gradations and the desired image information is displayed.

Therefore, according to the data driver and display device related to this embodiment, the gradation currents Ipix supplied to the display pixel clusters of specified lines via the data lines DL to each of the gradation current generation supply circuits PXA1, PXA2, . . . are generated based on the constant reference current Iref supplied via the common reference current line Ls from a single constant current generation source IR and the display data d0~d3 consists of a plurality of digital signal bits. For this reason, even when executing the light generation operation in the display pixels at relatively low luminosity gradations, and more specifically, when the current values of the gradation currents Ipix are exceptionally low or when the supply time (selection time) of the gradation currents Ipix to the display pixels is set briefly to a highly detailed display panel, etc., the influence of signal delays of the signal (reference current Iref) supplied to each of the gradation current generation supply circuits PXA1, PXA2, . . . of the data driver in relation to the generation of the gradation currents Ipix is eliminated, as well as any decline in the operating speed of the data drive can be controlled. Also, the current characteristic relative to the gradations specified by the digital signals of the display data of the gradation currents generated by each of the gradation current generation supply circuits PXA1, PXA2, . . . can be equalized, plus improvement in the display response characteristics in the display device and the display image quality can be achieved.

Moreover, the gradation current generation supply circuit comprises two sets (Refer to FIG. 10) of data latch section and two sets of current generation section relative to each of the data lines DL. Since gradation currents having current values corresponding appropriately to the display data relative to each of the display pixels from the data driver can be supplied continually while executing the data take-in operation to the data latch sections and the data output operation from the current generation sections in parallel and by repeatedly executing alternately the operating state for every selection period, the operating speed of the data driver can be raised substantially. Also, the light generation operation can be executed rapidly in the display pixels at the desired luminosity gradations, as well as the display response speed and display image quality of the display device can be elevated further.

Besides, since the recharge (refresh operation) of the potential (gate potential) applied to the gate terminal of each of the module current transistors which constitute each of the gradation current generation circuits can be accomplished to predetermined constant voltage periodically, decline of the gate potential resulting from current leakage, etc. in the module current transistors can be controlled by variation of the continuity condition of each of the module current transistors, gradation currents can be altered, the phenomenon in which the luminosity gradations of the display pixels become uneven or ragged can be controlled, and excellent display image quality can be acquired.

SECOND EMBODIMENT OF THE DISPLAY DEVICE

Next, the second embodiment of the display device applicable to the current generation supply circuit related to the present invention will be explained.

(An Example Configuration of the Data Driver)

Figure 13:
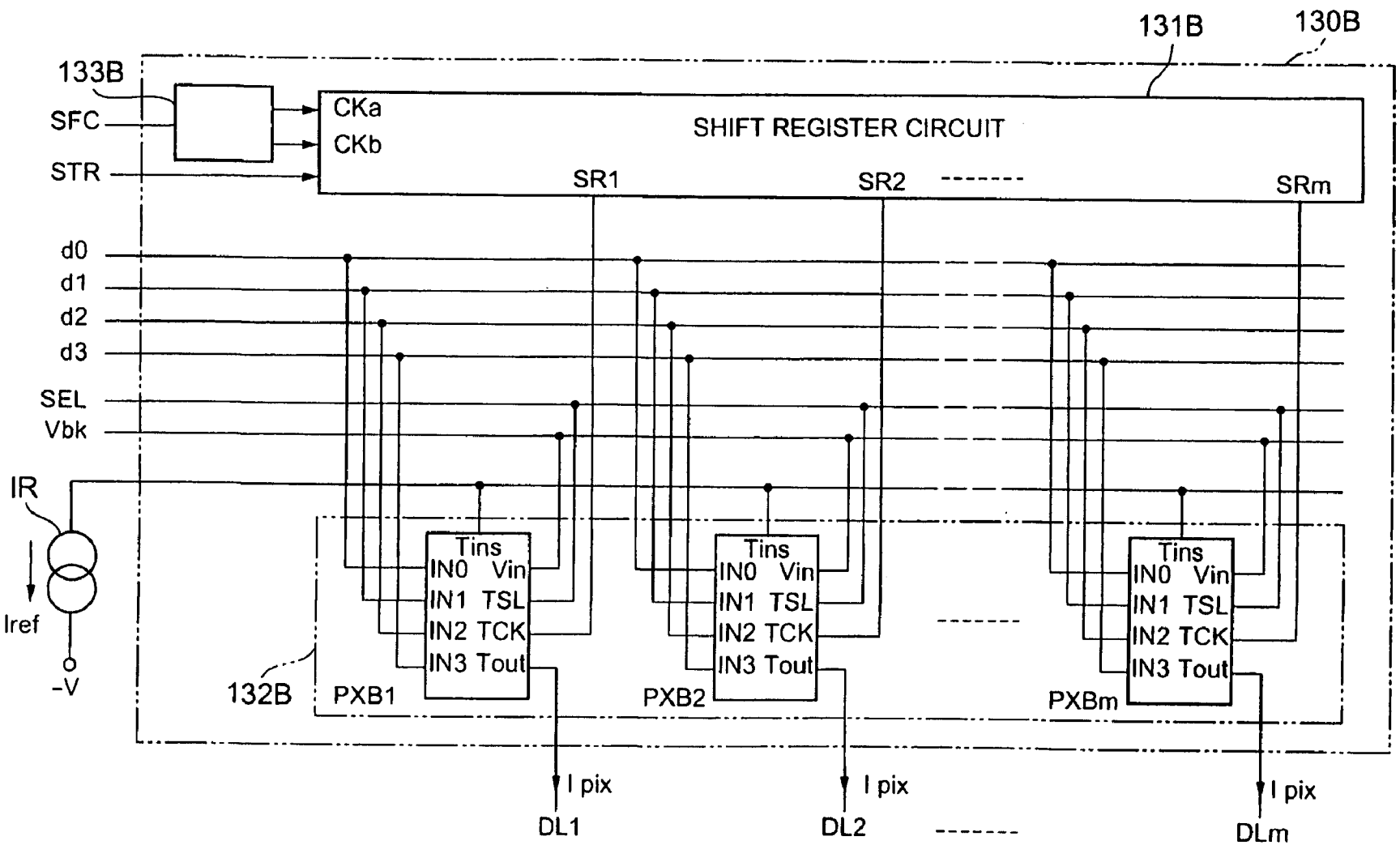
FIG. 13 is an outline configuration diagram showing an example of one arrangement of the data driver applicable to the second embodiment of the display device related to the present invention.

FIG. 13 is an outline configuration diagram showing an example of one arrangement of the data driver applicable to the second embodiment of the display device related to the present invention.

Figure 14:
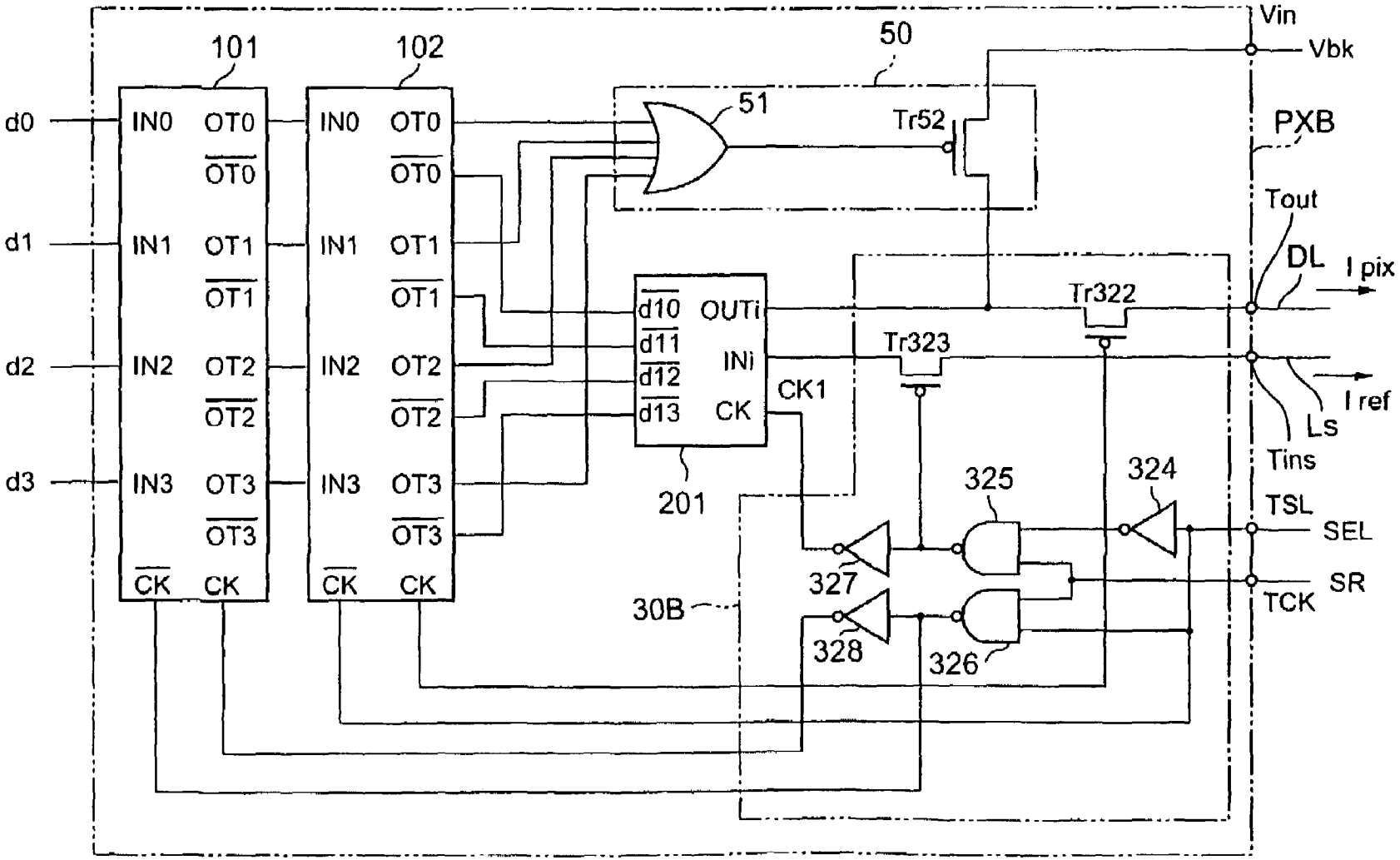
FIG. 14 is an outline configuration diagram showing one illustrative example of the gradation current generation supply circuit applicable to the data driver related to the embodiments.

FIG. 14 is an outline configuration diagram showing one illustrative example of the gradation current generation supply circuit applicable to the data driver related to the embodiments.

Here, concerning any configuration equivalent to the display device and data driver in the embodiment mentioned above, the same or equivalent nomenclature is appended and the explanation is simplified or omitted from the description.

The display device related to this embodiment, in summary, while comprising the display panel 110A which has the equivalent configuration of the display device 100A shown in FIG. 6 and the scanning driver 120A comprises a data driver 130B. The data driver 130B, as shown in FIG. 13, has a configuration comprising a reversal latch circuit 133B, a shift register circuit 131B and a gradation current generation supply circuit group 132B. The reversal latch circuit 133B generates the non-inverted clock signal CKa and the inverted clock signal CKb based on the shift clock signal SFC supplied from the system controller 140A identical to the data driver 130A (Refer to FIG. 9) in the above-mentioned embodiment. The shift register circuit 131B executes output sequentially of the shift signals SR1, SR2, SR3, . . . having a predetermined signal frequency (clock frequency) based on the non-inverted clock signal CKa, the inverted clock signal CKb and the sampling start signal STR. The gradation current generation supply circuit group 132B takes in sequentially the display data d0~d3 supplied from the display signal generation circuit 150A, generates the gradation currents Ipix having predetermined current values and supplies to each of the data lines DL1, DL2, DL3, . . . based on the output timing of the shift signals SR1, SR2, SR3, . . . .

Each of the gradation current generation supply circuits PXB1, PXB2, . . . (hereinafter denoted as the "gradation current generation supply circuits PXB") constitute the gradation current generation supply circuit group 132B, as shown in FIG. 14, and has a configuration comprising the data latch section 101 and 102, the gradation current generation section (gradation current generation circuit) 201, an operation setting section 30B (operational state setting circuit) and the specified state setting section 50 (specified state setting circuit). The data latch section 101 and 102 consist of an initial stage and a latter stage with each containing the composition of the current generation supply circuit ILA as the base element shown in FIG. 1. A single gradation current generation section 201 is connected to the inverted output contact points OT0*~OT3* of the above-mentioned data latch section 102. The operation setting section 30B sets the selection state and the operating state of each of the gradation current generation supply circuits PXB1, PXB2, . . . based on the selection setting signal SEL. The specified state setting section 50 applies the specified voltage Vbk to the data lines DL1, DL2, DL3, . . . when connecting with the non-inverted output contacts OT0~OT3 of the data latch section 102 and operating the display pixels in a specified drive state (black display operation, etc.). Here, since the data latch section 101 and 102, the gradation current generation section 201 and the specified state setting section 50 have equivalent configurations and features to the embodiments mentioned above, explanation is omitted from this portion of the description.

Referring to FIG. 14, the operation setting section 30B has a configuration comprising an inverter 324, an output control transistor Tr322, a NAND circuit 325, a NAND circuit 326, an inverter 327, an inverter 328 and a current supply source control transistor Tr323. The inverter 324 performs reversal processing of the selection setting signal SEL outputted from the system controller 140A. The output control transistor Tr322 by which the inverted signal (output signal of the inverter 324) of the above-mentioned selection setting signal SEL is applied to the control terminal while the current path is provided between the current output contact OUTi of the gradation current generation section 201 and the output contact Tout to which the data lines DL are connected. The NAND circuit 325 receives as input the inverted signal of the selection setting signal SEL and the shift signals SR from the shift register circuit 131B. The NAND circuit 326 receives as input the selection setting signal SEL and the shift signals SR from the shift register circuit 131B. The inverter 327 performs reversal processing of the logic output of the NAND circuit 325. The inverter 328 performs reversal processing of the logic output of the NAND circuit 326. The current supply source control transistor Tr323 by which the output signal of the above-mentioned NAND 325 is applied to the control terminal while the current path is provided between the current input contact INi of the gradation current generation section 201 and the reference current contact Tins to which the reference current Iref is supplied (the reference current supply line Ls is connected).

Here, the output signal of the inverter 327 is applied to the refresh control transistor (equivalent to the transistor Tr10 shown in FIG. 3) provided in the gradation current generation section 201 as the control signal CK1. The output signal of the inverter 328 is inputted to the non-inverted input contact CK of the data latch section 101 as the non-inverted clock signal CLK and the output signal of the NAND circuit 326 is inputted to the inverted input contact CK* of the data latch section 101 as the inverted clock signal CLK*. Also, the inverted signal (output signal of the inverter 324) of the selection setting signal SEL is inputted to the non-inverted input contact CK of the data latch section 102 as the non-inverted clock signal CK* and the selection setting signal SEL is inputted directly to the inverted input contact CK* of the data latch circuit 102 as the inverted clock signal CLK*.

The control operations in the gradation current generation supply circuit PXB which has such a configuration, when the selection setting signal SEL inputted to the operation setting section 30B is a period (For example, periods other than the retrace line period in a selection period) which functions as the high-level and at timing the shift signals SR (high-level) are outputted from the shift register circuit 131B. The display data d0~d3 consisting of a plurality of digital signal bits are taken in simultaneously and held in the data latch section 101. Also, at timing (For example, during the retrace line period) when the selection setting signal SEL functions as the low-level the held data is transferred to the data latch section 102 and the non-inverted output signals are taken in simultaneously and held in the data latch section 101 based on the display data d0~d3. Moreover, at timing (For example, periods other than the retrace line period in a selection period) set to the selection setting signal SEL as the succeeding high-level, the inverted output signals d10*~d13* are outputted simultaneously to the gradation current generation section 201 based on the above-mentioned non-inverted output signals (Namely, the display data d0~d3) held in the data latch section 102.

Here, when the selection setting signal SEL inputted to the operation setting section 30B is the high-level, the output control transistor Tr322 performs an "ON" operation by the inverter 324. Thereby, the current output contact OUTi of the gradation current generation section 201 is connected to the data lines DL (the output contact Tout) via the output control transistor Tr322.

Simultaneously during this period, while not involved with the output timing of the shift signals SR but having the high-level control signal (output signal of the NAND circuit 325) to the control terminal of the current supply source control transistor Tr323 by the NAND circuit 325 and the inverter 327, the low-level control signal CK1 is supplied to the gradation current generation section 201 and the current supply source control transistor Tr323 and the refresh control transistor of the gradation generation section 201 perform an "OFF" operation.

Consequently, when the high-level selection setting signal SEL is inputted to the gradation current generation supply circuits PXB, the gradation current generation section 201 is set as the data output state and supplies the gradation currents Ipix to the data lines DL which are generated based on the display data d0~d3 (inverted output signals d10*~d13*) taken in and held in the data latch section 101 and 102 at previous timing. Simultaneously, the data latch section 101 is set as the data take-in state (data take-in operation) and the operation which takes in the display data d0~d3 is executed.

Meanwhile, when the low-level selection setting signal SEL is inputted to the operation setting section 30B, the output control transistor Tr322 performs an "OFF" operation by the inverter 324. Thereby, the current output contact OUTi of the gradation current generation section 201 and the connection to the data lines DL are blocked out (shut down).

Simultaneously during this period, while the low-level control signal is applied to the control terminal of the current supply source control transistor Tr323 with the NAND circuit 325 and the inverter 327 corresponding to the output timing (high-level output timing) of the shift signals SR, the high-level control signal CK1 is supplied to the gradation current generation section 201. Also, the current supply source control transistor Tr323 and the refresh control transistor of the gradation current generation section 201 perform an "ON" operation.

Therefore, when the low-level selection setting signal SEL is inputted to the gradation current generation supply circuits PXB, while the non-inverted output signals are being transferred to the data latch section 102 based on the display data taken in and held in the data latch section 101, the reference current Iref is supplied to the gradation current generation section 201 (The gate terminal is supplied while flowing in the current path of the reference current transistor). Additionally, the refresh operation executes recharging of the charge storage circuit (the capacitor Ca shown in FIG. 3) in the gradation current generation section 201 to specified voltage.

Thus, in the gradation current generation supply circuits PXB related to this embodiment, by suitably setting the signal level of the selection setting signal SEL supplied from the system controller 140A for every predetermined cycle (For example, a retrace line period and other periods), the state of executing the take-in and hold operation of the display data to the data latch 101 and the data output operation of the gradation current generation section 201, as well as the state of executing the transfer operation of the digital signals based on the display data from the data latch section 101 to the data latch section 102 and the refresh operation of the gradation current generation section 201 can be set to repeat alternately.

(The Drive Control Method of the Display Device)

Next, the display device of this embodiment and the drive control method of the data driver will be explained with reference to the drawings.

Figure 15:
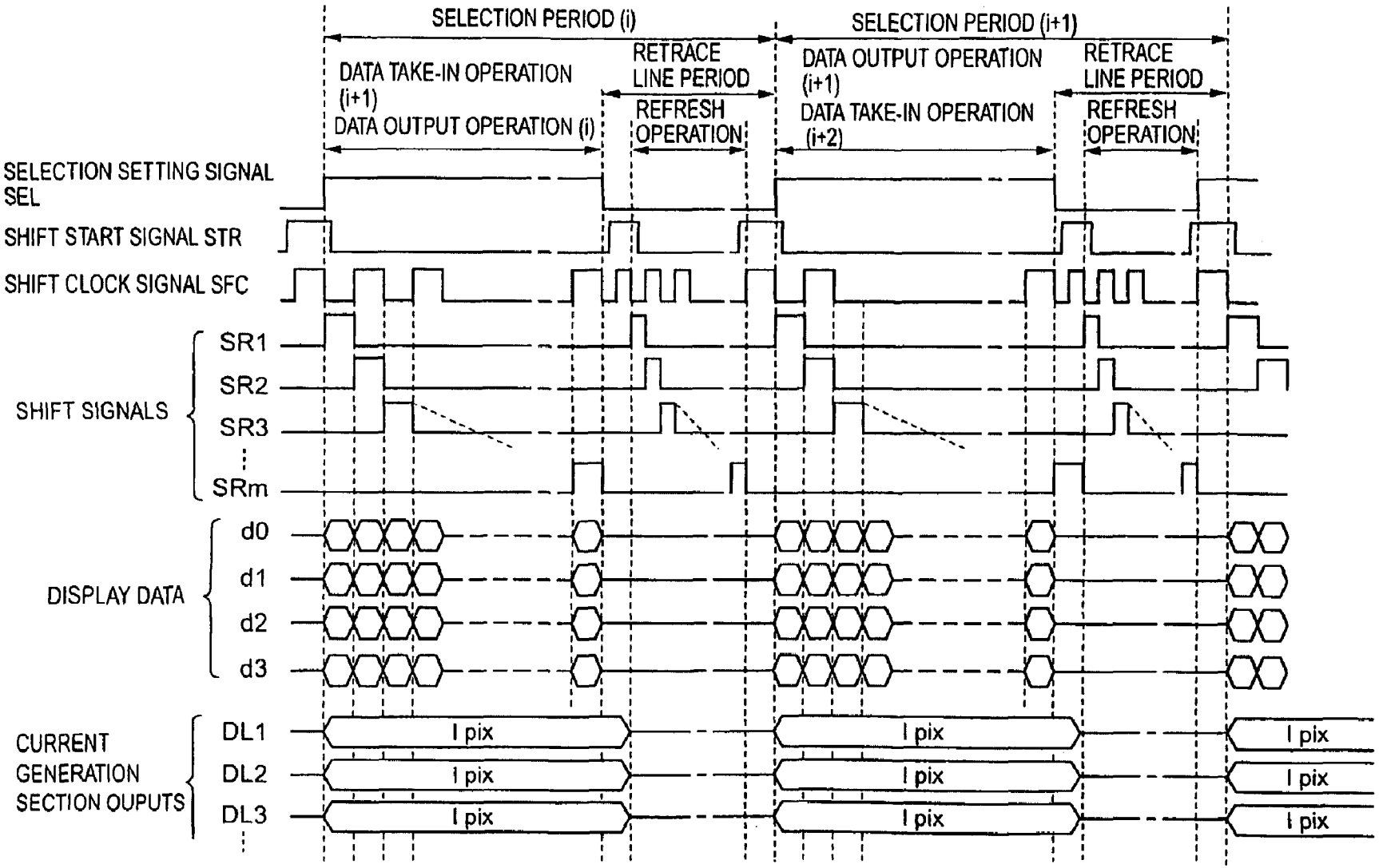
FIG. 15 is a timing chart showing an example of the control operations in the data driver related to the embodiments.

FIG. 15 is a timing chart showing an example of the control operations in the data driver related to the embodiments.

The control operations in the data driver 130B provided with the gradation current generation supply circuits PXB (gradation current generation supply circuit group 132B) mentioned above, in summary, set the data take-in period which takes in and holds the display data d0~d3 to the data latch section 101 provided in each of the gradation current generation supply circuits PXB1, PXB2, . . . described above and the data output period generates the gradation currents Ipix corresponding to the display data d0~d3 taken in and held as mentioned above by the gradation current generation section 201 and supplies to each of the display pixels via each of the data lines DL1, DL2, DL3, . . . The data take-in operation and the data output operation are simultaneously executed for every selection period and controls to execute the refresh operation during the retrace line period of the selection period.

The data take-in period which takes in and holds the display data d0~d3 to the data latch section 101 of each of the gradation current generation supply circuits PXB1, PXB2, . . . , as shown in FIG. 15, as the high-level selection setting signal SEL is inputted except for periods of the retrace line period in the selection periods (i) in the i-th line and sequential input of the shift signals SR1, SR2, SR3 . . . having the first signal frequency (clock frequency) from the shift register circuit 131B, the operation sequentially takes in and holds the display data d0~d3 while shifting corresponding to each column of the display pixels in the (i+1) line to the data latch section 101 of each of the gradation current generation supply circuits PXB1, PXB2, . . . provided corresponding to each of the data lines DL1, DL2, DL3, . . . and is executed consecutively for one line periods.

Additionally, in this operational period when the output control transistor Tr322 performs an "ON" operation in the gradation current generation section 201, corresponding to the display data d0~d3 in the i-th line taken in and held by the data take-in operation at previous timing (selection period of the i−1 line) and based on the inverted output signals d10*~d13* outputted from the data latch section 102, the composite currents of the module currents flow to the module current transistors connected to the switching transistor(s) which perform an "ON" operation and are simultaneously (in parallel) supplied (data output period) as the gradation currents Ipix to the data lines DL1, DL2, DL3, . . . from each of the gradation current generation supply circuits PXB1, PXB2 . . . The supply operation (data output operation) of the gradation currents Ipix is continued until directly before the retrace line period in the appropriate selection period (i).

In the refresh period for refreshing the potential of the gate terminal of each reference current transistor provided in the gradation current generation section 201 of each of the gradation current generation supply circuits PXB1, PXB2, . . . , as shown in FIG. 15, by inputting the low-level selection setting signal SEL in the retrace line period of the selection period (i) in the i-th line, the output control transistor Tr322 performs an "OFF" operation and supply of the gradation currents Ipix from the gradation current generation section 201 to the data lines DL1, DL2, DL3, . . . is blocked out (shut down).

Additionally, in this operational period, by inputting sequentially the shift signals SR1, SR2, SR3, . . . having the second signal frequency (clock frequency) which is higher than the above-mentioned first signal frequency from the shift register circuit 131B, as the current supply source control transistor TR323 performs an "ON" operation, the refresh control transistor provided in the gradation current generation section 201 also performs an "ON" operation. Accordingly, the electrical charge is stored in the capacitor formed at the gate terminal of the reference current transistor of the gradation current generation section 201 and recharging (refresh operation) of the potential of the gate terminal is performed to predetermined constant voltage.

Furthermore, in this operational period as the above-stated data is taken in and held, the non-inverted output signals based on the display data d0~d3 taken in and held in the data latch section 101 of each of the gradation current generation supply circuits PXB1, PXB2, . . . are transferred to the data latch section 102 which are taken in and held.

Subsequently, by inputting the high-level selection setting signal SEL in the period except for periods of the retrace line period in the selection periods (i+1) in the (i+1) line, a similar operation is executed in the above-mentioned data output period corresponding to the display data d0~d3 in the (i+1) line taken in and held in each of the gradation current generation supply circuits PXB1, PXB2, . . . and held in the selection period (i) in the i-th line based on the inverted output signals d10*~d13* outputted from the data latch section 102 to the gradation current generation section 201. Accordingly, the module currents are integrated selectively and simultaneously (in parallel) supplied to data lines DL1, DL2, DL3, . . . as the gradation currents Ipix from each of the gradation current generation supply circuits PXA1, PXA2, . . . .

Moreover, in this operational period and similar to the data take-in period mentioned above, the operation takes in and holds consecutively for one line periods the display data d0~d3 in the (i+2) line and is executed to the data latch section 101 of each of the gradation current generation supply circuits PXB1, PXB2, . . . based on the shift signals SR1, SR2, SR3, . . . outputted sequentially from the shift register circuit 131B.

Besides, in the selection period of the data driver related to this embodiment, because the operation executes supply sequentially and refreshes the reference current to the current generation section provided in each of the gradation current generation circuits in the retrace line period which is a relatively brief period, when the data take-in operation is executed as the shift signals are supplied from the shift register circuit 131B and while the above-mentioned refresh operation is executed, setting control is accomplished so that the signal frequency will differ (such as switching). Specifically, the signal frequency of the shift signals outputted from the shift register circuit 131B are controlled and switched to two levels (first and second frequencies) that are set (first signal frequency<second signal frequency) so at least in a retrace line period (Namely, the refresh period) the signal frequency of the shift signals is greater than compared with the selection period (data take-in period) other than the retrace line period.

Therefore, similar to the embodiment mentioned earlier and also in the display device and data driver related to this embodiment with the gradation currents Ipix corresponding to the display data d0~d3 of each of the gradation current generation supply circuits PXB1, PXB2, . . . , because the constant reference current Iref can be supplied from a single constant current generation source IR and based on the display data d0~d3 consisting of a plurality of digital signal bits, the influence of signal delays in the signals supplied to the data driver (each of the gradation current generation supply circuits PXB1, PXB2, . . . ) relative to generation of the gradation currents Ipix is eliminated. Likewise any decline of the operating speed of the data driver can be controlled, the current characteristic of the gradation currents can be equalized and further improvement in the display response characteristic in a display device along with the display image quality can be advanced.

Additionally, the gradation current generation supply circuits comprise two sets of the data latch section and a single current generation section to each of the data lines DL. Since gradation currents having current values corresponding appropriately to the display data relative to each of the display pixels from the data driver can be supplied continually while executing the data take-in operation to the data latch sections and the data output operation in the current generation section in parallel, the operating speed of the data driver can be raised substantially. Also, the light generation operation can be executed rapidly in the display pixels at the desired luminosity gradations, as well as the display response speed and display image quality of the display device can be elevated further.

Also, as compared with the configuration in data driver of the above-mentioned first embodiment comprising two sets of the current generation section corresponding to each data line, the circuit scale can be further reduced, the frame portion installed in the outer edges of the display area of the display device can be narrowed as well as miniaturization of the display device or enlargement of the display area size can be acquired.

THIRD EMBODIMENT OF THE DISPLAY DEVICE

Next, the third embodiment of the display device applicable to the current generation supply circuit related to the present invention will be explained.

Figure 16:
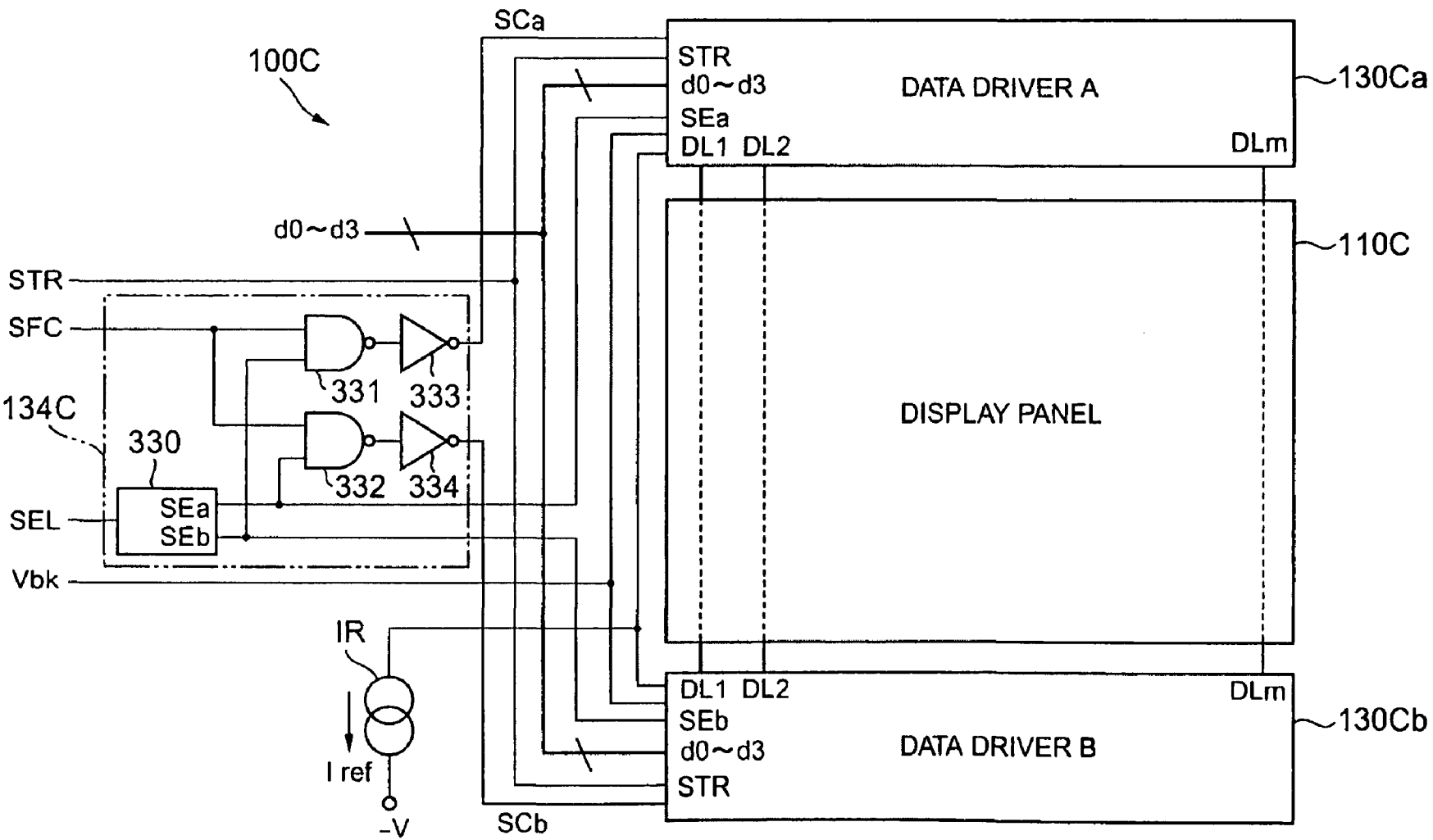
FIG. 16 is an outline block diagram showing the third embodiment of the display device applicable to the current generation supply circuit related to the present invention.

FIG. 16 is an outline block diagram showing the third embodiment of the display device applicable to the current generation supply circuit related to the present invention.

Here, concerning any configuration equivalent to the display device and data driver described in the first and second embodiments above, the same or equivalent nomenclature is appended and the explanation is simplified or omitted from the description.

Referring to FIG. 16, the display device 100C related to this embodiment, in summary, has the basic configuration as the display device 100A shown in FIG. 6 comprising a data driver 130Ca and 130Cb (signal driver circuits) and a common control unit 134C (operational state setting circuit). The data driver 130Ca and 130Cb are connected on both ends of the data lines DL1, DL2 (DL) (signal lines) connected in common for every display pixel cluster arranged in the column direction of the display panel 110C and arranged at the upper part and lower part of the display device 100C. The common control unit 134C switches and controls the operating state of the data driver 130Ca and 130Cb based on the data control signals (the shift clock signal SFC, the selection setting signal SEL, etc.) supplied from the system controller 140A.

The common control unit 134C, as shown in FIG. 16, has a configuration comprising a selection setting circuit 330, a NAND circuit 331, a NAND circuit 332, an inverter 333 and an inverter 334. The selection setting circuit 330 generates a non-inverted signal SEa and an inverted signal SEb based on the selection setting signal SEL supplied from the system controller 140A. The NAND circuit 331 receives as inputs the inverted signal SEb outputted from the above-mentioned selection setting circuit 330 and the shift clock signal SFC supplied from the system controller 140A. The NAND circuit 332 receives as inputs the non-inverted signal SEa outputted from the above-mentioned selection setting circuit 330 and the shift clock signal SFC. The inverter 333 performs reversal processing of the logic output of the NAND circuit 331. The inverter 334 performs reversal processing of the logic output of NAND circuit 332.

(An Example Configuration of the Data Driver)

Figure 17:
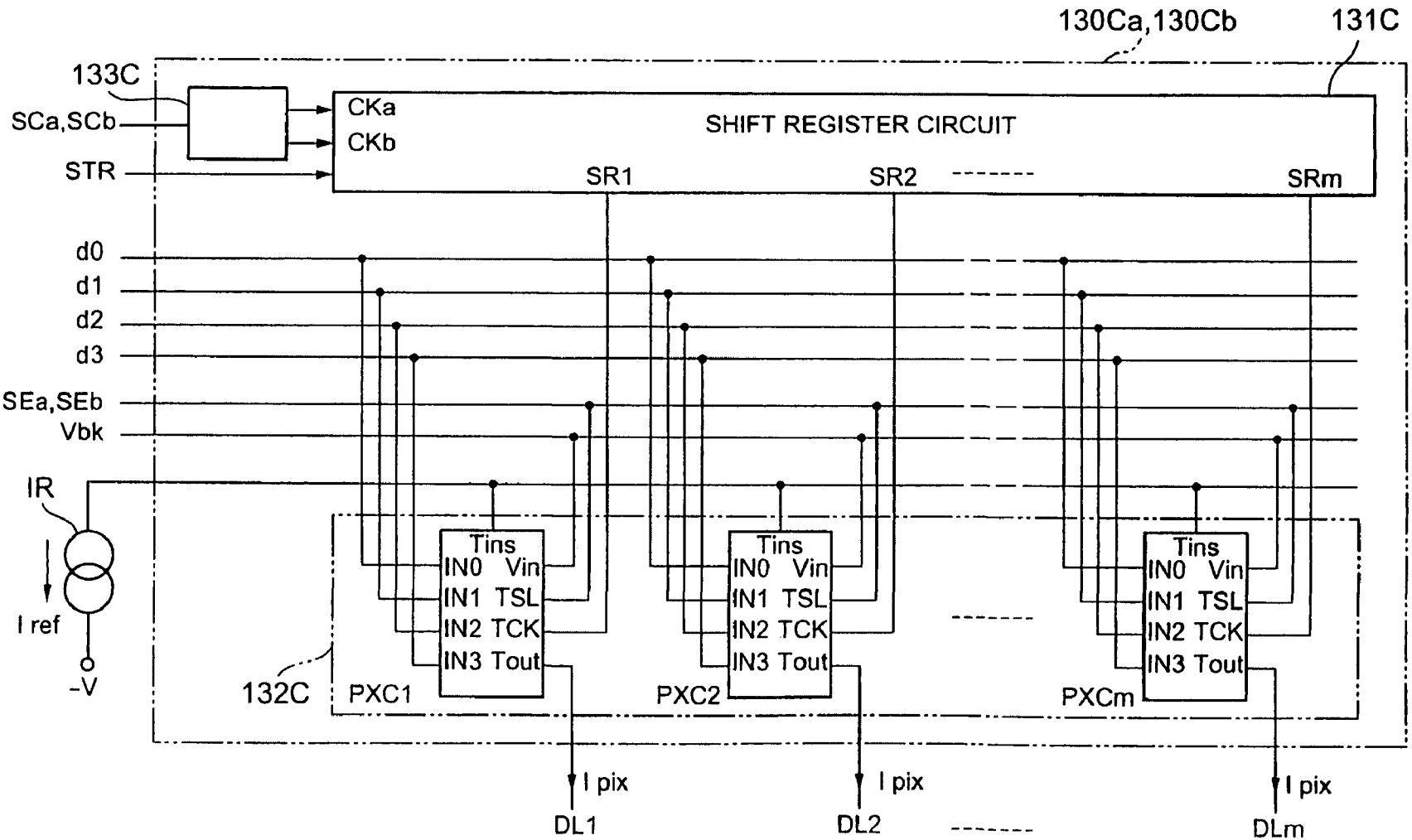
FIG. 17 is an outline configuration showing an example of one arrangement of the data driver applicable to the display device related to the embodiments.

FIG. 17 is an outline configuration showing an example of one arrangement of the data driver applicable to the display device related to the embodiments.

Figure 18:
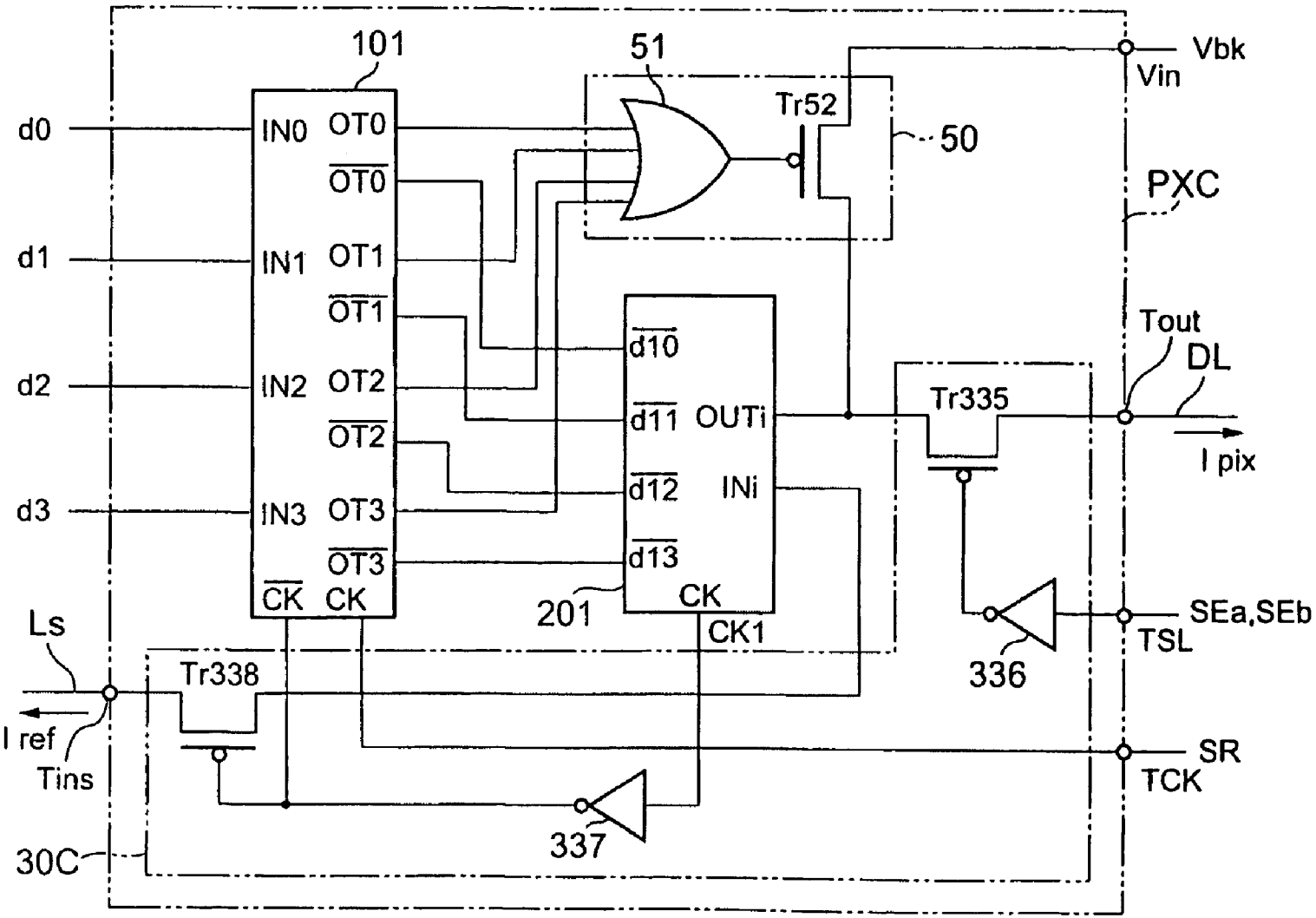
FIG. 18 is an outline configuration diagram showing one illustrative example of the gradation current generation circuit applicable to the data driver related to the embodiments.

FIG. 18 is an outline configuration diagram showing one illustrative example of the gradation current generation circuit applicable to the data driver related to the embodiments.

Each other of the data driver 130Ca and 130Cb, in summary and as shown in FIG. 17, are constituted comprising the data driver 130B (Refer to FIG. 13) described in the second embodiment above, a shift register circuit 131C which has the same configuration, a gradation current generation supply circuit group 132C and a reversal latch circuit 133C. Here, since the shift register circuit 131C and the reversal latch circuit 133C have equivalent configurations and features to the embodiments mentioned above, explanation is omitted from this portion of the description. Also, for convenience in viewing the circuit diagram, only one of the configurations is shown among the data driver 130Ca and 130Cb.

Referring now to FIG. 18, each of the gradation current generation supply circuits PXC1, PXC2, . . . (hereinafter denoted as the "gradation current generation supply circuits PXC") constitute the gradation current generation supply circuit group 132C and each is a configuration of the current generation supply circuit ILA shown in FIG. 1 as the base element. Furthermore, each has a configuration comprising a single data latch section 101 (signal holding circuit), a single current generation section 201 (current generation circuit), an operation setting section 30C (operational state setting circuit) and a specified state setting section 50 (specified state setting circuit). The single current generation section 201 is connected to the inverted output contact points OT0*~OT3* of the data latch section 101. The operation setting section 30C sets the selection state and the operating state of each of the gradation current generation supply circuits PXC1, PXC2, . . . based on the non-inverted signal SEa or inverted signal SEb outputted from the selection setting circuit 330 mentioned above. The specified state setting section 50 applies the specified voltage Vbk to the data lines DL1, DL2, . . . when connecting to the non-inverted output contact points OT0~OT3 of the data latch section 101 and operating the display pixels in the specified drive state. Here, since the data latch section 101, the gradation current generation section 201 and the specified state setting section 50 have equivalent configurations and features to the embodiments mentioned above, explanation is omitted from this portion of the description.

The operation setting section 30C, as shown in FIG. 18, has a configuration comprising an inverter 336, an output control transistor Tr335, an inverter 337 and a current supply source control transistor Tr338. The inverter 336 performs reversal processing of the non-inverted signal SEa or the inverted signal SEb outputted from the selection setting circuit 330 mentioned above. The output control transistor Tr335 by which the output signal of the inverter 324 is applied to the control terminal while the current path is established between the current output contact OUTi of the gradation current generation section 201 and the output contact Tout to which the data lines are connected. The inverter 337 performs reversal processing of the shift signals SR from the shift register circuit 131C. The current supply source control transistor Tr338 by which the output signal of the above-mentioned inverter 337 is applied to the control terminal while the current path is established between the current input contact INi of the gradation current generation section 201 to which the reference current Iref is supplied (the reference current supply line Ls is connected) and the reference current contact Tins.

Here, the shift signals SR from the shift register circuit 131C are directly applied to the refresh control transistor provided in the gradation current generation section 201 as the control signal CK1 and directly input to the non-inverted input contact CK of the data latch section 101 as the non-inverted clock signal. The inverted signal (output signal of the inverter 337) of the shift signals SR is applied to the control terminal of the current supply source control transistor Tr338 while also inputted to the inverted input contact CK* of the data latch section 101 as the inverted clock signal.

(The Drive Control Method of the Display Device)

Next, the display device of this embodiment and the drive control method of the data driver will be explained with reference to the drawings.

Figure 19:
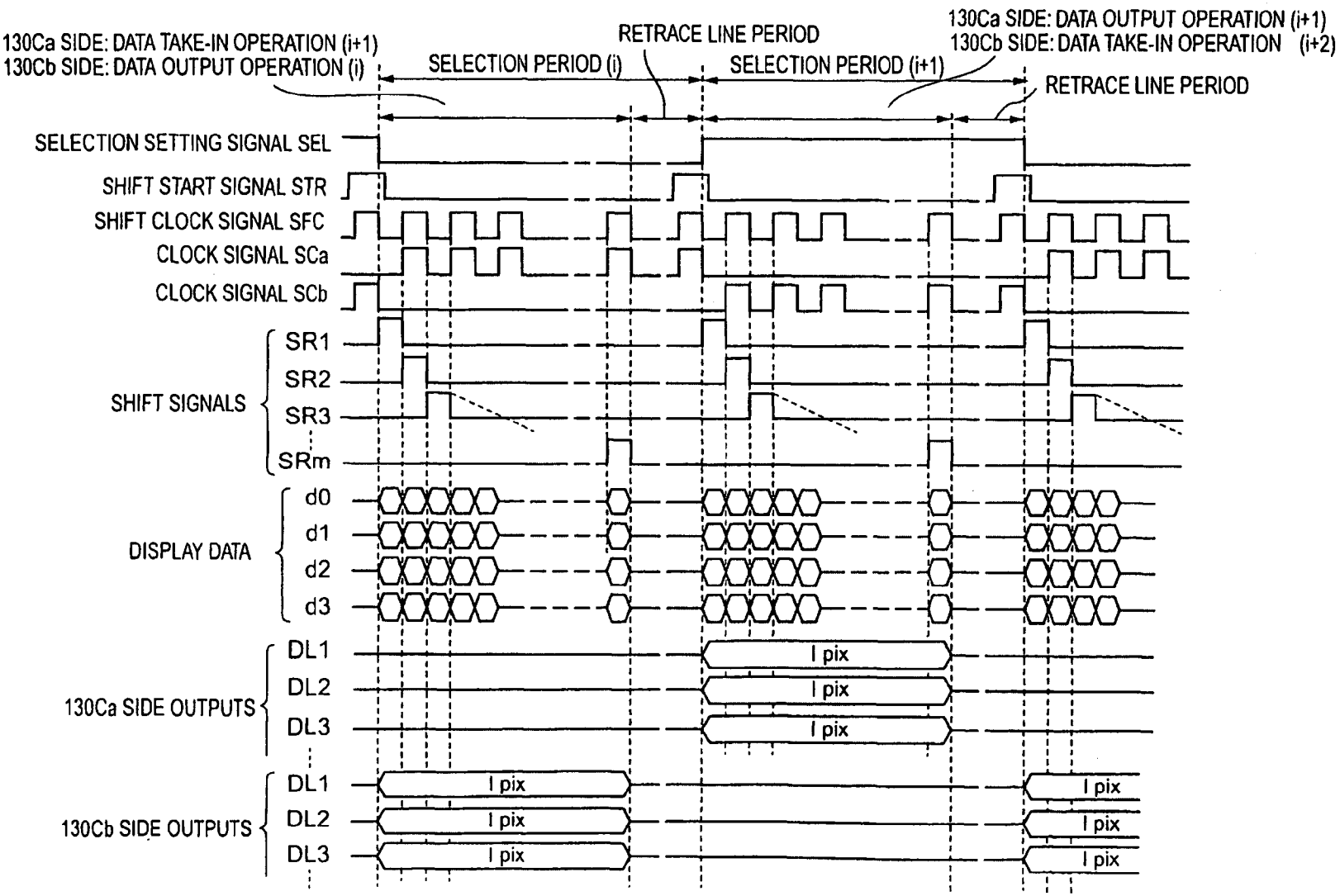
FIG. 19 is a timing chart showing an example of the control operations in the data driver related to the embodiments.

FIG. 19 is a timing chart showing an example of the control operations in the data driver related to the embodiments.

The control operations in the data driver are set with the gradation current generation supply circuits PXC (gradation current generation supply circuit group 132C) which have such a configuration as mentioned above, in summary, the data take-in period takes in and holds the display data d0~d3 in the gradation current generation supply circuit group 132C (data latch section 101 provided in each of the gradation current generation supply circuits PXC) provided in the data driver 130Ca or 130Cb and the refresh period is supplied and refreshed for the reference current in the gradation current generation section 201; and the data output period generates the gradation currents Ipix corresponding to the display data d0~d3 taken in as described above by the gradation current generation section 201 and supplies each of the display pixels via each of the data lines DL1, DL2, . . . . Furthermore, while executing simultaneously a data take-in operation and a refresh operation with one data driver for every selection period, the operation is controlled to execute the data output operation with a second data driver.

In the data take-in period, as shown in FIG. 19, by inputting the low-level selection setting signal SEL of the selection period (i) in the i-th line, the low-level of the non-inverted signal SEa and the high-level of the inverted signal SEb are generated by the common control unit 134C (selection setting circuit 330) and inputted each other to the data driver 130Ca and 130Cb.

At this stage, in the common control unit 134C, by outputting the non-inverted signal SEa from the selection setting circuit 330 as the low-level, the inverted signal SEb functions as the high-level. As the clock signal SCa which changes signal level corresponding to the shift clock signal SFC is generated and outputted to the data driver 130Ca, the clock signal SCb which is not involved with the shift clock signal SFC but having the low-level by the NAND circuit 332 and the inverter 334 is generated and outputted to the data driver 130Cb.

Thereby, in the data driver 130Ca, by inputting the low-level non-inverted signal SEa, the reversal processing of the signal polarity is performed by the inverter 336 and the output control transistor Tr335 performs an "OFF" operation, which results in the current output contact OUTi of the gradation current generation section 201 and connection to the data lines DL (output contact Tout) being blocked out (shut down).

Also, in this operational period, by supplying the shift signal (high-level) generated to each of the gradation current generation supply circuits PXC based on the clock signal SCa with the signal level changing to the predetermined frequency based on the shift clock signal SFC, the current supply source control transistor Tr338 and the refresh control transistor provided in the gradation current generation section 201 repeat alternately "ON" and "OFF" operations corresponding to the output timing of the shift signals SR.

Therefore, in the data driver 130Ca, as the low-level non-inverted signal SEa (low-level selection setting signal SEL) is inputted to each of the gradation current generation supply circuits PXC1, PXC2, . . . by means of inputting sequentially the shift signals SR1, SR2, SR3, . . . from the shift register circuit 131C, the operation (data take-in operation) takes in sequentially and holds the display data d0~d3 while shifting corresponding to each column of the display pixels in the (i+1) line to the data latch section 101 of each of the gradation current generation supply circuits PXC1, PXC2, . . . and is executed consecutively for one line periods. In this manner, the predetermined voltage based on the reference current Iref is charged to the gate terminal of the reference current transistor provided in the gradation current generation section 201 via the current supply source control transistor Tr338 at predetermined cycles (refresh operation).

Meanwhile, in the data driver 130Cb, by inputting the high-level inverted signal SEb, the output control transistor Tr335 performs an "ON" operation and the current output contact OUTi and the data lines DL (output contact Tout) of the gradation current generation section 201 are connected.

Additionally, in this operational period, since the clock signal SCb having a constant low-level is regularly supplied to the shift register circuit 131C, the shift signals SR having the low-level will be supplied to each of the gradation current generation supply circuits PXC. Accordingly, the current supply source control transistor Tr338 and the refresh control transistor provided in the gradation current generation section 201 perform an "OFF" operation.

Consequently, in the data driver 130Cb, as the high-level non-inverted selection signal SEL is inputted to each of the gradation current generation supply circuits PXC1, PXC2, . . . by means of inputting regularly the shift signals SR1, SR2, SR3, . . . from the shift register circuit 131C, the inverted output signals d10*~d13* based on the display data d0~d3 in the (i-th) line taken in and held at previous timing (selection period of the i−1 line) to the data latch section 101 of each of the gradation current generation supply circuits PXC1, PXC2, . . . are transferred and taken in to the gradation current generation section 201. Accordingly, the module currents are integrated selectively based on these inverted output signals d10*~d13* and simultaneously (in parallel) supplied (data output operation) to the data lines DL1, DL2, . . . as the gradation currents Ipix from each of the gradation current generation supply circuits PXC1, PXC2, . . . . The supply operation (data output operation) of the gradation currents Ipix is continued until directly before the retrace line period in the appropriate selection period (i).

Subsequently, by inputting the high-level selection setting signal SEL of the selection period (i+1) line, a similar data output operation to the above-mentioned data driver 130Cb in the data driver 130Ca occurs in which the inverted output signals d10*~d13* based on the display data d0~d3 in the (i+1) line taken in and held in the data latch section 101 of each of the gradation current generation supply circuits PXC1, PXC2, . . . in the selection period (i) in the i-th line are transferred to the gradation current generation section 201. Accordingly, the gradation currents Ipix having current values corresponding to the display data d0~d3 are generated and simultaneously (in parallel) supplied to the data lines DL1, DL2, . . . from each of the gradation current generation supply circuits PXC1, PXC2, . . . .

In this operational period, in the data driver 130Cb and similar to the data take-in operation and refresh operation in the above-mentioned data driver 130Ca, as the display data d0~d3 in the (i+2) line is taken in consecutively and held for one line periods to the data latch section 101 in each of the gradation current generation supply circuits PXC1, PXC2, . . . based on the shift signals SR1, SR2, SR3, . . . outputted sequentially from the shift register circuit 131C, the reference current Iref is supplied to the gradation current generation section 201 and the refresh operation are executed.

In this manner, the two sets of the data driver 130Ca and 130Cb related to this embodiment, by switching appropriately and controlling the signal level of the selection setting signal SEL from the system controller for every predetermined cycle (selection period), the take-in and hold operation of the display data to the data latch section 101 and the refresh operation of the gradation current generation section 201 by one data driver and the operation which generates and outputs the gradation currents Ipix based on the output signal from the data latch section 101 by a second data driver can be set so that the operating state is repeatedly executed alternately.

For this reason, also in the display device and data driver related to this embodiment, the influence of signal delays originating in level variations of the signal supplied to the data driver (each of the gradation current generation supply circuits PXC1, PXC2, . . . ) in relation to generation of the gradation currents Ipix resembling the embodiment mentioned above is eliminated. Likewise any decline of the operating speed of the data drivers can be controlled, the current characteristic of the gradation currents can be equalized and further improvement in the display response characteristic in a display device along with the display image quality can be promoted.

In addition, the gradation current generation supply circuit comprises two sets of the data driver consisting of a single data latch section and a single current generation section provided to each of the data lines DL. In view of that, gradation currents having current values corresponding appropriately to the display data relative to each of the display pixels from two sets of the data driver can be supplied without interruption. This is accomplished by executing the data take-in operation of the display data and the refresh operation of the current generation section in one data driver and by executing the data output operation corresponding to the display data taken in at previous timing in the second data driver. Accordingly, the operating speed of the data driver can be raised substantially. Also, the light generation operation can be executed rapidly in the display pixels at the desired luminosity gradations, as well as the display response speed and display image quality of the display device can be elevated further.

Furthermore, the two sets of the data driver placed at the upper part and lower part of the display panel the circuit scale of each data driver can be further reduced as compared with the data driver of the above-mentioned first and second embodiments. Also, the frame portion installed in the outer edges of the display area of the display device can be narrowed as well as miniaturization of the display device or enlargement of the display area size can be acquired.

FOURTH EMBODIMENT OF THE DISPLAY DEVICE

Next, the fourth embodiment of the display device applicable to the current generation supply circuit related to the present invention will be explained.

(An Example Configuration of the Data Driver)

Figure 20:
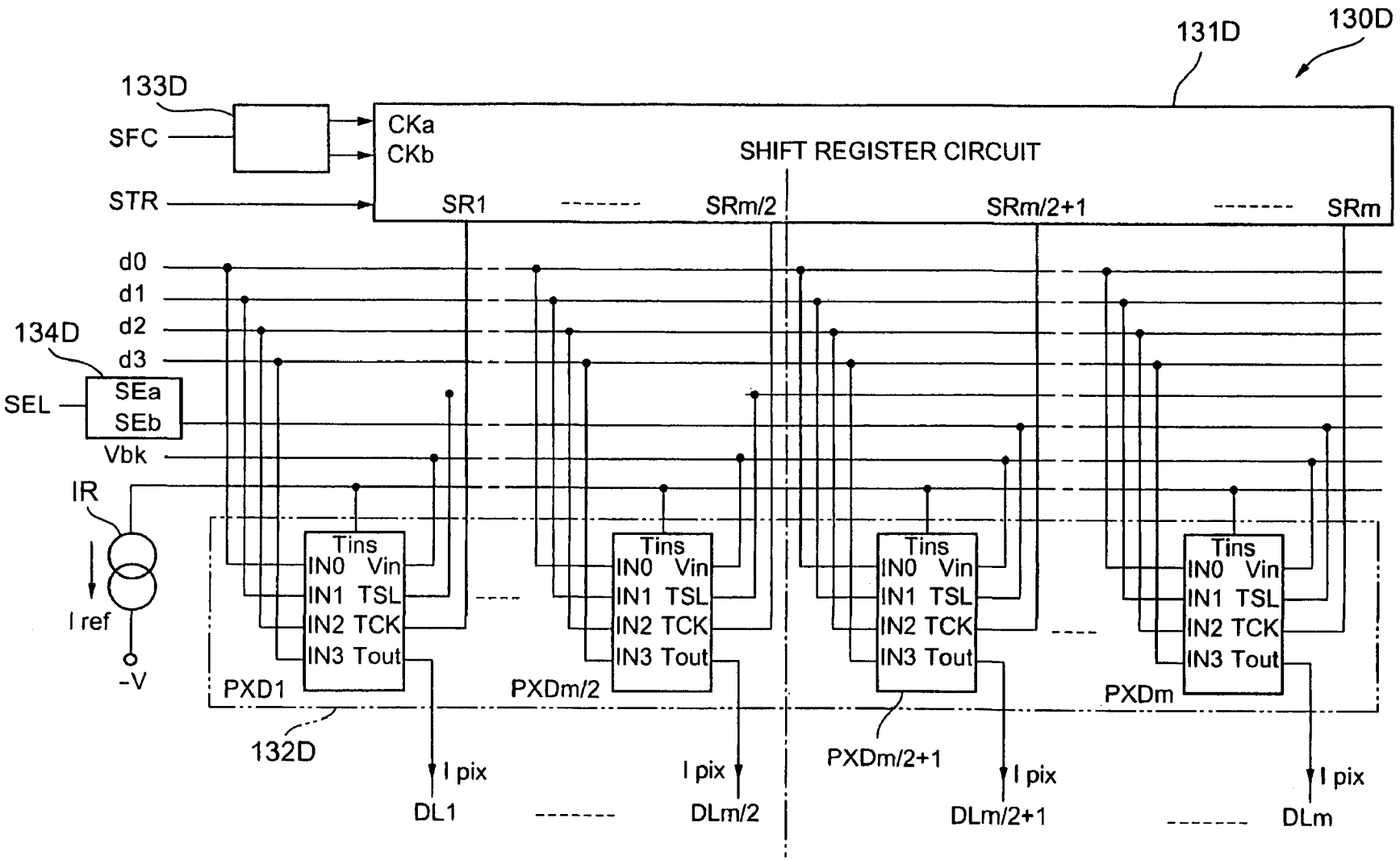
FIG. 20 is an outline configuration diagram showing an example of one arrangement of the data driver applicable to the fourth embodiment of the display device related to the present invention.

FIG. 20 is an outline configuration diagram showing an example of one arrangement of the data driver applicable to the fourth embodiment of the display device related to the present invention.

Here, concerning any configuration equivalent to the display device and the data drivers described in each of the embodiments mentioned above, the same or equivalent nomenclature is appended and the explanation is simplified or omitted from the description.

The display device related to this embodiment, in summary, while comprising the display panel 110A and the scanning driver 120A having the configuration equivalent to the display device 100A shown in FIG. 6, comprises the data driver 130D. The data driver 130D, as shown in FIG. 20, has a configuration comprising the data driver 130B (Refer to FIG. 13) described in the second embodiment above which has the equivalent configuration of the shift register circuit 131D, the gradation current generation supply circuit group 132D and the reversal latch circuit 133D. Furthermore, the data driver 130D has a configuration comprising the selection setting circuit 134D which generates the non-inverted signal SEa and the inverted signal SEb based on the selection setting signal SEL supplied from the system controller 140A.

Here, because the shift register circuit 131D and the reversal latch circuit 133D have equivalent configurations and features to the embodiment mentioned above, explanation is omitted from this portion of the description. Also, since each of the gradation current generation supply circuits PXD1, PXD2, . . . which constitute the gradation current generation supply circuit group 132D have the equivalent circuit configuration (Refer to FIG. 18) as mentioned above in the third embodiment, explanation is omitted here.

In this embodiment, the non-inverted signal SEa of the selection setting signal SEL generated by the selection setting circuit 134D, for example, is configured to be inputted to the selection control terminal TSL of the gradation current generation supply circuits PXD1, PXD2, . . . PXDm/2 provided corresponding to the data lines DL1, DL2, . . . DLm/2 arranged in the left half area of the display panel. Also, the inverted signal SEb of the selection setting signal SEL, for example, is configured to be inputted to the selection control terminal TSL of the gradation current generation supply circuits PXDm/2+1, PXDm/2+2, . . . PXDm provided corresponding to the data lines DLm/2+1, DLm/2+2, . . . DLm arranged in the right half area of the display panel.

Specifically, the gradation current generation supply circuit group 132D provided in the data driver 130D each other comprises a pair of gradation current generation circuits formed corresponding to the left half and the right half areas of the display panel. Furthermore, the operating state executes the data take-in operation and the refresh operation in two sets of the gradation current generation circuits based on the selection setting signal SEL (non-inverted signal SEa and inverted signal SEb), as well as the operating state executes the data output operation set simultaneously to an operating state which is different from each other and is set so that these operating states are repeatedly executed alternately.

(The Drive Control Method of the Display Device)

Next, the display device of this embodiment and the drive control method of the data driver will be explained with reference to the drawings.

Figure 21:
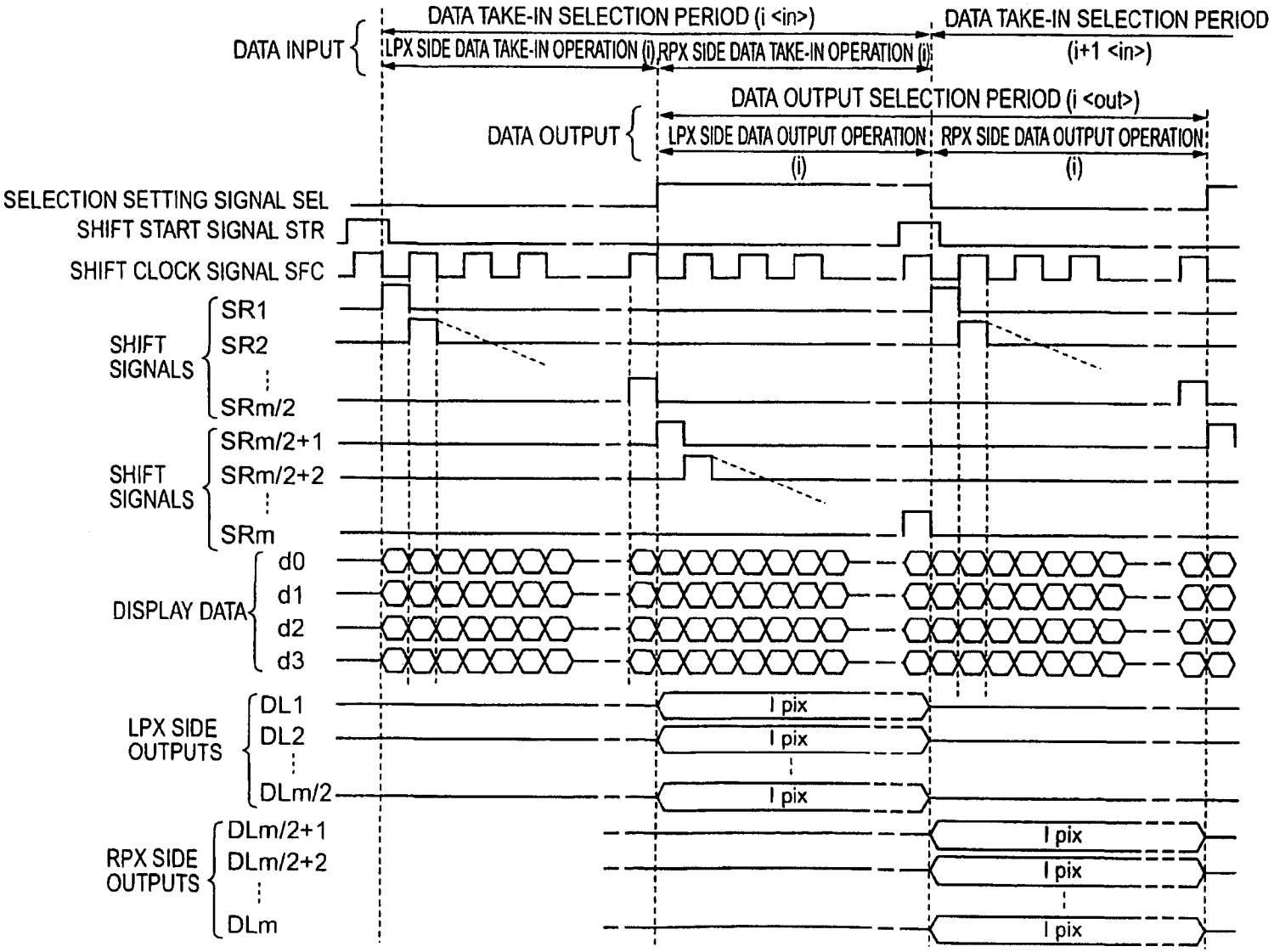
FIG. 21 is a timing chart showing an example of the control operations in the data driver related to the embodiments.

FIG. 21 is a timing chart showing an example of the control operations in the data driver related to the embodiments.

The control operations in the data driver 130D which has such a configuration as mentioned above, in summary, are set among the gradation current generation supply circuit group 132D provided in the data driver 130D. The data take-in period (data take-in selection period) takes in and holds the display data d0~d3 sequentially to each of the gradation current generation supply circuits PXD of each set (the left area side and the right area side) provided corresponding to each area of the left and right halves. The data output period (data output selection period) generates the gradation currents Ipix corresponding to the display data d0~d3 taken in as mentioned above and supplies each of the display pixels via each of the data lines DL1, DL2, . . . . Among the gradation current generation supply circuit group 132D, while executing the above-mentioned data take-in operation by the gradation current generation supply circuits PXD of one set, the display device controls to execute the above-mentioned data output operation by the gradation current generation supply circuits PXD of the second set.

Initially, referring to the data take-in period as shown in FIG. 21, by inputting the low-level selection setting signal SEL in the first half ($1^{st}$ ½) of the data take-in selection period (i <in>) in the i-th line, the low-level non-inverted signal SEa and the high-level inverted signal SEb are generated by the selection setting circuit 134D. As the non-inverted signal SEa is inputted to the gradation current generation supply circuits PXD1, PXD2, . . . PXDm/2 (hereinafter denoted as the "left area current generation circuit group LPX") provided corresponding to the data lines DL1~DLm/2 arranged in the left half area of the display panel among the gradation current generation supply circuit group 132D, the inverted signal SEb is inputted to the gradation current generation supply circuits PXDm/2+1, PXDm/2+2, . . . PXDm (hereinafter denoted as the "right area current generation circuit group RPX") provided corresponding to the data lines DLm/2+1~DLm arranged in the right half area of the display panel among the gradation current generation supply circuit group 132D.

Accordingly, as the output control transistor Tr335 (Refer to FIG. 18) provided in the left area of the current generation circuit group LPX performs an "OFF" operation based on the shift signals SR outputted sequentially from the shift register circuit 131D, the take-in and hold operation of the display data d0~d3 in the i-th line to the data latch section and the refresh operation of the current generation section are executed. At this stage in the right area of the current generation circuit group RPX, as the output control transistor performs an "ON" operation based on the display data d0~d3 in the (i−1 <in>) line taken in and held at previous timing (data take-in selection period (i−1 <in>)), the gradation currents Ipix having predetermined current values are generated by the current generation section and supplied simultaneously (in parallel) to each of the display pixels via each of the data lines DLm/2+1~DLm arranged in the right half area of the display panel.

Subsequently, by inputting the high-level selection setting signal SEL in the second half ($2^{nd}$½) of the data take-in selection period (i <in>) in the i-th line, as the high-level non-inverted signal SEa is inputted to the left area of the current generation circuit group LPX, the low-level inverted signal SEb is inputted to the right area of the current generation circuit group RPX.

Accordingly, as the output control transistor provided in the right area of the current generation circuit group RPX performs an "OFF" operation based on the shift signals SR outputted sequentially from the shift register circuit 131D, the take-in and hold operation of the display data d0~d3 in the i-th line to the data latch section and the refresh operation of the current generation section are executed.

At this stage simultaneously in the left area of the current generation circuit group LPX, as the output control transistor performs an "ON" operation based on the display data d0~d3 in the i-th line taken in and held to the data latch section in the first half of the data take-in selection period (i <in>) in the i-th line described above, the gradation currents Ipix having predetermined current values are generated by the current generation section and supplied simultaneously (in parallel) to each of the data lines DL1~DLm/2 arranged in the left half area of the display panel. Thus, as shown in FIG. 21, the period of the second half data take-in selection period (i <in>) in the i-th line is set in parallel simultaneously in order to overlap in terms of time as the first half data output selection period (i <out>) in the i-th line.

Subsequently, in the second half of the data output selection period (i <out>) in the i-th line by once again inputting the low-level selection setting signal SEL, as the output control transistor provided in the right area current generation circuit group RPX performs an "ON" operation based on the display data d0~d3 in the i-th line taken in and held in the data latch section in the second half of the data take-in selection (i <in>) in the i-th line described above, the gradation currents Ipix having predetermined current values are generated by the current generation section and supplied simultaneously (in parallel) to each of the data lines DLm/2+1~DLm arranged in the right half area of the display panel.

At this stage simultaneously, in the left area as the output control transistor of the current generation circuit group LPX, as the output control transistor performs an "OFF" operation based on the shift signals SR outputted sequentially from the shift register circuit 131D, the take-in and hold operation of the display data d0~d3 in the (i+1) line to the data latch section and the refresh operation of the current generation section are executed. Thus, as shown in FIG. 21, the period of the second half of the data output selection period (i <out>) in the i-th line is set in parallel simultaneously in order to overlap in terms of time as the first half of the data take-in selection period (i+1<in>) in the i-th line.

Accordingly, in the data driver 130D related to this embodiment by switching appropriately and controlling the signal level of the selection setting signal SEL supplied from the system controller for every predetermined cycle (selection period of the first and second halves), as the take-in and hold operation of the display data to the data latch section of the left area of the current generation circuit group LPX (or right area of the current generation circuit group RPX) and the refresh operation of the current generation section; as well as the output operation for generation of the gradation currents Ipix by the right area current generation circuit group RPX (or left area of the current generation circuit group LPX) can be executed in parallel simultaneously and set so that these operating states are repeatedly executed alternately.

Therefore, also in the display device and data driver related to this embodiment, the influence of signal delays originating in level variations of the signal supplied to the data driver (each gradation current generation supply circuit PXD1 and PXD2) in relation to generation of the gradation currents Ipix resembling the embodiment mentioned above is eliminated. Likewise any decline of the operating speed of the data drivers can be controlled, the current characteristic of the gradation currents can be equalized and further improvement in the display response characteristic in a display device along with the display image quality can be advanced.

Additionally, the gradation current generation supply circuit comprises two sets of data drivers consisting of a single latch section and a single current generation section provided to each of the data lines DL. In view of that, gradation currents having current values corresponding appropriately to the display data relative to each of the display pixels from a pair of data drivers can be supplied without interruption. This is accomplished by executing the data take-in operation of the display data and the refresh operation of the current generation circuit group corresponding to either the left or right areas of the display panel and by executing the data output operation corresponding to the display data taken in at the previous timing in the gradation current generation circuit group corresponding to the remaining other side. Since gradation currents having current values corresponding appropriately to each of the display pixels with a pair of data drivers can be supplied continually, the operating speed can be increased considerably. Also, the light generation operation can be executed rapidly in the display pixels at the desired luminosity gradations, as well as the display response speed and display image quality of the display device can be elevated further.

Furthermore, the circuit scale of the data drivers can be made of the same standard of the above-mentioned second embodiment, the frame portion of the display device can be narrowed, and miniaturization of the display device or enlargement of the display area size can be attained.

<Fifth Embodiment of the Display Device>

Next, the fifth embodiment of the display device applicable to the current generation supply circuit related to the present invention will be explained.

(An Example Configuration of the Data Driver)

Figure 22:
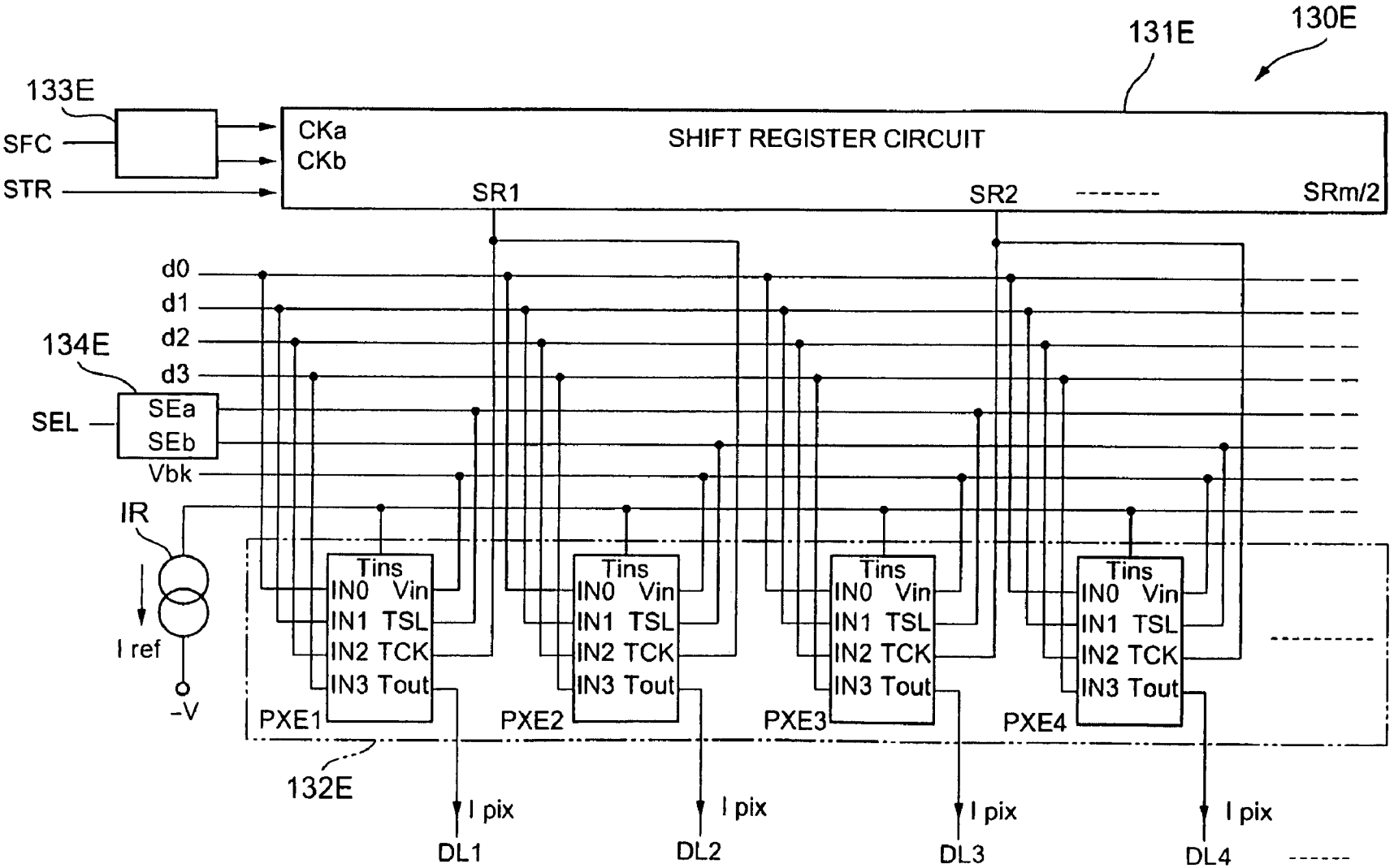
FIG. 22 is an outline configuration diagram showing an example of one arrangement of the data driver applicable to the fifth embodiment of the display device related to the present invention.

FIG. 22 is an outline configuration diagram showing an example of one arrangement of the data driver applicable to the fifth embodiment of the display device related to the present invention.

Figure 23:
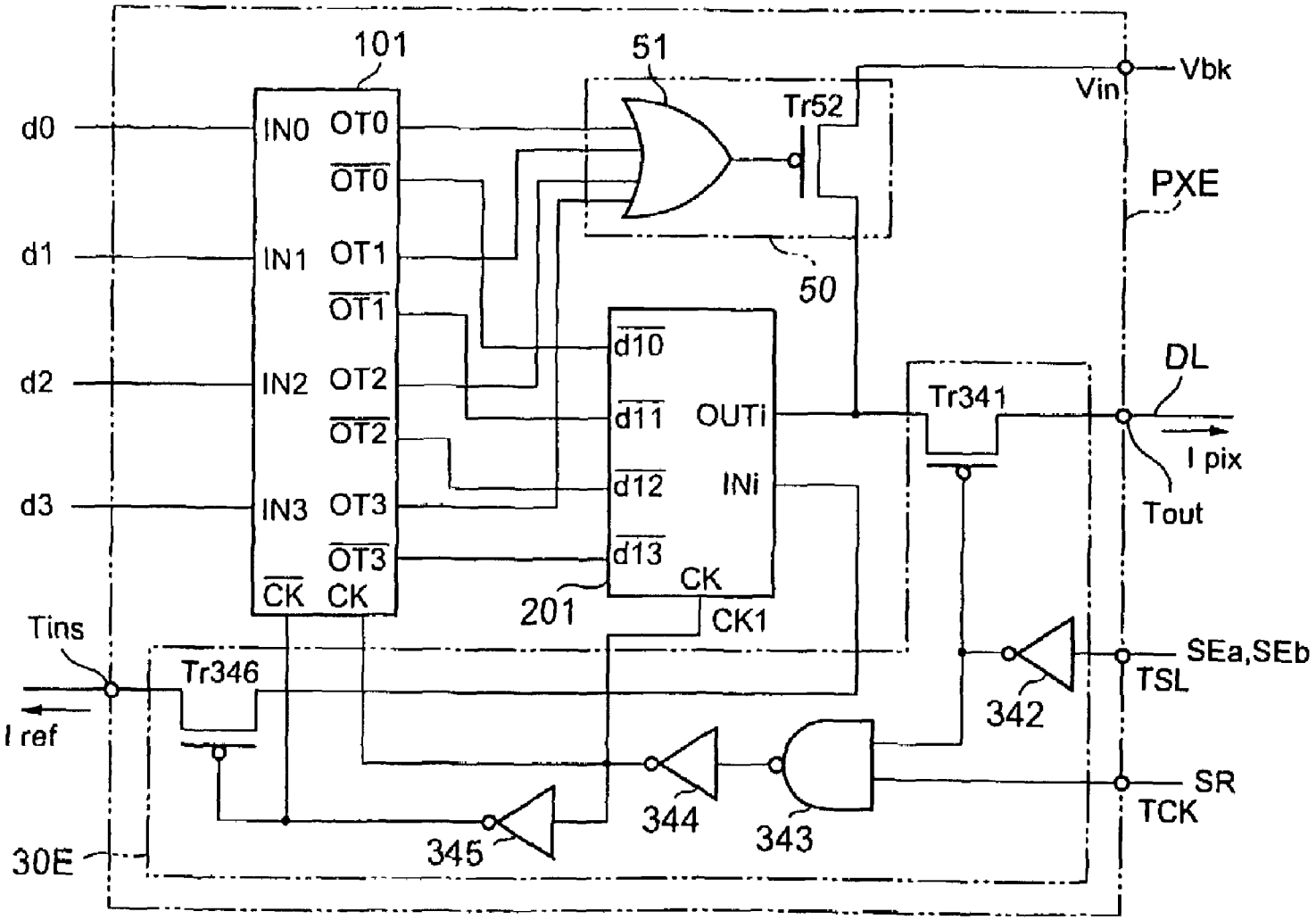
FIG. 23 is an outline configuration diagram showing one illustrative example of the gradation current generation circuit applicable to the data driver related to the embodiments.

FIG. 23 is an outline configuration diagram showing one illustrative example of the gradation current generation circuit applicable to the data driver related to the embodiments.

Here, concerning any configuration equivalent to the display device and the data driver described in each embodiment above, the same or equivalent nomenclature is appended and the explanation is simplified or omitted from the description.

The display device related to this embodiment, in summary, while comprising the display panel 110A and the scanning driver 120A having the configuration equivalent to the display device 100A shown in FIG. 6, comprises the data driver 130E. The data driver 130E, as shown in FIG. 22, has a configuration comprising the data driver 130D (Refer to FIG. 20) described in the fourth embodiment above which has the equivalent configuration of shift register circuit 131E, the gradation current generation supply circuit group 132E, the reversal latch circuit 133E and the selection setting circuit 134E. Here, because the reversal latch circuit 133E and the selection setting circuit 134E have equivalent configurations and features to the embodiment mentioned above, explanation is omitted from this portion of the description.

Referring to FIG. 23, each of the gradation current generation supply circuits PXE1, PXE2, . . . (hereinafter denoted as the "gradation current generation supply circuits PXE") constitute the gradation current generation supply circuit group 132E and each configuration employs the current generation supply circuit ILA shown in FIG. 1 as the base element which has a configuration comprising the single latch section 101

(signal holding circuit), the single current generation section 201 (current generation circuit), the operation setting section 30E (operational state setting circuit) and the specified state setting section 50. The single current generation section 201 (current generation circuit) is connected to the inverted output contact point OT0*~OT3 of the data latch section 101. The operation setting section 30E (operational state setting circuit) sets up the selection state and the operating state of each of the gradation current generation supply circuits PXE1, PXE2, . . . based on the non-inverted signal SEa or the inverted signal SEb from the selection setting circuit 134E mentioned above. The specified state setting section 50 applies the specified voltage Vbk to the data lines DL1, DL2, . . . when connecting with the non-inverted output contacts OT0~OT3 of the data latch section 101 and operating the display pixels in a specified drive state (black display operation, etc.). Here, since the data latch section 101, the gradation current generation section 201 and the specified state setting section 50 have equivalent configurations and features to the embodiments mentioned above, explanation is omitted from this portion of the description. Also, as the operation setting section 30E has an equivalent configuration to the current generation supply circuit ILA shown in FIG. 1, further explanation is omitted.

Additionally, in the data driver 130E applicable to this embodiment, the gradation current generation supply circuits PXE1 and PXE2 are constituted in order that the shift signal SR1 outputted from the shift register circuit 131E is supplied to the gradation current generation supply circuits PXE1 and PXE2 set corresponding to the data lines DL1 and DL2, the shift signal SR2 is supplied to the gradation current generation supply circuits PXE3 and PXE4 set corresponding to the data lines DL3 and DL4, and each shift signal SR is supplied in common to the gradation current generation supply circuits PXE set corresponding to 2 columns (odd numbered and even numbered) of the data lines DL in succession. Therefore, the data driver 130E related to this embodiment is constituted in order that the number of shift signals may be reduced by half as compared with the data driver described in each embodiment above becoming SR1~SRm/2.

Furthermore, the non-inverted signal SEa of the selection setting signal SEL generated by the selection setting circuit 134E, for example, is inputted into the selection control terminal TSL of the gradation current generation supply circuits PXE1, PXE3, . . . , PXEm-1 provided corresponding to the odd numbered data lines DL1, DL3. DLm-1 of the display panel. Also, the inverted signal SEb of the selection setting signal SEL, for example, is inputted into the selection control terminal TSL of the gradation current generation supply circuits PXE2, PXE4, . . . , PXEm provided corresponding to the even numbered data lines DL2, DL4. DLm of the display panel.

(The Drive Control Method of the Display Device)

Next, the display device of this embodiment and the drive control method of the data driver will be explained with reference to the drawings.

Figure 24:
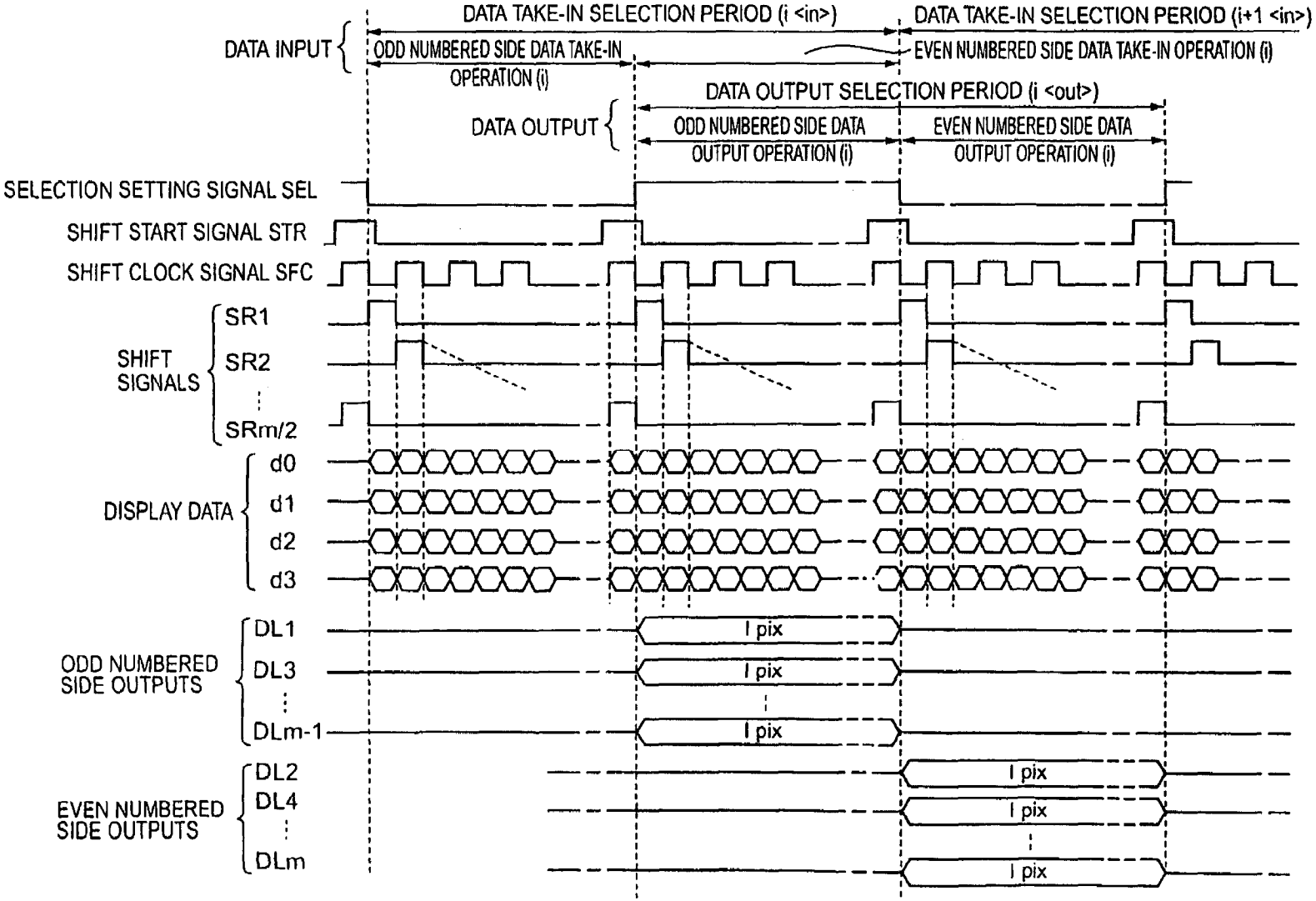
FIG. 24 is a timing chart showing an example of the control operations in the data driver related to the embodiments.

FIG. 24 is a timing chart showing an example of the control operations in the data driver related to the embodiments.

The control operations in the data driver 130E which has such a configuration described above, in summary, are set among the gradation current generation supply circuit group 132E provided in the data driver 130E. The data take-in period (data take-in selection period) takes in and holds the display data d0~d3 sequentially to each of the gradation current generation supply circuits PXE of each set (odd numbered side and even numbered side) provided corresponding to the odd numbered or even numbered data lines allocated in the display panel. The data output period (data output selection period) generates the gradation currents Ipix corresponding to the display data d0~d3 taken in as mentioned above and supplies each of the display pixels via each of the data lines DL1, DL2, . . . Among the gradation current generation supply circuit group 132E, while executing the above-mentioned data take-in operation by the gradation current generation supply circuits PXE of one set, the display device controls to execute the above-mentioned data output operation by the gradation current generation supply circuit PXE of the second set.

Initially, referring to the data take-in period as shown in FIG. 24, by inputting the low-level selection setting signal in the first half ($1^{st}$ ½) of the data take-in selection period (i <in>) in the i-th line, the low-level non-inverted signal SEa and the high-level inverted signal SEb are generated by the selection setting circuit 134E. As the non-inverted signal SEa is inputted to the gradation current generation supply circuits PXE1, PXE3, . . . (hereinafter denoted as the "current generation circuit group OPX") provided corresponding to the odd numbered data lines DL1, DL3, . . . of the display panel among the gradation current generation supply circuit group 132E, the inverted signal SEb is inputted to the gradation current generation supply circuits PXE2, PXE4, . . . (hereinafter denoted as the "current generation circuit group EPX") provided corresponding to the odd numbered data lines DL2, DL4, . . . of the display panel among the gradation current generation supply circuit group 132E.

Accordingly, as the output control transistor Tr341 (Refer to FIG. 23 provided in the odd lines current generation circuit group OPX performs an "OFF" operation based on the shift signals SR outputted sequentially from the shift register circuit 131E, the take-in and hold operation of the display data d0~d3 in the i-th line to the data latch section and the refresh operation of the current generation section are executed. At this stage, group distribution of the display data d0~d3 previously supplied to the data driver 130E (gradation current generation supply circuit group 132E) from the display signal generation circuit (Refer to FIG. 6) is executed to split independently into a digital signal group which specifies the luminosity gradations of the display pixels connected to the odd lines and a digital signal group which specifies the luminosity gradations of the display pixels connected to the even lines. Thus, in the first half of the data take-in selection period (i <in>) in the i-th line, the digital signals of the group corresponding to the odd lines are sequentially supplied to the data latch section of each of the gradation current generation supply circuits PXE1, PXE3, . . . which constitute the odd lines current generation circuit group OPX.

Additionally, at this stage in the even lines current generation circuit group EPX, as the output control transistor performs an "ON" operation based on the display data d0~d3 in the (i−1) line taken in and held at previous timing (data take-in selection period (i−1 <in>)), the gradation currents Ipix having predetermined current values are generated by the current generation section and supplied simultaneously (in parallel) to each of the display pixels via the even numbered data lines DL2, DL4. DLm of the display panel.

Subsequently, in the second half ($2^{nd}$ ½) of the data take-in selection period (i <in>) in the i-th line, as the high-level non-inverted signal SEa is inputted to the odd lines current generation circuit group OPX, the low-level inverted signal SEb is inputted to the even lines current generation circuit group EPX.

Accordingly, as the output control transistor provided in the even lines current generation circuit group EPX performs an "OFF" operation based on the shift signals SR outputted sequentially from the shift register circuit 131E, the take-in and hold operation of the display data d0~d3 in the i-th line to the data latch section and the refresh operation of the current generation section are executed. Here, in the second half of data take-in selection period (i <in>) in the i-th line the display data d0~d3 supplied to the data driver 130E (gradation current generation supply circuit group 132E) among the digital signal groups by which group distribution corresponding to the odd lines and the even lines is accomplished in advance as mentioned above, the digital signals of the group corresponding to the even lines are sequentially supplied to the data latch section of each the gradation current generation supply circuits PXE2, PXE4, . . . which constitute the even lines current generation circuit group EPX.

Also, at this stage simultaneously in the odd lines current generation circuit group OPX, as the output control transistor performs an "ON" operation based on the display data d0~d3 in the i-th line taken in and held to the data latch section in the first half of the data take-in selection period (i <in>) in the i-th line described above, the gradation currents Ipix having predetermined current values are generated by the current generation section and supplied simultaneously (in parallel) to each of the display pixels via the odd numbered data lines DL1, DL3, . . . DLm-1 of the display panel. Accordingly, as shown in FIG. 24, the period of the second half of the data take-in selection period (i <in>) in the i-th line is set simultaneous and in parallel in order to overlap in terms of time as the first half ($1^{st}$ ½) of the data output selection period (i <out>) in the i-th line.

Subsequently in the second half ($2^{nd}$ ½) of the data output selection period (i <out>) in the i-th line by once again inputting the low-level selection setting signal SEL, as the output control transistor provided in the even lines current generation circuit group EPX performs an "ON" operation based on the display data d0~d3 in the i-th line taken in and held in the data latch section in the second half of the data take-in selection (i <in>) in the i-th line described above, the gradation currents Ipix having predetermined current values are generated by the current generation section and supplied simultaneously (in parallel) to each of the display pixels via the even numbered data lines DL2, DL4. DLm of the display panel.

At this stage simultaneously, as the output control transistor provided in the odd lines current generation circuit group OPX performs an "OFF" operation based on the shift signals SR outputted sequentially from the shift register circuit 131E, the take-in and hold operation of the display data d0~d3 in the (i+1) line to the data latch section and the refresh operation of the current generation section are executed. Thus, as shown in FIG. 24, the period of the second half of the data output selection period (i <out>) in the i-th line is set simultaneous and in parallel in order to overlap in terms of time as the first half ($1^{st}$ ½) of the data take-in selection period (i <in>) in the i-th line.

Accordingly, in the data driver 130E related to this embodiment by switching appropriately and controlling the signal level of the selection setting signal SEL supplied from the system controller for every predetermined cycle (for each ½ of the selection period), as the take-in and hold operation of the display data to the odd lines current generation circuit group OPX (or the even lines current generation circuit group EPX) and the refresh operation of the current generation section; as well as the output operation for generation of the gradation currents Ipix by the even lines current generation circuit group EPX (or the odd lines current generation circuit group OPX) can be executed in parallel simultaneously and set so that these operating states are repeatedly executed alternately.

Therefore, also in the display device and data driver related to this embodiment, the influence of signal delays originating in level variations of the signal supplied to the data driver (each gradation current generation supply circuit PXE1 and PXE2) in relation to generation of the gradation currents Ipix resembling the embodiment mentioned above is eliminated. Likewise any decline of the operating speed of the data drivers can be controlled, the current characteristic of the gradation currents can be equalized and further improvement in the display response characteristic in a display device along with the display image quality can be advanced.

Additionally, the gradation current generation supply circuit comprises two sets of data drivers consisting of a single latch section and a single current generation section provided to each of the data lines DL. As stated above, the control operations are performed by executing the data take-in operation of the display data and the refresh operation of the current generation circuit group corresponding to the data lines of either odd numbered or even numbered in the display panel and by executing the data output operation corresponding to the display data taken in at the previous timing in the gradation current generation circuit group corresponding to the other oppositely numbered side. Thus, in this drive control method, as gradation currents having current values corresponding appropriately to each of the display pixels can be supplied continually with a pair of data drivers, the operating speed can be increased considerably. Also, the light generation operation can be executed rapidly in the display pixels at the desired luminosity gradations, as well as the display response speed and display image quality of the display device can be elevated further.

Moreover, the circuit scale of each data driver can be further reduced as compared with the above-mentioned fourth embodiment, as well as miniaturization of the display device or enlargement of the display area size can be acquired.

<Sixth Embodiment of the Display Device>

Next, the sixth embodiment of the display device applicable to the current generation supply circuit related to the present invention will be explained briefly.

Figure 25:
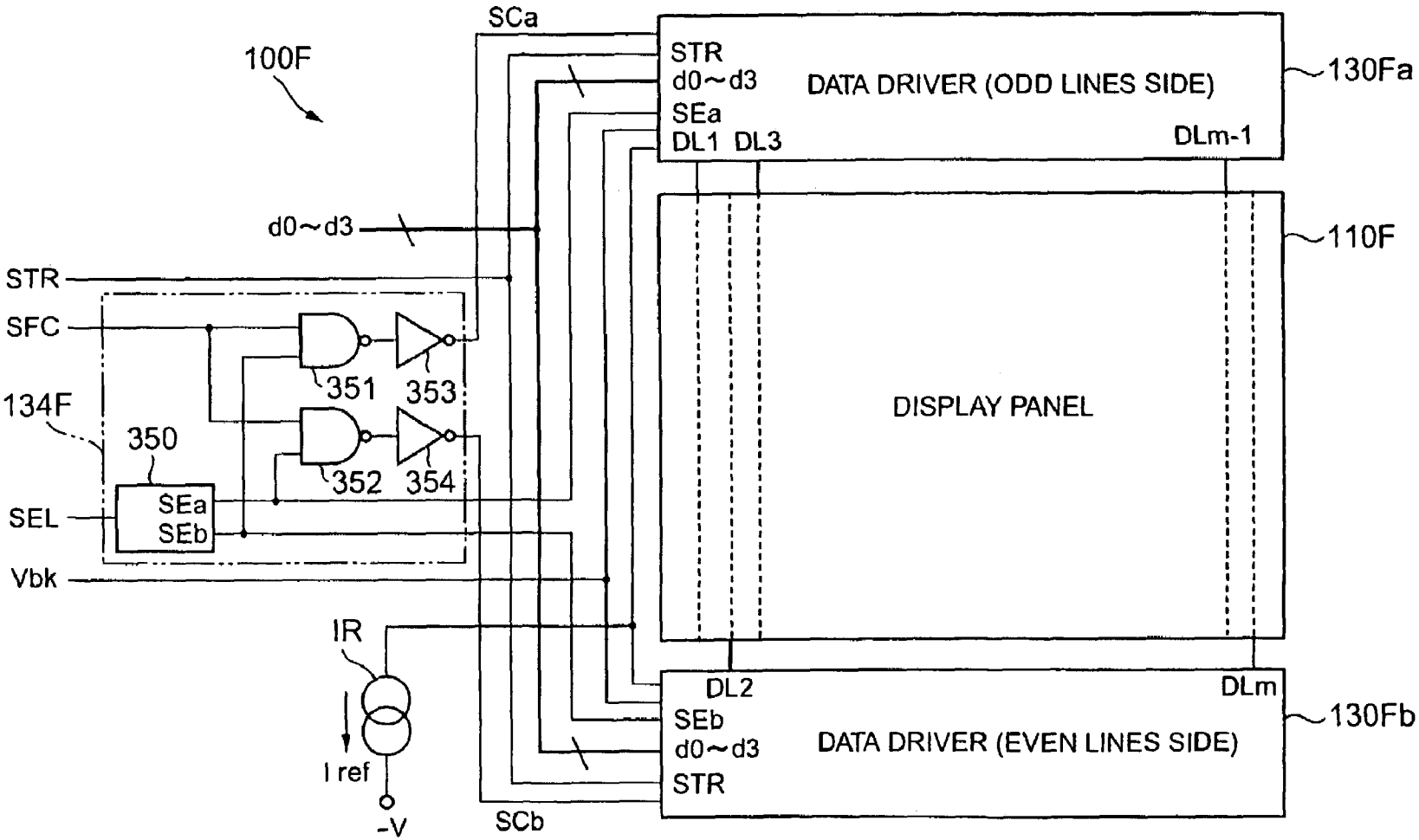
FIG. 25 is an outline block diagram showing the sixth embodiment of the display device applicable to the current generation supply circuit related to the present invention.

FIG. 25 is an outline block diagram showing the sixth embodiment of the display device applicable to the current generation supply circuit related to the present invention.

Here, concerning any configuration equivalent to the display device described in each embodiment mentioned above, the same or equivalent nomenclature is appended and the explanation is simplified or omitted from the description.

Referring to FIG. 25, the display device 100F related to this embodiment, in summary, has the basic configuration as the display device 100A shown in FIG. 6 and has a configuration comprising the driver circuit 130Fa and 130Fb (signal driver circuits) and a common control unit 134F (operational state setting circuit). The data driver 130Fa is connected to the odd data lines (odd numbered lines) DL1, DL3, . . . DLm-1 among the data lines DL1, . . . DLm (signal lines) connected in common for every display pixel cluster arranged in the column direction of the display panel 110F, for example, positioned above the display panel 110F. The data driver 130Fb is connected to the even data lines (even numbered lines) DL2, DL4, . . . DLm, for example, positioned below the display panel 110F. The common control unit 134F switches and controls the operating state of the data driver 130Fa and 130Fb based on the data control signals (the shift clock signal SFC, the selection setting signal SEL, etc.) supplied from the system controller 140A and resembles the third embodiment (Refer to FIG. 16) mentioned above.

Here, as the common control unit 134F has the equivalent configuration and features to the third embodiment described above, explanation is omitted from this portion of the description.

(An Example Configuration of the Data Driver)

Figure 26:
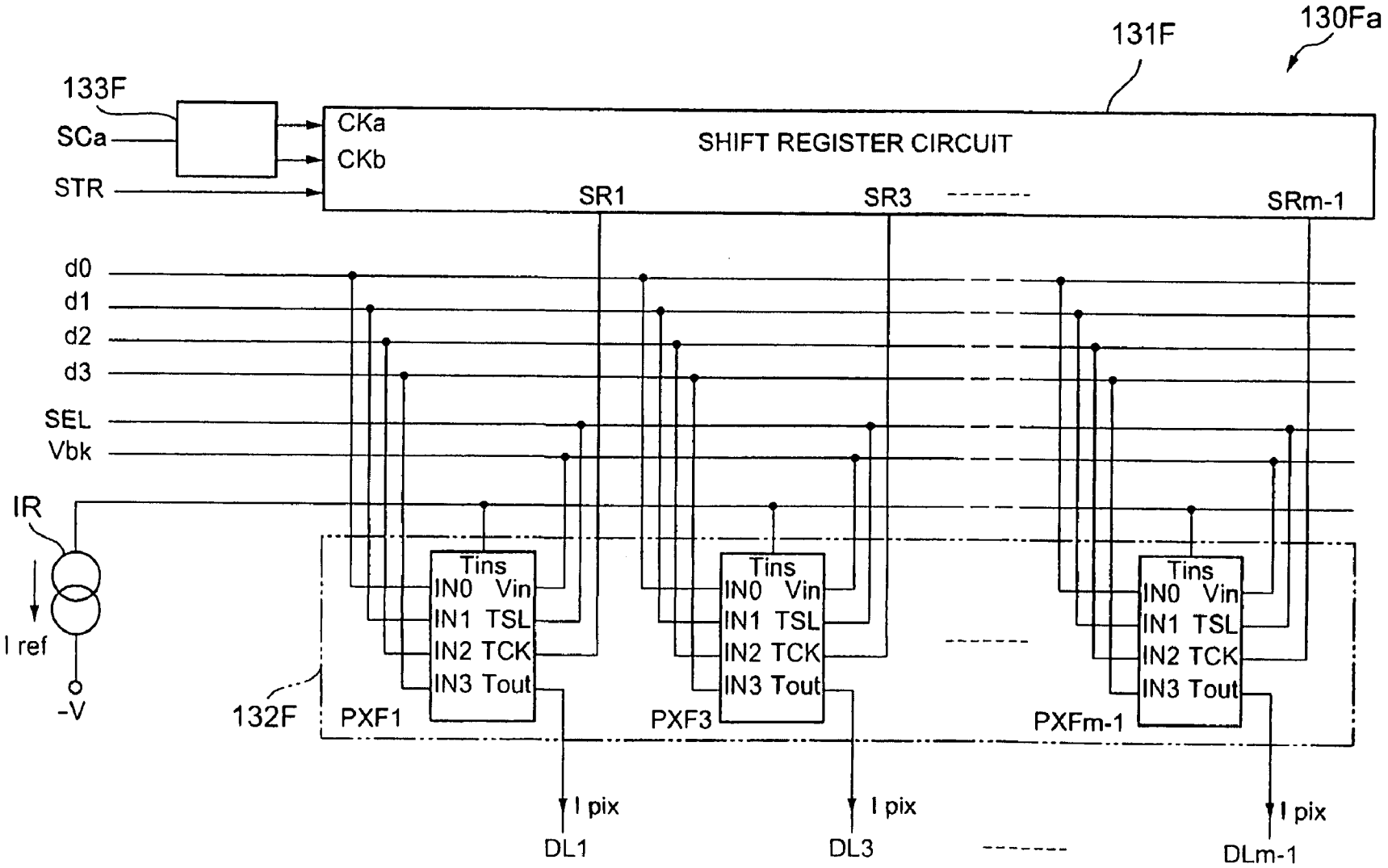
FIG. 26 is an outline configuration diagram showing an example of one arrangement of the data driver applicable to the display device related to the embodiments.

FIG. 26 is an outline configuration diagram showing an example of one arrangement of the data driver applicable to the display device related to the embodiments.

Here, since the data driver 130Fa and 130Fb have equivalent configurations, only the configuration of the data driver 130Fa is shown in the diagram. Also, concerning any configuration equivalent to the data driver described in each of the embodiments mentioned above, the same or equivalent nomenclature is appended and the explanation is simplified or omitted from the description.

The data driver 130Fa (or 130Fb) as shown in FIG. 26, in summary, has a configuration comprising the shift register circuit 131F which has the data driver 130Ca and 130Cb (Refer to FIG. 17) shown in the third embodiment above, the gradation current generation supply circuit group 132F and the reversal latch circuit 133F. Here since the configuration and features are equivalent to the third embodiment (Refer to FIG. 18) mentioned above and the reversal latch circuit 133F has an equivalent configuration and features to each embodiment described above, the gradation current generation supply group 132F is omitted from this portion of the description.

Additionally, in the data driver 130Fa applicable to this embodiment, as shown in FIG. 25 and FIG. 26, the shift signals SR1, SR3, . . . SRm-1 outputted sequentially from the shift register circuit 131F are supplied to the gradation current generation supply circuits PXF1, PXF3, . . . PXFm-1 provided to each other of the odd data lines DL1, DL3, . . . DLm-1. Also, in the data driver 130Fb, the shift signals SR (SR2, SR4, . . . SRm) outputted sequentially from the shift register circuit 131F provided in the data driver 130Fb are supplied to the gradation current generation supply circuits PXF (PXF2, PXF4, . . . PXFM) provided to each other of the even data lines DL2, DL4, . . . DLm. Therefore, in the data driver 130Fa and 130Fb related to this embodiment are constituted so that ½ of the shift signals of the total number of m data lines are outputted from the shift register circuits.

Specifically, the display device related to this embodiment provided with the data driver 130E (Refer to FIG. 22) described in the fifth embodiment mentioned above, has two sets of the data driver 130Fa and 130Fb comprised individually from each other with the gradation current generation circuit group provided for the odd lines side of the display panel and the gradation current circuit group provided for the even lines side of the display panel and has a configuration in which the data driver 130Fa and 130Fb are arranged separately in the upper part and the lower part of the display panel.

Additionally, the result of the logical operation process (logical operation by the NAND 351 and the inverter 353) of the shift clock signal SFC as the clock signal SCa and the inverted signal SEb of the selection setting signal SEL generated by the selection setting circuit 350 provided in the common control unit 134F are inputted to the reversal latch circuit 133F and the shift register circuit 131F established in the data driver 130Fa. Also, the result of the logical operation process (logical operation by the NAND circuit 352 and the inverter 354) of the shift clock signal SFC as the clock signal SCb and the non-inverted signal SEa of the selection setting signal SEL are constituted in order to be inputted to the shift register circuit and reversal latch circuit established in the data driver 130Fb.

(The Control Operations of the Display Device)

Next, the display device of this embodiment and the drive control method of the data driver will be explained with reference to the drawings.

Figure 27:
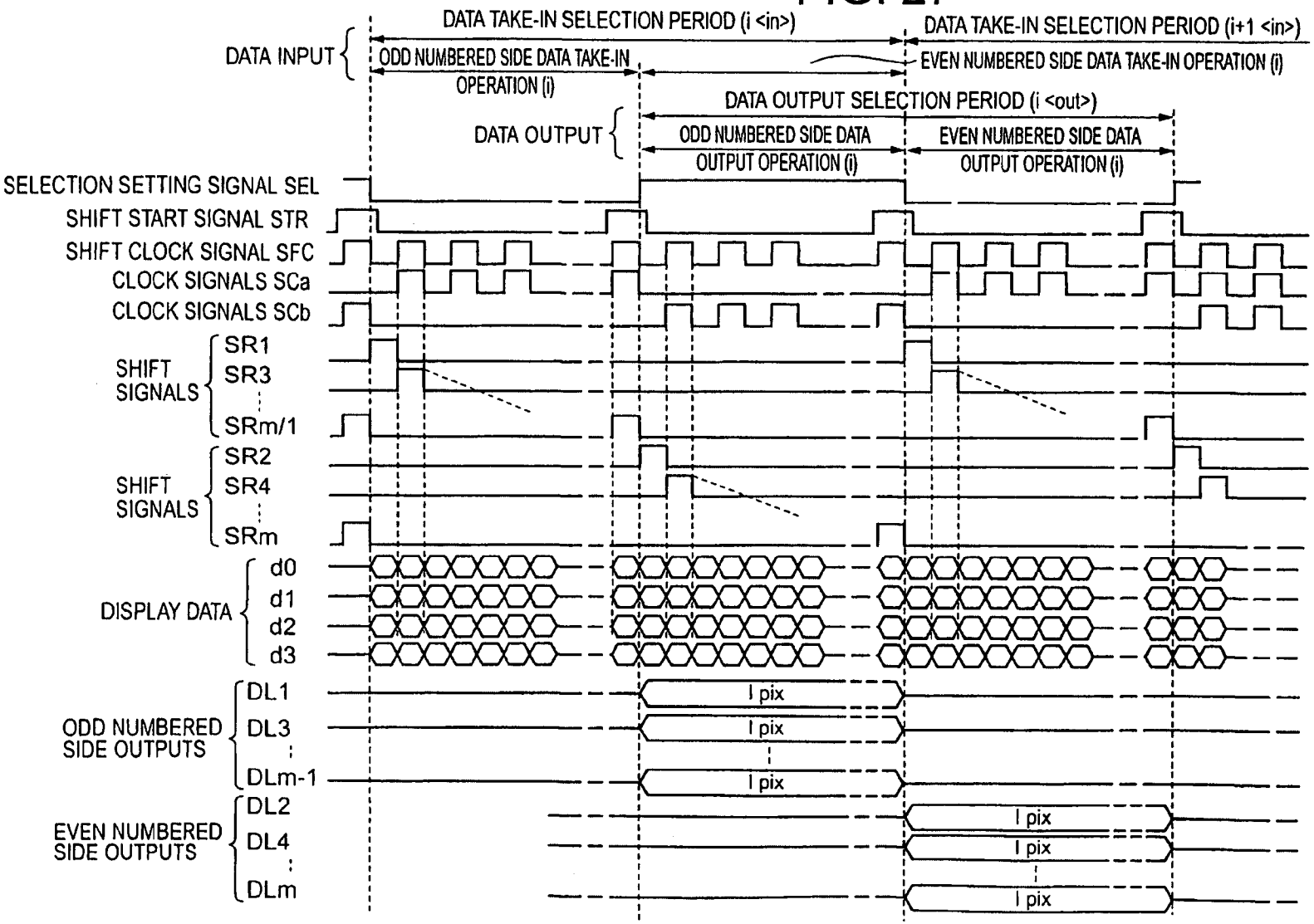
FIG. 27 is a timing chart showing an example of the control operations in the data driver related to the embodiments.

FIG. 27 is a timing chart showing an example of the control operations in the data driver related to the embodiments.

The control operations in the data driver 130F which has such a configuration, in summary, are set with the data driver 130Fa provided corresponding to odd lines side or with the data driver 130Fb provided corresponding to the even lines side arranged in the display panel. The data take-in period (data take-in selection period) takes in and hold the display data d0~d3 sequentially and generates the gradation currents Ipix corresponding to the display data d0~d3 taken in and held as stated above. The data output period (data output selection period) supplies each of the display pixels via the odd lines side or the even lines side at timing different from each other. While executing the above-mentioned data take-in operation with one of the data drivers among the data driver 130Fa and 130Fb, the display device controls to execute the above-mentioned data output operation with the second data driver.

Initially, referring to the data take-in period as shown in FIG. 27, by inputting the low-level selection setting signal SEL in the first half ($1^{st}$ ½) of the data take-in selection period (i <in>) in the i-th line, as the low-level non-inverted signal SEa is inputted to the data driver 130Fa from the common control unit 134F (selection setting circuit 350), the high-level inverted signal SEb is inputted to the data driver 130Fb.

Additionally, at this stage in the common control unit 134F, as the clock signal SCa is generated which changes signal level corresponding to the shift clock signal SFC by the NAND circuit 351 and the inverter 353, the clock signal Scb which is not involved with the shift clock signal SFC but has a low-level by the NAND 352 and the inverter 354 is generated and outputted to the data driver 130Fb.

Thereby, in the data driver 130Fa, as the output control transistor of the gradation current generation supply circuits PXF provided corresponding to the odd lines performs an "OFF" operation based on the clock signal SCa generated by the common control unit 134F which outputs sequentially from the shift register circuit to each of the gradation current generation supply circuits PXF, the take-in and hold operation of the display data d0~d3 corresponding to the odd lines in the i-th line and the refresh operation of the current generation section are executed.

In addition, at this stage in the data driver 130Fb, as the output control transistor of the gradation current generation supply circuit PXF provided corresponding to the even lines performs an "ON" operation based on the display data d0~d3 corresponding to the even lines in the (i−1) line taken in and held at previous timing (data take-in selection period (i−1 <in>)), the gradation currents Ipix having predetermined current values are generated and supplied simultaneously (in parallel) to each of the display pixels of even numbered sequence via the even lines of the display panel.

Subsequently, by inputting the high-level selection setting signal SEL in the second half ($2^{nd}$ ½) of the data take-in selection period (i <in>) in the i-th line, as the high-level non-inverted signal SEa is inputted to the data driver 130Fa from the common control unit 134F (selection setting circuit 350), the low-level inverted signal SEb is inputted to the data driver 130Fb.

Furthermore, at this stage, in the common control unit 134F, as the clock signal SCa which is not involved with the shift clock SFC but having the low-level by the NAND circuit 351 and the inverter 353 is generated and outputted to the data driver 130Fa, the clock signal SCb which changes signal level corresponding to the shift clock signal SFC is generated and outputted to the data driver 130Fb.

Thereby, in the data driver 130Fb, as the output control transistor of the gradation current generation circuits performs an "OFF" operation based on the clock signal SCb generated by the common control unit 134F which outputs sequentially from the shift register circuit to each of the gradation current generation supply circuits PXF, the take-in and hold operation of the display data d0~d3 corresponding to the even lines in the i-th line and the refresh operation of the current generation section are executed.

In addition, at this stage, in the data driver 130Fa, as the output control transistor of the gradation current generation supply circuit PXF performs an "ON" operation based on the display data d0~d3 corresponding to the odd lines in the i-th line taken in and held in the first half of the data take-in selection period (i <in>) in the i-th line mentioned above, the gradation currents Ipix having predetermined current values are generated and supplied simultaneously (in parallel) to each of the display pixels of odd numbered sequence via the odd lines of the display panel. Thus, as shown in FIG. 27, the period of the second half of the data take-in selection period (i <in>) in the i-th line is set simultaneous and in parallel in order to overlap in terms of time as the first half ($1^{st}$ ½) of the data output selection period (i <out>) in the i-th line.

Subsequently, in the second half ($2^{nd}$ ½) of the data output selection period (i <out>) in the i-th line by one again inputting the low-level selection setting signal SEL, as the output control transistor provided in the gradation current generation circuits provided in the data driver 130Fb performs an "ON" operation based on the display data d0~d3 corresponding to the even lines in the i-th line taken in and held to the data latch section in the second half of the data take-in selection period (i <in>) mentioned above, the gradation currents Ipix having predetermined current values are generated and supplied simultaneously (in parallel) to each of the display pixels of even numbered sequence via the even lines of the display panel.

At this phase simultaneously, as the output control transistor of the gradation current generation supply circuit PXF provided in the data driver 130Fa performs an "OFF" operation based on the shift signals SR outputted sequentially from the shift register circuit 131F, the take-in and hold operation of the display data d0~d3 in the (i+1) line corresponding to the odd lines in the i-th line and the refresh operation of the current generation section are executed. Thus, as shown in FIG. 27, the period of the second half of the data output selection period (i <out>) in the i-th line is set simultaneous and in parallel in order to overlap in terms of time as the first half ($1^{st}$ ½) of the data take-in selection period (i+1 <in>) in the (i+1) line.

Therefore, according to the display device and data driver related to this embodiment, while achieving the equivalent features of the above-mentioned fifth embodiment by placing two sets of the data driver in the upper part and lower part of the display panel, the circuit scale of each data driver can be further reduced as compared with the data driver of the above-mentioned fifth embodiment. Also, the frame portion installed of the display device can be narrowed as well as miniaturization of the display device or enlargement of the display area size can be acquired.

In addition, in the display device related to each embodiment mentioned above, even though the configuration corresponding to the current application method is explained as the data drivers and the display pixels (pixel driver circuits), the present invention is not limited to this and applied to a gradation current generation circuit using each configuration of the current generation supply circuit ILB as shown in FIG. 4 and FIG. 5 as the base element. It is emphasized that the present invention can have a configuration corresponding to the current sinking method which is supplied so that the gradation currents Ipix can be flowed in the direction of the data driver from the display pixels side.

While the present invention has been described with reference to the preferred embodiments, it is intended that the invention be not limited by any of the details of the description thereof.

As this invention can be embodied in several forms without departing from the spirit of the essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds thereof are intended to be embraced by the claims.

What is claimed is:

1. A current generation supply circuit which supplies drive currents corresponding to digital signals to a plurality of loads comprising:

two signal holding circuits which take-in and hold the digital signals;

at least one current generation circuit which generates and supplies to the plurality of loads the drive currents having a ratio of current values corresponding to the digital signal values held in one of the signal holding circuits relative to a reference current supplied from a constant current source; and an operational state setting circuit which sets an operating state in each of the signal holding circuits and the at least one current generation circuit to execute with overlapped timing at least a take-in and hold operation of the digital signals in the one of the signal holding circuits and a generation supply operation of the drive currents in the at least one current generation circuit based on the digital signal values held in the other of the signal holding circuits.

2. The current generation supply circuit according to claim 1, wherein the two signal holding circuits are constituted by an initial stage signal holding circuit and a latter stage signal holding circuit connected in series with each other, and wherein the operational state setting circuit sets the operating state to execute with overlapped timing an operation which takes-in and holds the digital signals in the initial stage signal holding circuit and an operation which outputs the outputted signals to the at least one current generation circuit based on each bit value of the digital signals held in the latter stage signal holding circuit.

3. The current generation supply circuit according to claim 2, wherein the at least one current generation circuit comprises two current generation circuits connected in parallel with each other; and wherein the operational state setting circuit selectively sets the operating state in the two current generation circuits for supplying the outputted signals to the two current generation circuits based on each bit value of the digital signals held in the latter signal holding circuit, and executes an operation for generating the drive currents in either of the two current generation circuits corresponding to each bit value of the digital signals.

4. The current generation supply circuit according to claim 1, wherein the at least one current generation circuit comprises a charge storage circuit which stores electrical charges corresponding to a current component of the reference current.

5. The current generation supply circuit according to claim 4, further comprising a refresh circuit which refreshes a charge amount stored in the charge storage circuit provided in the at least one current generation circuit to a charge amount corresponding to the reference current, and wherein the operational state setting circuit sets the operating state in the refresh circuit.

6. The current generation supply circuit according to claim 5, wherein the operational state setting circuit sets the operating state to execute with overlapped timing a take-in and hold operation of the plurality of digital signal bits in the one of the signal holding circuits and a refresh operation of the charge storage circuit in the refresh circuit.

7. The current generation supply circuit according to claim 5, wherein the operational state setting circuit sets the operating state to execute without overlapped timing a take-in and hold operation of the digital signals in the one of the signal holding circuits, a generation supply operation of the drive currents in the at least one current generation circuit, and a refresh operation of the charge storage circuit in the refresh circuit.

8. The current generation supply circuit according to claim 1, wherein the at least one current generation circuit comprises a module current generation circuit which generates a plurality of module currents having a ratio of current values different from each other relative to the reference current corresponding to each bit value of the digital signals.

9. The current generation supply circuit according to claim 8, wherein each current value of the plurality of module currents has a different ratio from each other defined by $2^n$ (n=0, 1, 2 and 3, . . . ).

10. The current generation supply circuit according to claim 8, wherein the module current generation circuit comprises a reference current transistor in which the reference current flows and a plurality of module current transistors in which each of the module currents flow.

11. The current generation supply circuit according to claim 10, wherein each control terminal of the reference current transistor and the plurality of module current transistors are connected in common and constitute a current mirror circuit.

12. The current generation supply circuit according to claim 10, wherein the plurality of module current transistors have different transistor sizes from each other.

13. The current generation supply circuit according to claim 12, wherein the plurality of module current transistors each have a channel width set at a different ratio from each other defined by $2^n$ (n=0, 1, 2 and 3, . . . ).

14. The current generation supply circuit according to claim 8, wherein the at least one current generation circuit further comprises a current selection circuit which selectively integrates the plurality of module currents and generates the drive currents corresponding to each bit value of the digital signals held in one of the signal holding circuits.

15. The current generation supply circuit according to claim 14, wherein the current selection circuit comprises a selection switch which selects the plurality of module currents corresponding to each bit value of the digital signals.

16. The current generation supply circuit according to claim 1, wherein the at least one current generation circuit sets a polarity of the drive currents in order to flow the drive currents in a direction from a side of the loads.

17. The current generation supply circuit according to claim 1, wherein the at least one current generation circuit sets a polarity of the drive currents in order to flow the drive currents in a direction to a side of the loads.

18. The current generation supply circuit according to claim 1, wherein the plurality of loads comprise current control type light emitting devices which execute a light generation operation at predetermined luminosity gradations corresponding to the current values of the drive currents.

19. The current generation supply circuit according to claim 18, wherein the light emitting devices are organic electroluminescent devices.

20. A display device which displays image information corresponding to display signals the display device comprising:

a display panel comprising a plurality of scanning lines and a plurality of signal lines positioned to intersect perpendicularly with each other and a plurality of display pixels arranged in matrix form near intersecting points of the scanning lines and the signal lines;

a scanning driver circuit which sequentially applies scanning signals to the plurality of scanning lines for setting a selection state in each of the display pixels a-line-at-a-time; and a signal driver circuit comprising at least one gradation current generation supply circuit group including a plurality of gradation current generation supply circuits corresponding to each of the plurality of signal lines, wherein each of the plurality of gradation current generation supply circuits comprises:

two signal holding circuits which take-in and hold digital signals of the display signals;

at least one gradation current generation circuit which generates gradation currents having a ratio of current values and supplies to each of the plurality of signal lines corresponding to the values of the digital signals held in one of the signal holding circuits relative to a reference current supplied from a constant current source; and an operational state setting circuit which sets an operating state in each of the signal holding circuits and the at least one gradation current generation circuit to execute with overlapped timing at least a take-in and hold operation of the digital signals in the one of the signal holding circuits and a generation supply operation of the gradation currents in the at least one gradation current generation circuit based on the digital signals that are held in the other of the signal holding circuits.

21. The display device according to claim 20, wherein the two signal holding circuits are constituted by an initial stage signal holding circuit and a latter stage signal holding circuit connected in series with each other, and wherein the operational state setting circuit sets the operating state to execute with overlapped timing at least an operation which takes in and holds the display signals to the initial stage signal holding circuit and an operation which outputs the outputted signals to the at least one current generation circuit based on each bit value of the digital signals held in the latter stage signal holding circuit.

22. The display device according to claim 20, wherein the at least one gradation current generation circuit comprises two current gradation current generation circuits connected in parallel with each other, and wherein the operational state setting circuit selectively sets the operating state in the two gradation current generation circuits and at least executes an operation which generates the gradation currents corresponding to each bit value of the display signals in either of the two gradation current generation circuits and supplies the outputted signals based on each bit value of the display signals held in the one of the signal holding circuits supplied to the two gradation current generation circuits.

23. The display device according to claim 20, wherein:

the signal driver circuit comprises two of the gradation current generation supply circuit groups at least for each of the plurality of signal lines, each of the gradation current generation supply circuit groups are arranged in position at opposite ends of the display panel, and the operational state setting circuit sets the operating state to execute with overlapped timing at least a take-in and hold operation of the plurality of digital signal bits in each of the signal holding circuits of each of the gradation current generation supply circuits of one of the gradation current generation supply circuit groups and a generation supply operation of the gradation currents in each of the at least one gradation current generation circuits of each of the gradation current generation supply circuits of the other of the gradation current generation supply circuit groups.

24. The display device according to claim 20, wherein:

the signal driver circuit comprises two of the gradation current generation supply circuit groups at least corresponding to each of the signal lines, the plurality of signal lines are grouped into two sets, and the operational state setting circuit sets the operating state to execute with overlapped timing at least a take-in and hold operation of the digital signals in each of the signal holding circuits of each of the gradation current generation supply circuits of one of the gradation current generation supply circuit groups and a generation supply operation of the gradation currents in each of the at least one gradation current generation circuits of each of the gradation current generation supply circuits of the other of the gradation current generation supply circuit groups.

25. The display device according to claim 24, wherein the two gradation current generation supply circuit groups are arranged at opposite ends of the display panel from each other.

26. The display device according to claim 24, wherein each group is grouped to a same number of each one of the signal lines among the plurality of signal lines allocated to the display panel.

27. The display device according to claim 24, wherein each group is grouped to a same number of each one of a predetermined number of signal lines among the plurality of signal lines allocated to the display panel.

28. The display device according to claim 20, wherein the at least one gradation current generation circuit comprises a charge storage circuit which stores electrical charges corresponding to a current component of the reference current.

29. The display device according to claim 28, wherein each of the gradation current generation supply circuits comprises a refresh circuit which refreshes a charge amount stored in the charge storage circuit provided in the at least one current generation circuit to a charge amount corresponding to the reference current; and wherein the operational state setting circuit sets the operating state in the refresh circuit.

30. The display device according to claim 29, wherein the operational state setting circuit sets the operating state to execute with overlapped timing a take-in and hold operation of the display signals in the one of the signal holding circuits, and a refresh operation of the charge storage circuit in the refresh circuit.

31. The display device according to claim 29, wherein the operational state setting circuit sets the operating state to execute without overlapped timing a take-in and hold operation of the display signals in the one of the signal holding circuits and a generation supply operation of the drive currents in the at least one gradation current generation circuit, and a refresh operation of the charge storage circuit in the refresh circuit.

32. The display device according to claim 20, wherein the at least one gradation current generation circuit comprises a module current generation circuit which generates a plurality of module currents having a ratio of current values different from each other relative to the reference current.

33. The display device according to claim 32, wherein each current value of the plurality of module currents has a different ratio from each other defined by $2^n$ (n=0, 1, 2 and 3, . . . ).

34. The display device according to claim 32, wherein the module current generation circuit comprises a reference current transistor in which the reference current flows and a plurality of module current transistors in which each of the module currents flow.

35. The display device according to claim 34, wherein the reference current transistor and the plurality of module current transistors are connected in common and each control terminal constitutes a current mirror circuit.

36. The display device according to claim 34, wherein the plurality of module current transistors have different transistor sizes from each other.

37. The display device according to claim 36, wherein the plurality of module current transistors each have a channel width set at a different ratio from each other defined by $2^n$ (n=0, 1, 2 and 3, . . . ).

38. The display device according to claim 32, wherein the at least one gradation current generation circuit further comprises a current selection circuit which integrates selectively the plurality of module currents corresponding to each bit value of the digital signals held in one of the signal holding circuits and generates the gradation currents.

39. The display device according to claim 38, wherein the current selection circuit comprises a selection switch which selects the plurality of module currents corresponding to each bit value in the digital signals of the display signals.

40. The display device according to claim 38, wherein the at least one gradation current generation supply circuit comprises a specified state setting circuit which applies a specified voltage to the scanning lines for making optical elements drive at a specified operating state.

41. The display device according to claim 40, wherein the specified values of the display signals are values in which each of the module currents are entirely non-selected by each bit in the digital signals of the display signals, and the specified voltage is a voltage for making the optical elements drive in a state of lowermost gradation.

42. The display device according to claim 20, wherein the at least one gradation current generation circuit sets a polarity of the gradation currents in order to flow in a direction of flow via the signal lines from a display pixel side.

43. The display device according to claim 20, wherein the gradation current generation circuit sets a polarity of the gradation currents in order to flow in a direction of flow toward a display pixel side via the signal lines.

44. The display device according to claim 20, wherein the display pixels in the display panel comprise current control type light emitting devices which execute a light generation operation by predetermined luminosity gradations corresponding to the current values of the gradation currents.

45. The display device according to claim 44, wherein the display pixels comprise pixel driver circuits which hold the gradation currents, and generate light generation currents based on the held gradation currents and supply the light generation currents to the light emitting devices.

46. The display device according to claim 44, wherein the light emitting devices are organic electroluminescent devices.

47. A drive control method for a display device which displays image information corresponding to display signals consisting of digital signals to a display panel comprising a plurality of display pixels, wherein the display device comprises two signal holding circuits that take in and hold the digital signals of the display signals, and wherein the method comprises:

taking in and holding each bit of the digital signals of the display signal in the signal holding circuits;

generating gradation currents relative to each of the plurality of display pixels;

supplying the gradation currents to the display pixels and displaying the image information on the display panel; and executing consecutively at least:

an operation which generates the gradation currents based on the display signals taken in and held into one of the signal holding circuits at previous timing and supplies the display pixels;

an operation which takes in and holds the display signals into the other of the signal holding circuits executed in order to overlap in terms of time, whereby the display signals are supplied to the display pixels consecutively; and an operation which takes in and holds the display signals and supplies consecutively the display signals.

48. The drive control method for the display device according to claim 47, wherein the two signal holding circuits are constituted by an initial stage holding circuit and a latter stage signal holding circuit connected in series with each other, and wherein the method includes:

an operation which takes in and holds each bit of the display signals;

the display signals are taken-in to the initial stage signal holding circuit;

the taken-in display signals are transferred to the latter stage signal holding circuit; and an operation which outputs the output signals based on each bit value of the transferred display signals from the latter stage signal holding circuit; and at least the take-in operation of the display signals to the initial stage signal holding circuit and the output operation which outputs the output signals based on the transferred display signal from the latter stage signal holding circuit execute with overlapped timing.

49. The drive control method of the display device according to claim 47, wherein the operation which generates the gradation currents includes:

a plurality of module currents corresponding to each bit of the display signals are generated based on a reference current supplied from a constant current source, the plurality of module currents are integrated selectively relative to each bit value of the held display signals, and the gradation currents are generated.

50. The drive control method of the display device according to claim 49, wherein the plurality of module currents are set to have a ratio of current values different from each other relative to the reference current corresponding to each bit value of the digital signals.

51. The drive control method of the display device according to claim 50, wherein each current value of the plurality of module currents has a different ratio from each other defined by $2^n$ (n =0, 1, 2 and 3, . . . ).

52. The drive control method of the display device according to claim 49, wherein the operation which generates the plurality of module currents corresponding to a current component of the reference current and the electrical charge is stored in a charge storage circuit based on a voltage component corresponding to a charge amount stored in the charge storage circuit and the plurality of module currents are generated.

53. The drive control method of the display device according to claim 52, wherein preceding the operation which generates the gradation currents includes an operation which refreshes the charge amount stored in the charge storage circuit corresponding to the reference current.

54. The drive control method of the display device according to claim 52, wherein the operation which takes-in the display signal and the operation which refreshes the charge amount stored in the charge storage circuit corresponding to the reference current are executed with overlapped timing.

55. The drive control method of the display device according to claim 52, wherein the take-in of the display signals and the operation which generates the drive currents supplied to the loads, and the operation which refreshes the charge amount stored in the charge storage circuit corresponding to the reference current are executed without overlapped timing.

56. The drive control method of the display device according to claim 52, wherein the operation which generates the gradation currents based on the display signals and supplied to the display pixels by one gradation current generation circuit of two gradation current generation circuits connected in parallel with each other, and the operation which refreshes the charge amount stored in the charge storage circuit corresponding to the reference current provided in the gradation current generation circuit of the other one of the two gradation current generation circuits is executed with overlapped timing.

57. The drive control method of the display device according to claim 47, wherein a polarity is set in order that the gradation currents flow in a direction from a display pixels side.

58. The drive control method of the display device according to claim 47, wherein a polarity is set in order that the gradation currents flow in a direction to a display pixels side.

59. The drive control method of the display device according to claim 47, wherein the display pixels comprise current control type light emitting devices which execute a light generation operation by predetermined luminosity gradations corresponding to the current values of the gradation currents.

60. The drive control method of the display device according to claim 59, wherein the light emitting devices are organic electroluminescent devices.

* * * * *